US006506717B1

(12) United States Patent
Kott et al.

(10) Patent No.: US 6,506,717 B1
(45) **Date of Patent: *Jan. 14, 2003**

(54) DISHWASHING COMPOSITIONS COMPRISING MODIFIED ALKYBENZENE SULFONATES

(75) Inventors: Kevin Lee Kott, Cincinnati, OH (US); Jeffrey John Scheibel, Loveland, OH (US); Roland George Severson, Cincinnati, OH (US); Thomas Anthony Cripe, Loveland, OH (US); James Charles Theophile Roger Burckett-St. Laurent, Cincinnati, OH (US); William Michael Scheper, Lawrenceburg, IN (US); Chandrika Kasturi, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/889,629

(22) PCT Filed: Dec. 15, 1999

(86) PCT No.: PCT/US99/29949

§ 371 (c)(1),
(2), (4) Date: Jul. 19, 2001

(87) PCT Pub. No.: WO00/43475

PCT Pub. Date: Jul. 27, 2000

Related U.S. Application Data

(60) Provisional application No. 60/116,680, filed on Jan. 20, 1999.

(51) Int. Cl.[7] ..... C11D 17/00

(52) U.S. Cl. ..... 510/357; 510/424; 510/426; 510/428

(58) Field of Search ..... 510/357, 424, 510/426, 428

(56) References Cited

U.S. PATENT DOCUMENTS 6,306,817 B1 * 10/2001 Kott et al. ..... 510/535

FOREIGN PATENT DOCUMENTS

| | | |
|---|---|---|
| EP | 615968 A1 | 9/1994 |
| WO | WO99/05244 A1 | 2/1999 |
| WO | WO99/07656 A2 | 2/1999 |

* cited by examiner

*Primary Examiner*—Necholus Ogden
(74) *Attorney, Agent, or Firm*—Frank Taffy; C. Brant Cook; Kim W. Zerby

(57) ABSTRACT

The present invention relates to surfactant mixtures, improved detergent and cleaning products containing particular types of modified alkylbenzenesulfonate surfactants.

28 Claims, No Drawings

DISHWASHING COMPOSITIONS COMPRISING MODIFIED ALKYBENZENE SULFONATES

This application claims benefit of provisional application No. 60/116,680 filed Jan. 20, 1999.

FIELD OF THE INVENTION

The present invention relates to dishwashing compositions comprising particular types of inproved alkylbenzene sulfonate surfactant mixtures adapted for use by controlling compositional parameters, especially a 2/3-phenyl index and a 2-methyl-2-phenyl index.

BACKGROUND OF THE INVENTION

Historically, highly branched alkylbenzene sulfonate surfactants, such as those based on tetrapropylene, known as "ABS" or "TPBS", were used in detergents. However, these were found to be very poorly biodegradable. A long period followed of improving manufacturing processes for alkylbenzene sulfonates, making them as linear as practically possible, hence the acronym "LAS". The overwhelming part of a large art of linear alkylbenzene sulfonate surfactant manufacture is directed to this objective. All relevant large-scale commercial alkylbenzene sulfonate processes in use today are directed to linear alkylbenzene sulfonates. However, linear alkylbenzene sulfonates are not without limitations; for example, they would be more desirable if improved for hard water cleaning and/or cold water cleaning properties. They can often fail to produce good cleaning results, for example when. used in hard water areas.

As a result of the limitations of the alkylbenzene sulfonates, consumer cleaning formulations have often needed to include a higher level of cosurfactants, builders, and other additives than would have been needed given a superior alkylbenzene sulfonate.

The art of alkylbenzene sulfonate detergents is replete with references which teach both for and against almost every aspect of these compositions. Moreover, there are believed to be erroneous teachings and technical misconceptions about the mechanism of LAS operation under in-use conditions, particularly in the area of hardness tolerance. The volume of such references debases the art as a whole and makes it difficult to select the useful teachings from the useless without repeated experimentation. To further understand the state of the art, it should be appreciated that there has been not only a lack of clarity on which way to go to fix the unresolved problems of linear LAS, but also a range of misconceptions, not only in the understanding of biodegradation but also in basic mechanisms of operation of LAS in presence of hardness.

Also, while the currently commercial, essentially linear alkylbenzene sulfonate surfactants are relatively simple compositions to define and analyze, compositions containing both branched and linear alkylbenzene sulfonate surfactants are complex. In general such compositions can be highly varied, containing one or more different kinds of branching in any of a number of positions on the aliphatic chain. A very large number, e.g., hundreds, of distinct chemical species are possible in such mixtures. Accordingly there is an onerous burden of experimentation if it is desired to improve such compositions so that they can clean better in detergent compositions while at the same time remaining biodegradable. The formulator's knowledge is key to guiding this effort.

Yet another currently unresolved problem in alkylbenzene sulfonate manufacture is to make more effective use of current LAB feedstocks. It would be highly desirable, both from a performance point of view and from an economic point of view, to better utilize certain desirable types of branched hydrocarbons.

Accordingly there is a substantial unmet need for further improvements in alkylbenzene sulfonate surfactant mixtures, especially with respect to those offering one or more of the advantages of superior cleaning, hardness tolerance, satisfactory biodegradability, and cost.

BACKGROUND ART

U.S. Pat. Nos. 5,659,099, 5,393,718, 5,256,392, 5,227,558, 5,139,759, 5,164,169, 5,116,794, 4,840,929, 5,744,673, 5,522,984, 5,811,623, 5,777,187, WO 9,729,064, WO 9,747573, WO 9,729,063, U.S. Pat. Nos. 5,026,933; 4,990,718; 4,301,316; 4,301,317; 4,855,527; 4,870,038; 2,477,382; EP 466,558, Jan. 15, 1992; EP 469,940, Feb. 5, 1992; FR 2,697,246, Apr. 29, 1994; SU 793,972, Jan. 7, 1981; U.S. Pat. Nos. 2,564,072; 3,196,174; 3,238,249; 3,355,484; 3,442,964; 3,492,364; 4,959,491; WO 88/07030, Sep. 25, 1990; U.S. Pat. Nos. 4,962,256, US 5,196,624; 5,196,625; EP 364,012 B, Feb. 15, 1990; U.S. Pat. Nos. 3,312,745; 3,341,614; 3,442,965; 3,674,885; 4,447,664; 4,533,651; 4,587,374; 4,996,386; 5,210,060; 5,510,306; WO 95117961, Ju. 6, 1995; WO 95/18084; U.S. Pat. Nos. 5,510,306; 5,087,788; 4,301,316; 4,301,317; 4,855,527; 4,870,038; 5,026,933; 5,625,105 and 4,973,788. See Vol 56 in "Surfactant Science" series, Marcel Dekker, New York, 1996, including in particular Chapter 2 entitled "Alkylarylsulfonates: History, Manufacture, Analysis and Environmental Properties", pages 39–108, "Surfactant Science" series, Vol 73, Marcel Dekker, New York, 1998 and "Surfactant Science" series, Vol 40, Marcel Dekker, New York, 1992. See also copending U.S. patent applications Ser. No. 60/053,319 filed on Jul. 21st, 1997, Ser. No. 60/053,318, filed on Jul. 21st, 1997, Ser. No. 60/053,321, filed on Jul. 21st, 1997, Ser. No. 60/053,209, filed on Jul. 21st, 1997, Ser. No. 60/053,328, filed on Jul. 21st, 1997, Ser. No. 60/053,186, filed on Jul. 21st, 1997 and the art cited therein. Documents referenced herein are incorporated in their entirety.

SUMMARY OF THE INVENTION

It has now been determined that the use of certain alkylbenzene sulfonate surfactant mixtures, hereinafter "modified alkylbenzene sulfonate surfactant mixtures", as outlined in detail below, leads to improved cleaning of tough food stains, removal of grease/oil, improved benefits in dissolution, rinsing and low temperature product stability when compared to the use LAS in conventional detergent compositions.

The hand dishwashing compositions according to the first embodiment of the present invention comprises:

(i) from about 0.01% to about 95%, preferably from about 1% to about 50%, preferably from about 2% to about 30%, by weight of composition of a modified alkylbenzene sulfonate surfactant mixture comprising:

(a) from about 60% to about 95% by weight, preferably from about 65% to about 90%, more preferably from about 70% to about 85%, by weight of surfactant mixture, a mixture of branched alkylbenzene sulfonates having formula (I):

(I)

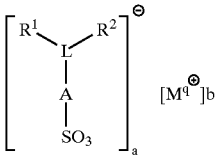

wherein L is an acyclic aliphatic moiety consisting of carbon and hydrogen, said L having two methyl termini and said L having no substituents other than A, $R^1$ and $R^2$; and wherein said mixture of branched alkylbenzene sulfonates contains two or more, preferably at least three, optionally more, of said branched alkylbenzene sulfonates differing in molecular weight of the anion of said formula (I) and wherein said mixture of branched alkylbenzene sulfonates has a sum of carbon atoms in $R^1$, L and $R^2$ of from 9 to 15, preferably from 10 to 14;

an average aliphatic carbon content, i.e., based on $R^1$, L and $R^2$ and excluding A, of from about 10.0 to about 14.0 carbon atoms, preferably from about 11.0 to about 13.0, more preferably from about 11.5 to about 12.5; M is a cation or cation mixture, preferably M is selected from H, Na, K, Ca, Mg and mixtures thereof, more preferably M is selected from H, Na, K and mixtures thereof, more preferably still, M is selected from H, Na, and mixtures thereof, M having a valence q, typically from 1 to 2, preferably 1; a and b are integers selected such that said branched alkylbenzene sulfonates are electroneutral (a is typically from 1 to 2, preferably 1, b is 1); $R^1$ is $C_1$–$C_3$ alkyl, preferably $C_1$–$C_2$ alkyl, more preferably methyl; $R^2$ is selected from H and $C_1$–$C_3$ alkyl (preferably H and $C_1$–$C_2$ alkyl, more preferably H and methyl, more preferably H and methyl provided that in at least about 0.5, more preferably 0.7, more preferably 0.9 to 1.0 mole fraction of said branched alkylbenzene sulfonates, $R^2$ is H); A is a benzene moiety (typically A is the moiety—$C_6H_4$—, with the $SO_3$ moiety of Formula (I) in para- position to the L moiety, though in some proportion, usually no more than about 5%, preferably from 0 to 5% by weight, the $SO_3$ moiety is ortho- to L); and (b) from about 5% to about 40%, preferably from about 10% to about 35%, more preferably from about 15% to about 30%, by weight of surfactant mixture, of a mixture of nonbranched alkylbenzene sulfonates having formula (II):

(II)

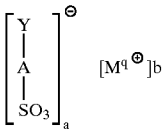

wherein a, b, M, A and q are as defined hereinbefore and Y is an unsubstituted linear aliphatic moiety consisting of carbon and hydrogen having two methyl termini, and wherein said Y has a sum of carbon atoms of from 9 to 15, preferably from 10 to 14, and said Y has an average aliphatic carbon content of from about 10.0 to about 14.0, preferably from about 11.0 to about 13.0, more preferably 11.5 to 12.5 carbon atoms; and wherein said modified alkylbenzene sulfonate surfactant mixture is further characterized by a 2/3-phenyl index of from about 275 to about 10,000, preferably from about 350 to about 1200, more preferably from about 500 to about 700; and also preferably wherein said modified alkylbenzene sulfonate surfactant mixture has a 2-methyl-2-phenyl index of less than about 0.3, preferably less than about 0.2, more preferably less than about 0.1, more preferably still, from 0 to 0.05;

(ii) from about 0.00001% to about 99.9% by weight of a conventional hand dishwashing adjunct;

wherein said composition is further characterized by a 2/3-phenyl index of from about 275 to about 10,000.

The hand dishwashing compositions according to the second embodiment of the present invention comprises:

(i) a modified alkylbenzene sulfonate surfactant mixture, preferably from about 0.01% to about 95%, more preferably from about 1% to about 50%, even more preferably from about 2% to about 30%, by weight of composition, comprising the product of a process comprising the steps of:

(I) alkylating benzene with an alkylating mixture;

(II) sulfonating the product of (I); and (III) optionally but very preferably, neutralizing the product of (II);

wherein said alkylating mixture comprises:

(a) from about 1% to about 99.9%, by weight of alkylating mixture of branched $C_9$–$C_{20}$ (preferably $C_9$–$C_{15}$, more preferably $C_{10}$–$C_{14}$) monoolefins, said branched monoolefins having structures identical with those of the branched monoolefins formed by dehydrogenating branched paraffins of formula $R^1LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of alkylating mixture of $C_9$–$C_{20}$ (preferably $C_9$–$C_{15}$, more preferably $C_{10}$–$C_{14}$) linear aliphatic olefins;

wherein said alkylating mixture contains said branched $C_9$–$C_{20}$ (preferably $C_9$–$C_{15}$, more preferably $C_{10}$–$C_{14}$) monoolefins having at least two different carbon numbers in said $C_9$–$C_{20}$ (preferably $C_9$–$C_{15}$, more preferably $C_{10}$–$C_{14}$) range, and has a mean carbon content of from about 9.0 to about 15.0 carbon atoms (preferably from about 10.0 to about 14.0, more preferably from about 11.0 to about 13.0, more preferably still from about 11.5 to about 12.5); and wherein said components (a) and (b) are at a weight ratio of at least about 15:85 (preferably having branched component (a) in excess of linear component (b), for example 51% or more by weight of (a) and 49% or less of (b), more preferably 60% to 95% by weight of (a) and 5% to 40% of (b), more preferably still 65% to 90% by weight of (a) and 10% to 35% of (b), more preferably still 70% to 85% by weight of (a) and 15% to 30% of (b) wherein these percentages by weight exclude any other materials, for example diluent hydrocarbons, that may be present in the process;

(ii) from about 0.00001% to about 99.9% by weight of composition of a conventional hand dishwashing adjunct;

wherein said composition is further characterized by a 2/3-phenyl index of from about 275 to about 10,000.

The hand dishwashing compositions according to the third embodiment of the present invention comprises:

(i) A modified alkylbenzene sulfonate surfactant mixture, preferably from about 0.01% to about 95%, more preferably from about 1% to about 50%, even more preferably from about 2% to about 30%, by weight of composition, consisting essentially of the product of a process comprising the steps, in sequence, of:

(I) alkylating benzene with an alkylating mixture;

(II) sulfonating the product of (I); and (III) neutralizing the product of (II);

wherein said alkylating mixture comprises:

(a) from about 1% to about 99.9%, by weight of alkylating mixture of a branched alkylating agent selected from the group consisting of:

(A) $C_9$–$C_{20}$ (preferably $C_9$–$C_{15}$, more preferably $C_{10}$–$C_{14}$) internal monoolefins $R^1LR^2$ wherein L is an acyclic olefinic moiety consisting of carbon and hydrogen and containing two terminal methyls;

(B) $C_9$–$C_{20}$ (preferably $C_9$–$C_{15}$, more preferably $C_{10}$–$C_{14}$) alpha monoolefins $R^1AR^2$ wherein A is an acyclic alpha-olefinic moiety consisting of carbon and hydrogen and containing one terminal methyl and one terminal olefinic methylene;

(C) $C_9$–$C_{20}$ (preferably $C_9$–$C_{15}$, more preferably $C_{10}$–$C_{14}$) vinylidene monoolefins $R^1BR^2$ wherein B is an acyclic vinylidene olefin moiety consisting of carbon and hydrogen and containing two terminal methyls and one internal olefinic methylene;

(D) $C_9$–$C_{20}$ (preferably $C_9$–$C_{15}$, more preferably $C_{10}$–$C_{14}$) primary alcohols $R^1QR^2$ wherein Q is an acyclic aliphatic primary terminal alcohol moiety consisting of carbon, hydrogen and oxygen and containing one terminal methyl;

(E) $C_9$–$C_{20}$ (preferably $C_9$–$C_{15}$, more preferably $C_{10}$–$C_{14}$) primary alcohols $R^1ZR^2$ wherein Z is an acyclic aliphatic primary nonterminal alcohol moiety consisting of carbon, hydrogen and oxygen and containing two terminal methyls; and (F) mixtures thereof;

wherein in any of (A)–(F), said $R^1$ is $C_1$ to $C_3$ alkyl and said $R^2$ is selected from H and $C_1$ to $C_3$ alkyl; and (b) from about 0. 1% to about 85%, by weight of alkylating mixture of $C_9$–$C_{20}$ (preferably $C_9$–$C_{15}$, more preferably $C_{10}$–$C_{14}$) linear alkylating agent selected from $C_9$–$C_{20}$ (preferably $C_9$–$C_{15}$, more preferably $C_{10}$–$C_{14}$) linear aliphatic olefins, $C_9$–$C_{20}$ (preferably $C_9$–$C_{15}$, more preferably $C_{10}$–$C_{14}$) linear aliphatic alcohols and mixtures thereof;

wherein said alkylating mixture contains said branched alkylating agents having at least two different carbon numbers in said $C_9$–$C_{20}$ (preferably $C_9$–$C_{15}$, more preferably $C_{10}$–$C_{14}$) range, and has a mean carbon content of from about 9.0 to about 15.0 carbon atoms, preferably from about 10.0 to about 14.0, more preferably from about 11.0 to about 13.0, more preferably still from about 11.5 to about 12.5; and wherein said components (a) and (b) are at a weight ratio of at least about 15:85 (preferably having branched component (a) in excess of linear component (b), for example 51% or more by weight of (a) and 49% or less of (b), more preferably 60% to 95% by weight of (a) and 5% to 40% of (b), more preferably still 65% to 90% by weight of (a) and 10% to 35% of (b), more preferably still 70% to 85% by weight of (a) and 15% to 30% of (b) wherein these percentages by weight exclude any other materials, for example diluent hydrocarbons, that may be present in the process).;

(i) from about 0.00001% to about 99.9% by weight of composition of a conventional hand dishwashing adjunct;

wherein said composition is further characterized by a 2/3-phenyl index of from about 275 to about 10,000.

In accordance with the fourth embodiments of the present invention, there are encompassed herein a number of alternate embodiments, such as those in which there is blending of the novel modified alkylbenzene sulfonate surfactant mixture of the invention with one or more other alkylbenzene sulfonate surfactants. In practical terms, such blending is usually encompassed before sulfonation and detergent formulation, but the outcome is a hand dishwashing composition containing a blend of the novel modified alkylbenzene sulfonate surfactant with other, known, alkylbenzene sulfonates. Such alternate embodiments of the invention nonlimitingly include those termed herein as "medium 2/3-phenyl surfactant system". Such surfactant system essentially contain useful amounts of the modified alkylbenzene sulfonate surfactant, along with other known alkylbenzene sulfonates subject to specific provisions of the 2/3-phenyl index of the overall composition. Such hand dishwashing compositions include:

(i) from about 0.1% to about 95% by weight of composition of a medium 2/3-phenyl surfactant system consisting essentially of:

(1) from 1% preferably at least about 5%, more preferably at least about 10%) to about 60% (preferably less than about 50%, more preferably less than about 40%), by weight of surfactant system of a first alkylbenzene sulfonate surfactant, wherein said first alkylbenzene sulfonate surfactant is a modified alkylbenzene sulfonate surfactant mixture, said surfactant mixture comprising:

(a) from about 60% to about 95% by weight of surfactant mixture, a mixture of branched alkylbenzene sulfonates having formula (I):

(I)

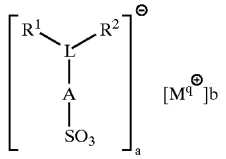

wherein L is an acyclic aliphatic moiety consisting of carbon and hydrogen, said L having two methyl termini and said L having no substituents other than A, $R^1$ and $R^2$; and wherein said mixture of branched alkylbenzene sulfonates contains two or more of said branched alkylbenzene sulfonates differing in molecular weight of the anion of said formula (I) and wherein said mixture of branched alkylbenzene sulfonates has a sum of carbon atoms in $R^1$, L and $R^2$ of from 9 to 15;

an average aliphatic carbon content of from about 10.0 to about 14.0 carbon atoms; M is a cation or cation mixture having a valence q; a and b are integers selected such that said branched alkylbenzene sulfonates are electroneutral; $R^1$ is $C_1$–$C_3$ alkyl; $R^2$ is selected from H and $C_1$–$C_3$ alkyl; A is a benzene moiety; and (b) from about 5% to about 40% by weight of surfactant mixture, of a mixture of nonbranched alkylbenzene sulfonates having formula (II):

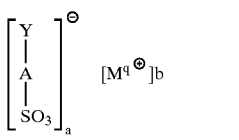

(II)

wherein a, b, M, A and q are as defined hereinbefore and Y is an unsubstituted linear aliphatic moiety consisting of carbon and hydrogen having two methyl termini, and wherein said Y has a sum of carbon atoms of from 9 to 15, preferably from 10 to 14, and said Y has an average aliphatic carbon content of from about 10.0 to about 14.0; and wherein said modified alkylbenzene sulfonate surfactant mixture is further characterized by a 2/3-phenyl index of from about 275 to about 10,000; and (2) from 40% (preferably at least about 50%, more preferably at least about 60%) to about 99% (preferably less than about 95%, more preferably less than about 90%), by weight of surfactant system of a second alkylbenzene sulfonate surfactant, wherein said second alkylbenzene sulfonate surfactant is an alkylbenzene sulfonate surfactant mixture other than said modified alkylbenzene sulfonate surfactant mixture (1) (typically said second alkylbenzene sulfonate surfactant is a conmmercial $C_{10}$–$C_{14}$ linear alkylbenzene sulfonate surfactant, e.g., DETAL® process LAS or HF process LAS though in general any commercial linear (LAS) or branched (ABS, TPBS) type can be used); and wherein said second alkylbenzene sulfonate surfactant has a 2/3-phenyl index of from about 75 to about 160 (preferably from about 170 to about 265, more preferably from about 180 to about 255).;

provided that said medium 2/3-phenyl surfactant system has a 2/3-phenyl index of from about 160 to about 275;

(i) from about 0.00001% to about 99.9% by weight of composition of a conventional hand dishwashing adjunct.

The above mentioned embodiments and other aspects of the present invention are more fully described and exemplified in the detailed description hereinafter.

All percentages, ratios and proportions herein are by weight, unless otherwise specified. All temperatures are in degrees Celsius (°C.) unless otherwise specified. All documents cited are in relevant part, incorporated herein by reference.

DETAILED DESCRIPTION OF THE INVENTION

The invention, on the other hand, is not intended to encompass any wholly conventional hand dishwashing detergent compositions, such as those based exclusively on linear alkylbenzene sulfonates made by any process, or exclusively on known unacceptably branched alkylbenzene sulfonates such as ABS or TPBS.

It is preferred that when the detergent compositions of the present invention comprise any alkylbenzene sulfonate surfactant other than said modified alkylbenzene sulfonate surfactant mixture (for example as a result of blending into the detergent composition one or more commercial, especially linear, typically linear $C_{10}$–$C_{14}$, alkylbenzene sulfonate surfactants), said composition is further characterized by an overall 2/3-phenyl index of at least about 200, preferably at least about 250, more preferably at least about 350, more preferably still, at least about 500, wherein said overall 2/3-phenyl index is determined by measuring 2/3-phenyl index, as defined herein, on a blend of said modified alkylbenzene sulfonate surfactant mixture and said any other alkylbenzene sulfonate to be added to said composition, said blend, for purposes of measurement, being prepared from aliquots of said modified alkylbenzene sulfonate surfactant mixture and said other alkylbenzene sulfonate not yet exposed to any other of the components of said composition; and further provided that when said composition comprises any alkylbenzene sulfonate surfactant other than said modified alkylbenzene sulfonate surfactant mixture (for example as a result of blending into the composition one or more commercial, especially linear, typically linear $C_{10}$–$C_{14}$, alkylbenzene sulfonate surfactants), said composition is further characterized by an overall 2-methyl-2-phenyl index of less than about 0.3, preferably from 0 to 0.2, more preferably no more than about 0.1, more preferably still, no more than about 0.05, wherein said overall 2-methyl-2-phenyl index is to be determined by measuring 2-methyl-2-phenyl index, as defined herein, on a blend of said modified alkylbenzene sulfonate surfactant mixture and any other alkylbenzene sulfonate to be added to said composition, said blend, for purposes of measurement, being prepared from aliquots of said modified alkylbenzene sulfonate surfactant mixture and said other alkylbenzene sulfonate not yet exposed to any other of the components of said composition. These provisions may appear somewhat unusual, however they are consistent with the spirit and scope of the present invention, which encompasses a number of economical but less preferred approaches in terms of overall cleaning performance, such as blending of the modified alkylbenzene sulfonate surfactants with conventional linear alkylbenzene sulfonate surfactants either during synthesis or during formulation into the detergent composition. Moreover, as is well known to practitioners of detergent analysis, a number of detergent adjuncts (paramagnetic materials and sometimes even water) are capable of interfering with methods for determining the parameters of alkylbenzene sulfonate surfactant mixtures as described hereinafter. Hence wherever possible, analysis should be conducted on dry materials before mixing them into the compositions.

Moreover, the invention encompasses the addition of useful hydrotrope precursors and/or hydrotropes, such as $C_1$–$C_8$ alkylbenzenes, more typically toluenes, cumenes, xylenes, naphthalenes, or the sulfonated derivatives of any such materials, minor amounts of any other materials, such as tribranched alkylbenzene sulfonate surfactants, dialkylbenzenes and their derivatives, dialkyl tetralins, wetting agents, processing aids, and the like. It will be understood that, with the exception of hydrotropes, it will not be usual practice in the present invention to include any such materials. Likewise it will be understood that such materials, if and when they interfere with analytical methods, will not be included in samples of compositions used for analytical purposes.

A preferred modified alkylbenzene sulfonate surfactant mixture according to first embodiment of the present invention has M selected from H, Na, K and mixtures thereof, said a=1, said b=1, said q=1, and said modified alkylbenzene sulfonate surfactant mixture has a 2-methyl-2-phenyl index of less than about 0.3, preferably less than about 0.2, more preferably from 0 to about 0.1.

Such a modified alkylbenzene sulfonate surfactant mixture according can be made as the product of a process using as catalyst a zeolite selected from mordenite, offretite and H-ZSM-12 in at least partially acidic form, preferably an acidic mordenite (in general certain forms of zeolite beta can be used as an alternative but are not preferred). Embodiments described in terms of their making, as well as suitable catalysts, are all further detailed hereinafter.

Another hand dishwashing composition according to the first embodiment of the invention wherein said modified alkylbenzene sulfonate surfactant mixture consists essentially of said mixture of (a) and (b), said 2-methyl-2-phenyl index of said modified alkylbenzene sulfonate surfactant mixture is less than about 0.1, said average aliphatic carbon content is from about 11.5 to about 12.5 carbon atoms; said $R^1$ is methyl; said $R^2$ is selected from H and methyl provided that in at least about 0.7 mole fraction of said branched alkylbenzene sulfonates $R^2$ is H; and wherein said sum of carbon atoms in $R^1$, L and $R^2$ is from 10 to 14; and further wherein in said mixture of nonbranched alkylbenzene sulfonates, said Y has a sum of carbon atoms of from 10 to 14 carbon atoms, said average aliphatic carbon content of said nonbranched alkylbenzene sulfonates is from about 11.5 to about 12.5 carbon atoms, and said M is a monovalent cation or cation mixture selected from H, Na and mixtures thereof.

Definitions

Methyl termini

The terms "methyl termini" and/or "terminal methyl" mean the carbon atoms which are the terminal carbon atoms in alkyl moieties, that is L, and/or Y of formula (I) and formula (II) respectively are always bonded to three hydrogen atoms. That is, they will form a $CH_3$— group. To better explain this, the structure below shows the two terminal methyl groups in an alkylbenzene sulfonate.

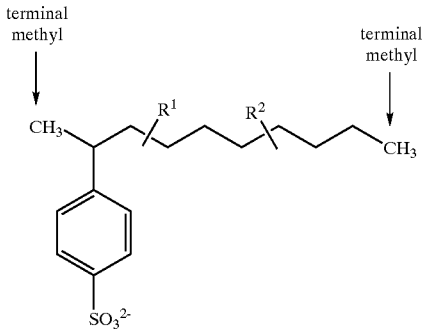

The term "AB" herein when used without further qualification is an abbreviation for "alkylbenzene" of the so-called "hard" or nonbiodegradable type which on sulfonation forms "ABS". The term "LAB" herein is an abbreviation for "linear alkylbenzene" of the current commercial, more biodegradable type, which on sulfonation forms linear alkylbenzene sulfonate, or "LAS". The term "MLAS" herein is an abbreviation for the modified alkylbenzene sulfonate mixtures of the invention.

Impurities

The surfactant mixtures herein are preferably substantially free from impurities selected from tribranched impurities, dialkyl tetralin impurities and mixtures thereof. By "substantially free" it is meant that the amounts of such impurities are insufficient to contribute positively or negatively to the cleaning effectiveness of the composition. Typically there is less than about 5%, preferably less than about 1%, more preferably about 0.1% or less of the impurity, that is typically no one of the impurities is practically detectable.

Illustrative Structures

The better to illustrate the possible complexity of modified alkylbenzene sulfonate surfactant mixtures of the invention and the resulting detergent compositions, structures (a) to (v) below are illustrative of some of the many preferred compounds of formula (I). These are only a few of hundreds of possible preferred structures that make up the bulk of the composition, and should not be taken as limiting of the invention.

(a)

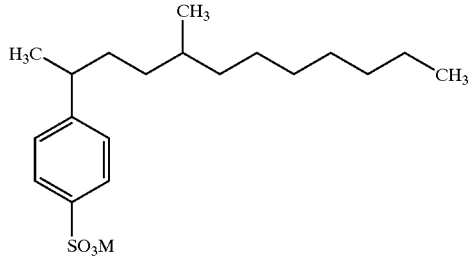

(b)

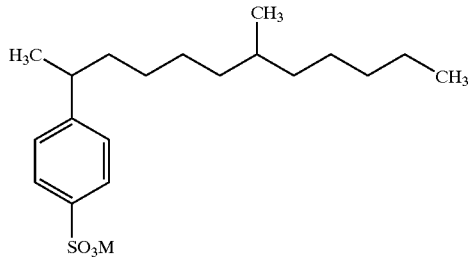

(c)

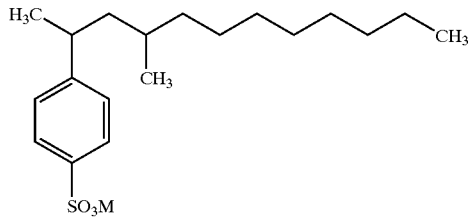

(d)

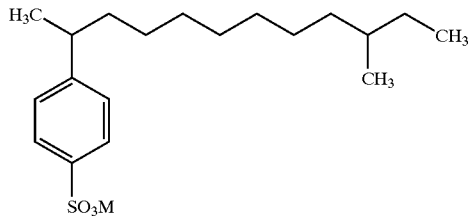

-continued
(e)
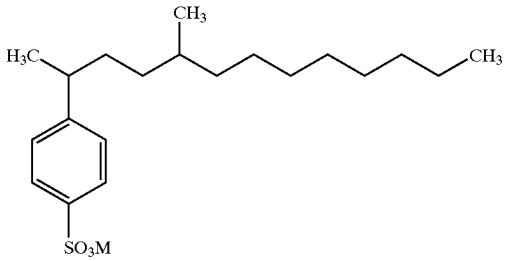
(f)
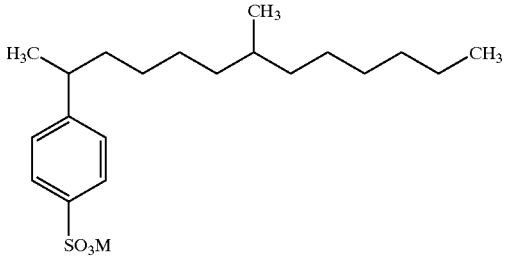
(g)
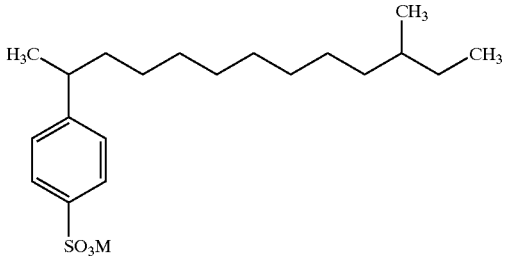
(h)
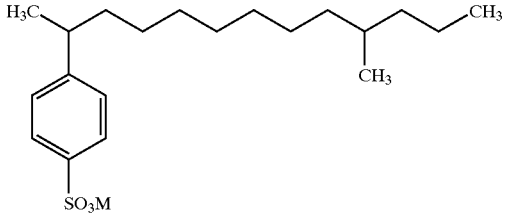
(i)
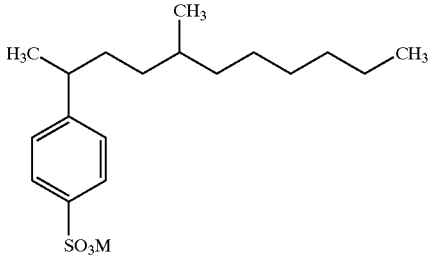
(j)
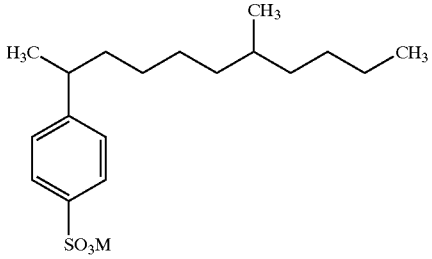
-continued
(k)
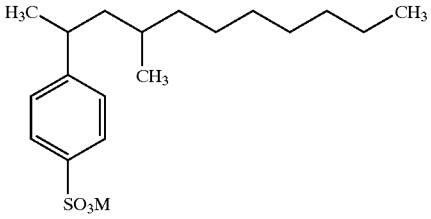
(l)
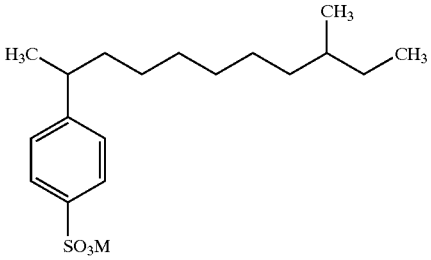
(m)
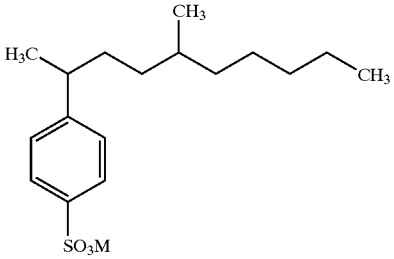
(n)
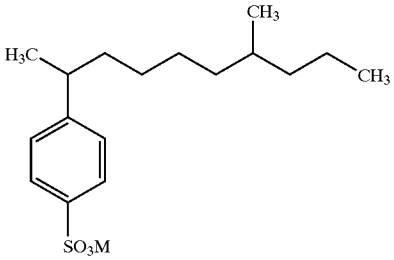
(o)
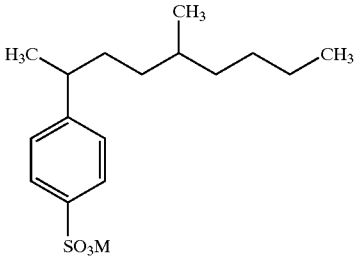
(p)
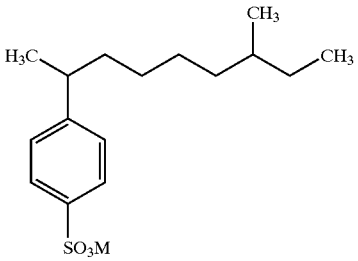

-continued (q)

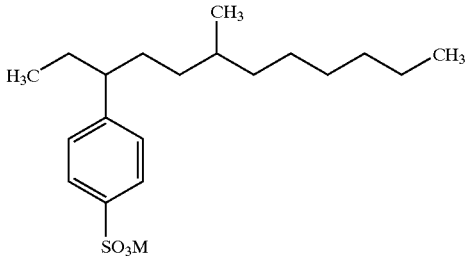

(r)

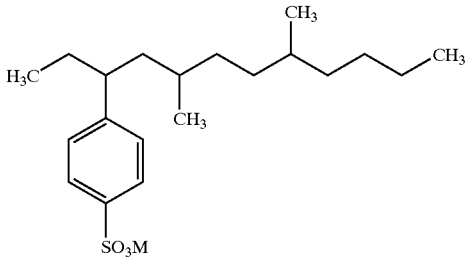

(s)

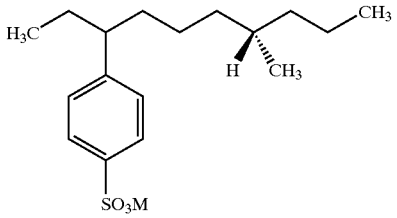

(t)

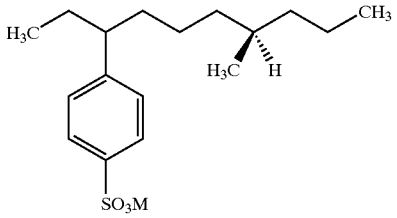

(u)

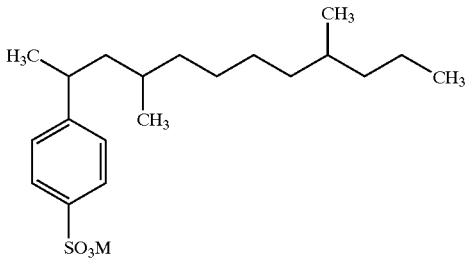

(v)

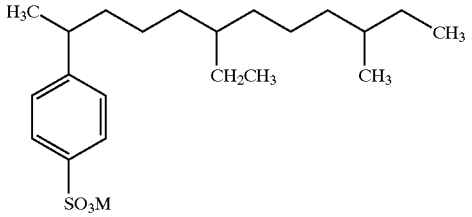

Structures (w) and (x) nonlimitingly illustrate less preferred compounds of Formula (I) which can be present, at lower levels than the above-illustrated preferred types of stuctures, in the modified alkylbenzene sulfonate surfactant mixtures of the invention and the resulting detergent compositions.

(w)

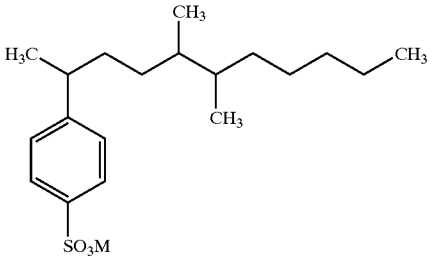

(x)

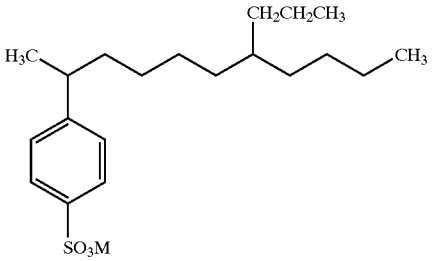

Structures (y), (z), and (aa) nonlimitingly illustrate compounds broadly within Formula (I) that are not preferred but which can be present in the modified alkylbenzene sulfonate surfactant mixtures of the invention and the resulting detergent compositions.

(y)

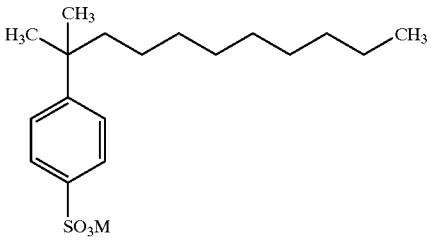

(z)

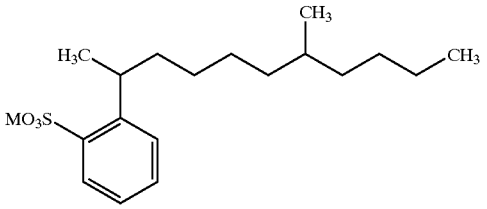

(aa)

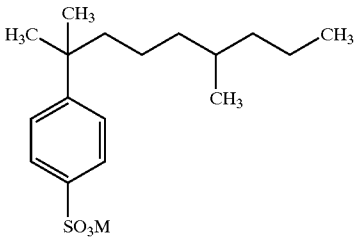

-continued (bb)

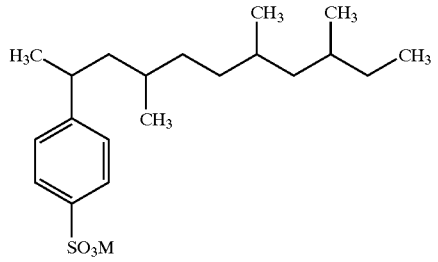

Structure (bb) is illustrative of a tri-branched structure not within Formula (I), but that can be present as an impurity.

Preferably the modified alkylbenzene sulfonate surfactant mixtures herein are the product of sulfonating a modified alkylbenzene, (other than well known tetrapropylene or AB types) wherein the modified alkylbenzene is produced by alkylating benzene with a branched olefin, other than tetrapropylene, and more particularly the lightly branched types described in more detail hereinafter, over an acidic mordenite-type catalyst or other suitable catalyst as defined elsewhere herein.

In certain cases, compositions herein can also be prepared by blending. Thus, the invention includes a hand dishwashing composition using a modified alkylbenzene sulfonate surfactant mixture according to the first embodiment wherein said modified alkylbenzene sulfonate surfactant mixture is prepared by a process comprising a step selected from: (i) blending a mixture of branched and linear alkylbenzene sulfonate surfactants having a 2/3-phenyl index of 500 to 700 with an alkylbenzene sulfonate surfactant mixture having a 2/3-phenyl index of 75 to 160 and (ii) blending a mixture of branched and linear alkylbenzenes having a 2/3-phenyl index of 500 to 700 with an alkylbenzene mixture having a 2/3-phenyl index of 75 to 160 and sulfonating said blend. However when a modified alkylbenzene sulfonate surfactant mixture is prepared in this fashion, the resulting surfactant mixture will have a 2/3-phenyl index of from about 275 to about 10,000.

In outline, modified alkylbenzene sulfonate surfactant mixtures herein can be made by the steps of:

(I) alkylating benzene with an alkylating mixture;

(II) sulfonating the product of (I); and (optionally but very preferably)

(III) neutralizing the product of (II).

Provided that suitable alkylation catalysts and process conditions as taught herein are used, the product of step (I) is a modified alkylbenzene mixture in accordance with the invention. Provided that sulfonation is conducted under conditions generally known and reapplicable from LAS manufacture, see for example the literature references cited herein, the product of step (II) is a modified alkylbenzene sulfonic acid mixture in accordance with the invention. Provided that neutralization step (III) is conducted as generally taught herein, the product of step (III) is a modified alkylbenzene sulfonate surfactant mixture in accordance with the invention. Since neutralization can be incomplete, mixtures of the acid and neutralized forms of the present modified alkylbenzene sulfonate systems in all proportions, e.g., from about 1000:1 to 1:1000 by weight, are also part of the present invention. Overall, the greatest criticalities are in step (I).

Preferred modified alkylbenzene sulfonate surfactant mixtures herein comprise the product of a process comprising the steps of: (I) alkylating benzene with an alkylating mixture; (II) sulfonating the product of (I); and (optionally but very preferably) (III) neutralizing the product of (II); wherein said alkylating mixture comprises: (a) from about 1% to about 99.9%, by weight of branched $C_9$–$C_{20}$ (preferably $C_9$–$C_{15}$, more preferably $C_{10}$–$C_{14}$) monoolefins, said branched monoolefins having structures identical with those of the branched monoolefins formed by dehydrogenating branched paraffins of formula $R^1LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of $C_9$–$C_{20}$ (preferably $C_9$–$C_{15}$, more preferably $C_{10}$–$C_{14}$) linear aliphatic olefins; wherein said alkylating mixture contains said branched $C_9$–$C_{20}$ monoolefins having at least two different carbon numbers in said $C_9$–$C_{20}$ range, and has a mean carbon content of from about 9.0 to about 15.0 carbon atoms (preferably from about 10.0 to about 14.0, more preferably from about 11.0 to about 13.0, more preferably still from about 11.5 to about 12.5); and wherein said components (a) and (b) are at a weight ratio of at least about 15:85 (preferably having branched component (a) in excess of linear component (b), for example 51% or more by weight of (a) and 49% or less of (b), more preferably 60% to 95% by weight of (a) and 5% to 40% of (b), more preferably still 65% to 90% by weight of (a) and 10% to 35% of (b), more preferably still 70% to 85% by weight of (a) and 15% to 30% of (b) wherein these percentages by weight exclude any other materials, for example diluent hydrocarbons, that may be present in the process).

Also encompassed herein are modified alkylbenzene sulfonate surfactant mixtures consisting essentially of the product of a process comprising the steps, in sequence, of: (I) alkylating benzene with an alkylating mixture; (II) sulfonating the product of (I); and (III) neutralizing the product of (I); wherein said alkylating mixture comprises: (a) from about 1% to about 99.9%, by weight of a branched alkylating agent selected from: (A) $C_9$–$C_{20}$ (preferably $C_9$–$C_{15}$, more preferably $C_{10}$–$C_{14}$) internal monoolefins $R^1LR^2$ wherein L is an acyclic olefinic moiety consisting of carbon and hydrogen and containing two terminal methyls; (B) $C_9$–$C_{20}$ (preferably $C_9$–$C_{15}$, more preferably $C_{10}$–$C_{14}$) alpha monoolefins $R^1AR^2$ wherein A is an acyclic alpha-olefinic moiety consisting of carbon and hydrogen and containing one terminal methyl and one terminal olefinic methylene; (C) $C_9$–$C_{20}$ (preferably $C_9$–$C_{15}$, more preferably $C_{10}$–$C_{14}$) vinylidene monoolefins $R^1BR2$ wherein B is an acyclic vinylidene olefin moiety consisting of carbon and hydrogen and containing two terminal methyls and one internal olefinic methylene; (D) $C_9$–$C_{20}$ (preferably $C_9$–$C_{15}$, more preferably $C_{10}$–$C_{14}$) primary alcohols $R^1QR^2$ wherein Q is an acyclic aliphatic primary terminal alcohol moiety consisting of carbon, hydrogen and oxygen and containing one terminal methyl; (E) $C_9$–$C_{20}$ (preferably $C_9$–$C_{15}$, more preferably $C_{10}$–$C_{14}$) primary alcohols $R^1ZR^2$ wherein Z is an acyclic aliphatic primary nonterminal alcohol moiety consisting of carbon, hydrogen and oxygen and containing two terminal methyls; and (F) mixtures thereof; wherein in any of (A)–(F), said $R^1$ is $C_1$ to $C_3$ alkyl and said $R^2$ is selected from H and $C_1$ to $C_3$ alkyl; and (b) from about 0.1% to about 85%, by weight of $C_9$–$C_{20}$ (preferably $C_9$–$C_{15}$, more preferably $C_{10}$–$C_{14}$) linear alkylating agent selected from $C_9$–$C_{20}$ (preferably $C_9$–$C_{15}$, more preferably $C_{10}$–$C_{14}$) linear aliphatic olefins, $C_9$–$C_{20}$ (preferably $C_9$–$C_{15}$, more preferably $C_{10}$–$C_{14}$) linear aliphatic alcohols and mixtures thereof; wherein said alkylating mixture contains said branched alkylating agents having at least two different carbon numbers in said $C_9$–$C_{20}$ (preferably $C_9$–$C_{15}$, more preferably $C_{10}$–$C_{14}$) range, and has a mean carbon content of from about 9.0 to about 15.0 carbon atoms (preferably from about 10.0 to about 14.0, more preferably from about 11.0 to about 13.0, more preferably still from about 11.5 to about 12.5); and wherein said components (a) and (b) are at a weight ratio of at least about 15:85 (preferably having branched component (a) in excess of linear component (b), for example 51% or more by weight of (a) and 49% or less of (b), more preferably 60% to 95% by weight of (a) and 5% to 40% of (b), more preferably still 65% to 90% by weight of (a) and 10% to 35% of (b), more preferably still 70% to 85% by weight of (a) and 15% to 30% of (b) wherein these percentages by weight exclude any other materials, for example diluent hydrocarbons, that may be present in the process).

In more highly preferred embodiments, the invention encompasses a modified alkylbenzene sulfonate surfactant mixture prepared in accordance with the above-outlined steps wherein said alkylating mixture consists essentially of: (a) from about 0.5% to about 47.5%, by weight of said branched alkylating agent selected from: (G) $C_9$–$C_{14}$ internal monoolefins $R^1LR^2$ wherein L is an acyclic olefinic moiety consisting of carbon and hydrogen and containing two terminal methyls; (H) $C_9$–$C_{14}$ alpha monoolefins $R^1AR^2$ wherein A is an acyclic alpha-olefinic moiety consisting of carbon and hydrogen and containing one terminal methyl and one terminal olefinic methylene; and (J) mixtures thereof; wherein in any of (G)–(H), said $R^1$ is methyl, and said $R^2$ is H or methyl provided that in at least about 0.7 mole fraction of the total of said monoolefins, $R^2$ is H; and (b) from about 0.1% to about 25%, by weight Of $C_9$–$C_{14}$ linear aliphatic olefins; and (c) from about 50% to about 98.9%, by weight of carrier materials selected from paraffins and inert nonparaffinic solvents; wherein said alkylating mixture contains said branched alkylating agents having at least two different carbon numbers in said $C_9$–$C_{14}$ range, and has a mean carbon content of from about 11.5 to about 12.5 carbon atoms; and wherein said components (a) and (b) are at a weight ratio of from about 51:49 to about 90:10.

Other modified alkylbenzene sulfonate surfactant mixtures herein are made by the above-outlined processes wherein in step (I), said alkylation is performed in the presence of an alkylation catalyst, said alkylation catalyst is an intermediate acidity solid porous alkylation catalyst, and step (II) comprises removal of components other than monoalkylbenzene prior to contacting the product of step (I) with sulfonating agent.

Also encompassed is the modified alkylbenzene sulfonate surfactant mixture according to the above-defined processes wherein said alkylation catalyst is other than a member selected from the group consisting of HF, $AlCl_3$, sulfuric acid and mixtures thereof. Such is the case when the alkylation catalyst is selected from the group consisting of non-fluoridated acidic mordenite-type catalyst, fluoridated acidic mordenite-type catalyst and mixtures thereof. Catalysts are described in more detail hereinafter.

The processes are tolerant of variation, for example conventional steps can be added before, in parallel with, or after the outlined steps (I), (II) and (III). This is especially the case for accomodating the use of hydrotropes or their precursors. Thus the invention encompasses a modified alkylbenzene sulfonate surfactant mixture according to the above-outlined processes wherein a hydrotrope, hydrotrope precursor, or mixtures thereof is added after step (I); or the hydrotrope, hydrotrope precursor or mixtures thereof is added during or after step (II) and prior to step (III); or a hydrotrope can be added during or after step (III).

Sulfonation and Workup or Neutralization (Steps II/III)

In general, sulfonation of the modified alkylbenzenes in the instant process can be accomplished using any of the well-known sulfonation systems, including those described in "Detergent Manufacture Including Zeolite Builders and other New Materials", Ed. Sittig., Noyes Data Corp., 1979, as well as in Vol. 56 in "Surfactant Science" series, Marcel Dekker, New York, 1996, including in particular Chapter 2 entitled "Alkylarylsulfonates: History, Manufacture, Analysis and Environmental Properties", pages 39–108 which includes 297 literature references. This work provides access to a great deal of literature describing various processes and process steps, not only sulfonation but also dehydrogenation, alkylation, alkylbenzene distillation and the like. Common sulfonation systems useful herein include sulfuric acid, chlorosulfonic acid, oleum, sulfur trioxide and the like. Sulfur trioxide/air is especially preferred. Details of sulfonation using a suitable air/sulfur trioxide mixture are provided in U.S. Pat. No. 3,427,342, Chemithon. Sulfonation processes are further extensively described in "Sulfonation Technology in the Detergent Industry", W. H. de Groot, Kluwer Academic Publishers, Boston, 1991.

Any convenient workup steps may be used in the present process. Common practice is to neutralize after sulfonation with any suitable alkali. Thus the neutralization step can be conducted using alkali selected from sodium, potassium, ammonium, magnesium and substituted ammonium alkalis and mixtures thereof. Potassium can assist solubility, magnesium can promote soft water performance and substituted ammonium can be helpful for formulating specialty variations of the instant surfactants. The invention encompasses any of these derivative forms of the modified alkylbenzenesulfonate surfactants as produced by the present process and their use in consumer product compositions.

Alternately the acid form of the present surfactants can be added directly to acidic cleaning products, or can be mixed with cleaning ingredients and then neutralized.

The hydrotropes or hydrotrope precursors useful herein can in general be selected from any suitable hydrotrope or hydrotrope precursor, including lower alkyl ($C_1$–$C_8$) aromatics and their sulfonic acids and sulfonate salts, but are more typically based on a sulfonic acid or sodium sulfonate salt of toluene, cumene, xylene, napthalene or mixtures thereof. The hydrotrope precursors are selected from any suitable hydrotrope precursor, typically toluene, cumene, xylene, napthalene or mixtures thereof. A hydrotrope precursor is a compound that during step (ImI), namely the sulfonation step, is converted into a hydrotrope.

In terms of process conditions for alkylation, the invention encompasses a modified alkylbenzene sulfonate surfactant mixture wherein in step (I) said alkylation is performed at a temperature of from about 125° C. to about 230° C. (preferably from about 175° C. to about 215° C.) and at a pressure of from about 50 psig to about 1000 psig (preferably from about 100 psig to about 250 psig). Preferably in step (I) said alkylation is performed at a temperature of from about 175° C. to about 215° C., at a pressure of from about 100 psig to about 250 psig. and a time of from about 0.01 hour to about 18 hours (preferably, as rapidly as possible, more typically from about 0.1 hour to about 5 hours). If desired such alkylation may be conducted in one or more stages. Different stages of the process can be conducted in different manufacturing facilities. Typically in practice, LAB manufacturers will conduct step (I), with detergent manufacturers conducting step (III). Step (II) is typically conducted by either, or can even be conducted by third party manufacturers.

In general it is found preferable in step (I) to couple together the use of relatively low temperatures (e.g., 175° C. to about 215° C.) with reaction times of medium duration (1 hour to about 8 hours) in the above-indicated ranges.

It is possible even to "target" for desirably low 2-methyl-2-phenyl index in the present inventive compositions by selecting a relatively low reaction temperature, e.g., about 190° C., and to monitor the progress of the reaction by any convenient means (e.g., sampling and NMR analysis) to assure adequate completion while minimizing 2-methyl-2-phenyl index.

Moreover, it is contemplated that the alkylation "step" (I) herein can be "staged" so that two or more reactors operating under different conditions in the defined ranges may be useful. By operating a plurality of such reactors, it is possible to allow for material with less preferred 2-methyl-2-phenyl index to be initially formed and, surprisingly, to convert such material into material with a more preferred 2-methyl-2-phenyl index.

In terms of sulfonating agent selection, the invention encompasses a modified alkylbenzene sulfonate surfactant mixture wherein step (II) is performed using a sulfonating agent selected from the group consisting of sulfur trioxide, sulfur trioxide/air mixtures, and sulfuric acid (including oleum). Chlorosulfonic acid or other known sulfonating agents, while less commercially relevant, are also useful and are included for use in the invention.

Although in general, neutralization step (III) can be carried out with any suitable alkali, the invention includes a modified alkylbenzene sulfonate surfactant mixture wherein said step (III) is performed using a basic salt, said basic salt having a cation selected from the group consisting of alkali metal, alkaline earth metal, ammonium, substituted ammonium, and mixtures thereof and an anion selected from hydroxide, oxide, carbonate, silicate, phosphate, and mixtures thereof. Preferred basic salt is selected from the group consisting of sodium hydroxide, sodium silicate, potassium hydroxide, potassium silicate, magnesium hydroxide, ammonium hydroxide, and mixtures thereof.

Alkylation Catalyst

To secure the modified alkylbenzene sulfonate surfactant mixtures of the invention, the present invention uses a particularly defined alkylation catalyst. Said alkylation catalyst is an intermediate acidity solid porous alkylation catalyst defined in detail hereinafter. Particularly preferred alkylation catalysts comprise at least partially dealuminized acidic fluoridated mordenites, at least partially dealuminized acidic nonfluoridated mordenites, and mixtures thereof.

Numerous alkylation catalysts are unsuitable for making the present modified alkylbenzene mixtures and modified alkylbenzene sulfonate surfactant mixtures. Unsuitable alkylation catalysts include any of: sulfuric acid, aluminum chloride, and HF. Also unsuitable are non-acidic calcium mordenite, and many others. Other catalysts, such as the DETAL® process catalysts of UOP are also unsuitable, at least in their current commercial executions. Indeed no alkylation catalyst currently used for alkylation in the commercial production of detergent $C_{10}$–$C_{14}$ linear alkylbenzene sulfonates for use in laundry products are suitable.

In contrast, suitable alkylation catalysts herein are selected from shape-selective moderately acidic alkylation catalysts, preferably zeolitic. The zeolite catalyst used for the alkylation step (I) is preferably selected from the group consisting of mordenite, HZSM-12, and offretite, any of these being in at least partially acidic form. Mixtures can be used and the catalysts can be combined with binders etc. as described hereinafter. More preferably, the zeolite is substantially in acid form and is contained in a catalyst pellet comprising a conventional binder and further wherein said catalyst pellet comprises at least about 1%, more preferably at least 5%, more typically from 50% to about 90%, of said zeolite.

More generally, a suitable alkylation catalyst is typically at least partially crystalline, more preferably substantially crystalline not including binders or other materials used to form catalyst pellets, aggregates or composites. Moreover the catalyst is typically at least partially acidic. Fully exchanged Ca-form mordenite, for example, is unsuitable whereas H-formn mordenite is suitable.

The pores characterizing the zeolites useful in the present alkylation process may be substantially circular, uniform pores of about 6.2 Angstrom, or preferably may be somewhat elliptical, such as in mordenite. It should be understood that, in any case, the zeolites used as catalysts in the alkylation step of the present process have a major pore dimension intermediate between that of the large pore zeolites, such as the X and Y zeolites, and the relatively small pore size zeolites ZSM-5 and ZSM-11, and preferably between about 6 Angstrom and about 7 Angstrom. Indeed ZSM-5 has been tried and found inoperable in the present invention. The pore size dimensions and crystal structures of certain zeolites are specified in ATLAS OF ZEOLITE STRUCTURE TYPES by W. M. Meier and D. H. Olson, published by the Structure Commission of the International Zeolite Association (1978 and more recent editions) and distributed by Polycrystal Book Service, Pittsburgh, Pa.

The zeolites useful in the alkylation step of the instant process generally have at least 10 percent of the cationic sites thereof occupied by ions other than alkali or alkaline-earth metals. Typical but non-limiting replacing ions include ammonium, hydrogen, rare earth, zinc, copper and aluminum. Of this group, particular preference is accorded ammonium, hydrogen, rare earth or combinations thereof. In a preferred embodiment, the zeolites are converted to the predominantly hydrogen form, generally by replacement of the alkali metal or other ion originally present with hydrogen ion precursors, e.g., ammonium ions, which upon calcination yield the hydrogen form. This exchange is conveniently carried out by contact of the zeolite with an ammonium salt solution, e.g., ammonium chloride, utilizing well known ion exchange techniques. In certain preferred embodiments, the extent of replacement is such as to produce a zeolite material in which at least 50 percent of the cationic sites are occupied by hydrogen ions.

The zeolites may be subjected to various chemical treatments, including alumina extraction (dealumination) and combination with one or more metal components, particularly the metals of Groups IIB, III, IV, VI, VII and VIII. It is also contemplated that the zeolites may, in some instances, desirably be subjected to thermal treatment, including steaming or calcination in air, hydrogen or an inert gas, e.g. nitrogen or helium.

A suitable modifying treatment entails steaming of the zeolite by contact with an atmosphere containing from about 5 to about 100% steam at a temperature of from about 250° C. to 1000° C. Steaming may last for a period of between about 0.25 and about 100 hours and may be conducted at pressures ranging from sub-atmospheric to several hundred atmospheres.

In practicing the desired alkylation step of the instant process, it may be useful to incorporate the above-described intermediate pore size crystalline zeolites in another material, e.g., a binder or matrix resistant to the temperature and other conditions employed in the process. Such matrix materials include synthetic or naturally occurring substances as well as inorganic materials such as clay, silica, and/or metal oxides. Matrix materials can be in the form of gels including mixtures of silica and metal oxides. The latter may be either naturally occurring or in the form of gels or gelatinous precipitates. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the intermediate pore size zeolites employed herein may be compounded with a porous matrix material, such as alumina, silica-alumina, silica-magnesia, silica-zirconia, silica-thoria, silica-beryllia, and silica-titania, as well as ternary combinations, such as silica-alumina-thoria, silica-alumina-zirconia, silica-alumina-magnesia and silica-magnesia-zirconia. The matrix may be in the form of a cogel. The relative proportions of finely divided zeolite and inorganic oxide gel matrix may vary widely, with the zeolite content ranging from between about 1 to about 99% by weight and more usually in the range of about 5 to about 80% by weight of the composite.

A group of zeolites which includes some useful for the alkylation step herein have a silica:alumina ratio of at least 2:1, preferably at least 10:1 more preferably at least 20:1. The silica:alumina ratios referred to in this specification are the structural or framework ratios, that is, the ratio for the $SiO_4$ to the $AlO_4$ tetrahedra. In practice, silica:alumina ratios as determined by various physical and chemical methods are acceptable for use herein. It should be understood that such methods may acceptably give some variation. For example, a gross chemical analysis may include aluminum which is present in the form of cations associated with the acidic sites on the zeolite, thereby giving a somewhat low experimentally determined silica:alumina ratio. Similarly, if the ratio is determined by thermnogravimetric analysis (TGA) of ammonia desorption, a somewhat low ammonia titration may be obtained if cationic aluminum prevents exchange of the ammonium ions onto the acidic sites. These disparities are well known in the art. They can be troublesome when certain treatments, such as the dealuminization methods described below which result in the presence of ionic aluminum free of the zeolite structure, are employed. Due care should therefore be taken to ensure that the framework silica:alumina ratio is correctly determined to the extent acceptable to a practitioner of the art.

When the zeolites have been prepared in the presence of organic cations they are typically catalytically inactive, commonly because the intracrystalline free space is occupied by organic cations from the forming solution. They may be activated by heating in an inert atmosphere at 540° C. for one hour, for example, followed by base exchange with ammonium salts followed by calcination at 540° C. in air. The presence of organic cations in the forming solution may not be absolutely essential to the formation of the zeolite; but it does appear to favor the formation of this special type of zeolite. Some natural zeolites may sometimes be converted to zeolites of the desired type by various activation procedures and other treatments such as base exchange, steaming, alumina extraction and calcination. The zeolites preferably have a crystal framework density, in the dry hydrogen form, not substantially below about 1.6 g/cm$^3$. The dry density for known structures may be calculated from the number of silicon plus aluminum atoms per 1000 cubic Angstroms, as given, e.g., on page 19 of the article on Zeolite Structure by W. M. Meier included in "Proceedings of the Conference on Molecular Sieves, London, April 1967", published by the Society of Chemical Industry, London, 1968. Reference is made to this paper for a discussion of the crystal framework density. A further discussion of crystal framework density, together with values for some typical zeolites, is given in U.S. Pat. No. 4,016,218, to which reference is made. When synthesized in the alkali metal form, the zeolite is conveniently converted to the hydrogen (acidic) form, generally via intermediate formation of the ammonium form by ammonium ion exchange and calcination of the ammonium form to yield the hydrogen form. It has been found that although the hydrogen form of the zeolite catalyzes the reaction successfully, the zeolite may also be partly in the alkali metal form and/or the form of other metal salts.

EP 466,558 describes an acidic mordenite type alkylation catalyst also of possible use herein having overall Si/Al atomic ratio of 15–85 (15–60), Na weight content is less than 1000 ppm (preferably less than 250 ppm), and there is a low or zero content of extra-network Al species; the elementary mesh volume as defined in EP 466,558 is below 2,760 nmn.

U.S. Pat. No. 5,057,472 is likewise useful for preparing alkylation catalysts herein and relates to concurrent dealumination and ion-exchange of an acid-stable Na ion-containing zeolite, preferably mordenite, effected by contact of the zeolite with a 0.5–3 (preferably 1–2.5) M $HNO_3$ solution containing sufficient $NH_4NO_3$ to fully exchange the $Na^+$ ions for $NH_4^+$ and $H^+$ ions. The resulting zeolites can have a $SiO_2$:$Al_20_3$ ratio of 15:1 to 26:1, preferably 17:1 to 23:1, and are preferably calcined to at least partially convert the $NH_4^+/H^+$ form to the $H^+$ form. Optionally, though not necessarily particularly desirable in the present invention, the catalyst can contain a Group VIII metal (and optionally also an inorganic oxide) together with the calcined zeolite of '472.

Another acidic mordenite catalyst useful for the alkylation step herein is disclosed in U.S. Pat. No. 4,861,935 which relates to a hydrogen form of mordenite incorporated with alumina, the composition having a surface area of at least 580 m$^2$/g. Other acidic mordenite catalysts useful for the alkylation step herein include those described in U.S. Pat. Nos. 5,243,116 and 5,198,595. Yet another alkylation catalyst useful herein is described in U.S. Pat. No. 5,175,135 which is an acid mordenite zeolite having a silica/alumina molar ratio of at least 50:1, a Symmetry Index of at least 1.0 as determined by X-ray diffraction analysis, and a porosity such that the total pore volume is in the range from about 0.18 cc/g to about 0.45 cc/g and the ratio of the combined meso- and macropore-volume to the total pore volume is from about 0.25 to about 0.75.

Particularly preferred alkylation catalysts herein include the acidic mordenite catalysts Zeocat™ FM-8/25H available from Zeochem; CBV 90 A available from Zeolyst International, and LZM-8 available from UOP Chemical Catalysts as well as fluoridated versions of the above commercial catalysts. Fluoridated mordenites can be prepared by a number of ways. A method of providing a particularly useful fluoridated mordenite is described in U.S. Pat. No. 5,777,187. The invention encompasses preferred embodiments in which the mordenites are fluoridated, but also has other preferred embodiments in which the mordenites are non-fluoridated.

Most generally, any alkylation catalyst may be used herein provided that the alkylation catalyst can (a) accommodate branched olefins as described elsewhere herein into the smallest pore diameter of said catalyst and (b) selectively alkylate benzene with said branched olefins and optionally mixtures thereof with nonbranched olefins. Acceptable selectivity is in accordance with a 2/3-Phenyl index of about 275 to about 10,000 as defined herein.

In other terms, the catalyst selections herein are made in part with the intention of minimizing internal alkylbenzene formation (e.g., 4-phenyl, 5-phenyl . . . ) The formulators contributing to the present invention have unexpectedly discovered that control of internal alkylbenzene sulfonate isomers in the present inventive surfactant mixtures in conjunction with introduction of limited methyl branching is very helpful for improving their perfonnance. The present invention connects this discovery to discoveries of the synthesis chemists in the present invention, who have determined how to control internal isomer content while providing limited methyl branching in the modified alkylbenzene sulfonate surfactant mixtures in accordance with the formulators' prescriptions.

The extent to which internal isomer content needs to be controlled can vary depending on the consumer product application and on whether outright best performance or a balance of performance and cost is required. In absolute terms, the amount of internal isomer such as internal alkylbenzene isomer is preferably always kept below 25% by weight, but for best results, from 0 to 10%, preferably less than about 5% by weight. "Internal alkylbenzene" isomers as defined herein include alkylbenzenes having phenyl attachment to an aliphatic chain in the 4,5,6 or 7 position.

Without intending to be limited by theory, there are two reasons for which it is believed that the prefered alkylation catalysts are the above-described shape selective zeolitic type catalysts, especially mordenites. The first reason is to provide the selectivity of formation of preferred compounds such as branched and nonbranched 2-phenyl and 3-phenylalkylbenzenes. This selectivity is measured by the 2/3-phenyl index. The second reason is to control the amount of quaternary alkylbenzenes and thus quaternary alkylbenzenesulfonates.

Results with alkylation catalysts such as HF can give quite high levels of quaternary alkylbenzenes as shown in the literature (see J. Org. Chem. Vol 37, No. 25, 1972). This contrasts with the surprising discovery as part of the present invention that one can attain low levels of quaternary alkylbenzenes in catalyzed reactions of benzene with branched olefins, as characterized by 2-methyl-2-phenyl index. Even when the olefins used are substantially dibranched, as illustrated herein, a low 2-methyl-2-phenyl index of less than 0.1 can surprisingly be obtained.

Numerous variations of the present detergent compositions are useful. Such variations include:

the detergent composition which is substantially free from alkylbenzene sulfonate surfactants other than said modified alkylbenzene sulfonate surfactant mixture;

the detergent composition which comprises, at least about 0.1%, preferably no more than about 10%, more preferably no more than about 5%, more preferably still, no more than about 1% by weight of composition, of a commercial $C_{10}$–$C_{14}$ linear alkylbenzene sulfonate surfactant;

the detergent composition which comprises, at least about 0.1%, preferably no more than about 10%, more preferably no more than about 5%, more preferably still, no more than about 1% by weight of composition, of a commercial highly branched alkylbenzene sulfonate surfactant. (e.g., TPBS or tetrapropylbenzene sulfonate);

the detergent composition which comprises, a nonionic surfactant at a level of from about 0.5% to about 25% by weight of composition, and wherein said nonionic surfactant is a polyalkoxylated alcohol in capped or non-capped form having:—a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof and—a hydrophilic group selected from 1–15 ethoxylates, 1–15 propoxylates 1–15 butoxylates and mixtures thereof, in capped or uncapped form. (when uncapped, there is also present a terminal primary —OH moiety and when capped, there is also present a terminal moiety of the form—OR wherein R is a $C_1$–$C_6$ hydrocarbyl moiety, optionally comprising a primary or, preferably when present, a secondary alcohol.);

the detergent composition which comprises, an alkyl sulfate surfactant at a level of from about 0.5% to about 25% by weight of composition, wherein said alkyl sulfate surfactant has a hydrophobic group selected from linear $C_{10}$–$C_{18}$ alkyl, mid-chain $C_1$–$C_3$ branched $C_{10}$–$C_{18}$ alkyl, guerbet branched $C_{10}$–$C_{18}$ alkyl, and mixtures thereof and a cation selected from Na, K and mixtures thereof;

the detergent composition which comprises, an alkyl (polyalkoxy)sulfate surfactant at a level of from about 0.5% to about 25% by weight composition, wherein said alkyl(polyalkoxy)sulfate surfactant has—a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof and—a (polyalkoxy)sulfate hydrophilic group selected from 1–15 polyethoxysulfate, 1–15 polypropoxysulfate, 1–15 polybutoxysulfate, 1–15 mixed poly (ethoxylpropoxy/butoxy)sulfates, and mixtures thereof, in capped or uncapped form; and—a cation selected from Na, K and mixtures thereof;

Further the present invention includes a detergent composition comprising (preferably consisting essentially of): (i) from about 0.01% to about 95%, by weight of composition, (preferably from about 0.5% to about 50%, more preferably from about 1%, preferably at least 2%, more preferably at least 4%, more preferably at least 6%, more preferably still at least 8% to about 35%) of modified alkylbenzene sulfonate surfactant mixture according to the invention; (ii) from about 0.00001% to about 99.9% by weight of composition (preferably from about 5% to about 98%, more preferably from about 50% to about 95%) of a conventional hand dishwasing adjunct; and (iii) from about 0.00001% to about 99.9% by weight of composition (preferably from about 0.1% to about 50%, more preferably from about 0.2% to about 40%, even more preferably form abour 0.5% to about 30%), of a surfactant selected from the group consisting of anionic surfactants other than said modified alkylbenzene sulfonate surfactant mixture, nonionic, cationic, amphoteric, zwitterionic and mixtures thereof; provided that when said detergent composition comprises any other alkylbenzene sulfonate than the alkylbenzene sulfonate of said modified alkylbenzene sulfonate surfactant mixture, said modified alkylbenzene sulfonate surfactant mixture and said other alkylbenzene sulfonate, as a mixture, have an overall 2/3-phenyl index of from about 275 to about 10,000 (preferably from about 350 to about 1200, more preferably from about 500 to about 700).

More generally, the hand dishwashing compositions can include the modified alkylbenzene sulfonate surfactant mixtures together with any conventional cleaning adjunct such as those wherein the adjunct is selected from the group consisting of builders, detersive enzymes, at least partially water-soluble or water dispersible polymers, abrasives, bactericides, tarnish inhibitors, dyes, solvents, hydrotropes, perfumes, thickeners, antioxidants, processing aids, suds boosters, suds suppressors, buffers, anti-fungal agents, mildew control agents, insect repellents, anti-corrosive aids, chelants and mixtures thereof.

Also more generally, the inventive detergent compositions can take the form of a liquid, powder, agglomerate, paste, tablet, bar, gel, liqui-gel, microemulsion, liquid crystal, or granule.

Related to the detergent composition embodiments are methods of their use, such as a method contacting soiled tableware in need of cleaning with either a neat or an aqueous solution of the composition of the invention. Such methods may optionally include the step of diluting the composition with water. Furthermore, the composition may be applied, either neat or as an aqueous solution directly to the tableware or surface to be cleaned or directly to a cleaning implement, such as a spounge or a wash cloth. Such methods are part of the present invention.

The present invention also encompasses hand dishwashing compositions comprising modified alkylbenzene sulfonate surfactant mixtures which are more particularly termed "2/3-phenyl surfactant mixtures". Such mixtures are not the most preferred offered by the invention, but can be very economical.

Thus the invention includes a 2/3-phenyl surfactant mixture consisting essentially of: from 1% (preferably at least about 5%, more preferably at least about 10%) to about 60% (in one mode preferably less than about 50%, more preferably less than about 40%), by weight of surfactant system of a first alkylbenzene sulfonate surfactant, wherein said first alkylbenzene sulfonate surfactant is a modified alkylbenzene sulfonate surfactant mixture according to the first embodiment; and from 40% (in one mode preferably at least about 50%, more preferably at least about 60%) to about 99% (preferably less than about 95%, more preferably less than about 90%), by weight of surfactant system of a second alkylbenzene sulfonate surfactant, wherein said second alkylbenzene sulfonate surfactant is an alkylbenzene sulfonate surfactant mixture other than said modified alkylbenzene sulfonate surfactant mixture according to the first embodiment, and wherein said second alkylbenzene sulfonate surfactant has a 2/3-phenyl index of from about 75 to about 160 (typically said second alkylbenzene sulfonate surfactant is a commercial $C_{10}$–$C_{14}$ linear alkylbenzene sulfonate surfactant, e.g., DETAL® process LAS or HF process LAS though in general any commercial linear (LAS) or branched (ABS, TPBS) type can be used); provided that said medium 2/3-phenyl surfactant mixture has a 2/3-phenyl index of from about 160 to about 275 (preferably from about 170 to about 265, more preferably from about 180 to about 255). (of course it is equally possible within the spirit and scope of the invention to prepare any blend of the modified alkylbenzene sulfonate surfactant mixture of the invention with any known commercial linear or branched alkylbenzene sulfonate surfactant.

Processes for preparing a medium 2/3-phenyl surfactant mixture include those comprising a step selected from: (i) blending said first alkylbenzene sulfonate surfactant and said second alkylbenzene sulfonate surfactant; and (ii) blending the nonsulfonated precursor of said first alkylbenzene sulfonate surfactant and the nonsulfonated precursor of said second alkylbenzene sulfonate surfactant and sulfonating said blend.

Preparative Examples

EXAMPLE 1

Mixture of 4-methyl-4-nonanol, 5-methyl-5-decanol, 6-methyl-6-undecanol and 6-methyl-6-dodecanol

A starting-material for Branched Olefins

A mixture of 4.65 g of 2-pentanone, 20.7 g of 2-hexanone, 51.0 g of 2-heptanone, 36.7 g of 2-octanone and 72.6 g of diethyl ether is added to an addition funnel. The ketone mixture is then added dropwise over a period of 2.25 hours to a nitrogen blanketed stirred three neck 2 L round bottom flask, fitted with a reflux condenser and containing 600 mL of 2.0 M n-pentylmagnesium bromide in diethyl ether and an additional 400 mnL of diethyl ether. After the addition is complete the reaction mixture is stirred an additional 2.5 hours at 20° C. The reaction mixture is then added to 1 kg of cracked ice with stirring. To this mixture is added 393.3 g of 30% sulphuric acid solution. The aqueous acid layer is drained and the remaining ether layer is washed twice with 750 mL of water. The ether layer is then evaporated under vacuum to yield 176.1 g of a mixture of 4-methyl-4-nonanol, 5-methyl-5-decanol, 6-methyl-6-undecanol and 6-methyl-6-dodecanol.

EXAMPLE 2

Substantially Mono Methyl Branched Olefin Mixture with Randomized Branching

A branched Olefin Mixture which is an Alkylating Agent for Preparing Modified Alkylbenzenes in Accordance with the Invention a) A 174.9 g sample of the mono methyl branched alcohol mixture of Example 1 is added to a nitrogen blanketed stirred three neck round bottom 500 mL flask, fitted with a Dean Stark trap and a reflux condenser along with 35.8 g of a shape selective zeolite catalyst (acidic mordenite catalyst Zeocat™ FM-8/25H). With mixing, the mixture is then heated to about 110–155° C. and water and some olefin is collected over a period of 4–5 hours in the Dean Stark trap. The conversion of the alcohol mixture of example 1 to a substantially non-randomized methyl branched olefin mixture is now complete. The substantially non-randomized methyl branched olefin mixture remaining in the flask along with the substantially non-randomized methyl branched olefin mixture collected in the dean stark trap is recombined and filtered to remove catalyst. The solid filter cake is washed twice with 100 mL portions of hexane. The hexane filtrate is evaporated under vacuum and the resulting product is combined with the first filtrate to give 148.2 g of a substantially non-randomized methyl branched olefin mixture.

b) The olefin mixture of Example 2a is combined with 36 g of a shape selective zeolite catalyst (acidic mordenite catalyst Zeocat™ FM-8/25H) and reacted according to example 2a with the following changes. The reaction temperature is raised to 190–200° C. for a period of about 1–2 hours to randomize the specific branch positions in the olefin mixture. The substantially mono methyl branched olefin mixture with randomized branching remaining in the flask along with the substantially mono methyl branched olefin mixture with randomized branching collected in the dean stark trap are recombined and filtered to remove catalyst. The solid filter cake is washed twice with 100 mL portions of hexane. The hexane filtrate is evaporated under vacuum and the resulting product is combined with the first filtrate to give 147.5 g of a substantially mono methyl branched olefin mixture with randomized branching.

EXAMPLE 3

Substantially Mono Methyl Branched Alkylbenzene Mixture with a 2/3-Phenyl Index of About 550 and a 2-Methyl-2-Phenyl Index of About 0.02

A Modified Alkylbenzene Mixture in Accordance with the Invention 147 g of the substantially mono methyl branched olefin mixture of example 2 and 36 g of a shape selective zeolite catalyst (acidic mordenite catalyst Zeocat™ FM-8/25H) are added to a 2 gallon stainless steel, stirred autoclave. Residual olefin and catalyst in the container are washed into the autoclave with 300 mL of n-hexane and the autoclave is sealed. From outside the autoclave cell, 2000 g of benzene (contained in a isolated vessel and added by way of an isolated pumping system inside the isolated autoclave cell) is added to the autoclave. The autoclave is purged twice with 250 psig $N_2$, and then charged to 60 psig $N_2$. The mixture is stirred and heated to about 200° C. for about 4–5 hours. The autoclave is cooled to about 20° C. overnight. The valve is opened leading from the autoclave to the benzene condenser and collection tank. The autoclave is heated to about 120° C. with continuous collection of benzene. No more benzene is collected by the time the reactor reaches 120° C. The reactor is then cooled to 40° C. and 750 g of n-hexane is pumped into the autoclave with mixing. The autoclave is then drained to remove the reaction mixture. The reaction mixture is filtered to remove catalyst and the n-hexane is removed under vacuum. The product is distilled under vacuwn (1–5 mm of Hg). The substantially mono methyl branched alkylbenzene mixture with a 2/3-Phenyl index of about 550 and a 2-methyl-2-phenyl index of about 0.02 is collected from 76° C.–130° C. (167 g).

EXAMPLE 4

Substantially Mono Methyl Branched Alkylbenzenesulfonic Acid Mixture with a 2/3-Phenyl Index of About 550 and a 2-Methyl-2-Phenyl Index of About 0.02

A Modified Alkylbenzene Sulfonic Acid Mixture in Accordance with the Invention

The product of example 3 is sulfonated with a molar equivalent of chlorosulfonic acid using methylene chloride as solvent. The methylene chloride is removed to give 210 g of a substantially mono methyl branched alkylbenzenesulfonic acid mixture with a 2/3-Phenyl index of about 550 and a 2-methyl-2-phenyl index of about 0.02

EXAMPLE 5

Substantially Mono Methyl Branched Alkylbenzene Sulfonate, Sodium Salt Mixture with a 2/3-Phenyl Index of About 550

A modified Alkylbenzene Sulfonate Surfactant Mixture in Accordance with the Invention The product of example 4 is neutralized with a molar equivalent of sodium methoxide in methanol and the methanol is evaporated to give 225 g of a substantially mono methyl branched alkylbenzene sulfonate, sodium salt mixture with a 2/3-Phenyl index of about 550 and a 2-methyl-2-phenyl index of about 0.02.

EXAMPLE 6

Substantially Linear Alkylbenzene Mixture with a 2/3-Phenyl Index of About 550 and a 2-Methyl-2-Phenyl Index of About 0.02

An Alkylbenzene Mixture to be Used as a Component of Modified Alkylbenzenes

A mixture of chain lengths of substantially linear alkylbenzenes with a 2/3-Phenyl index of about 550 and a 2-methyl-2-phenyl index of about 0.02 is prepared using a shape zeolite catalyst (acidic mordenite catalyst Zeocat™ FM-8/25H). A mixture of 15.1 g of Neodene (R)10, 136.6 g of Neodene(R)1112, 89.5 g of Neodene(R)12 and 109.1 g of 1-tridecene is added to a 2 gallon stainless steel, stirred autoclave along with 70 g of a shape selective catalyst (acidic mordenite catalyst Zeocat™ FM-8/25H). Neodene is a trade name for olefins from Shell Chemical Company. Residual olefin and catalyst in the container are washed into the autoclave with 200 mL of n-hexane and the autoclave is sealed. From outside the autoclave cell, 2500 benzene (contained in a isolated vessel and added by way of an isolated pumping system inside the isolated autoclave cell) is added to the autoclave. The autoclave is purged twice with 250 psig $N_2$, and then charged to 60 psig $N_2$. The mixture is stirred and heated to about 200–205° C. for about 4–5 hours then cooled to 70–80° C. The valve is opened leading from the autoclave to the benzene condenser and collection tank. The autoclave is heated to about 120° C. with continuous collection of benzene in collection tank. No more benzene is collected by the time the reactor reaches 120° C. The reactor is then cooled to 40° C. and 1 kg of n-hexane is pumped into the autoclave with mixing. The autoclave is then drained to remove the reaction mixture. The reaction mixture is filtered to remove catalyst and the n-hexane is evaporated under low vacuum. The product is then distilled under high vacuum (1–5 mm of Hg). The substantially linear alkylbenzene mixture with a 2/3-Phenyl index of about 550 and a 2-methyl-2-phenyl index of about 0.02 is collected from 85° C.–150° C. (426.2 g).

EXAMPLE 7

Substantially Linear Alkylbenzenesulfonic Acid Mixture with a 2/3-Phenyl Index of About 550 and a 2-Methyl-2-Phenyl Index of About 0.02

An Alkylbenzene Sulfonic Acid Mixture to be Used as a Component of Modified Alkylbenzene Sulfonic Acid Mixtures in Accordance with the Invention 422.45 g of the product of example 6 is sulfonated with a molar equivalent of chlorosulfonic acid using methylene chloride as solvent. The methylene chloride is removed to give 574 g of a substantially linear alkylbenzenesulfonic acid mixture with a 2/3-Phenyl index of about 550 and a 2-methyl-2-phenyl index of about 0.02.

EXAMPLE 8

Substantially Linear Alkylbenzene Sulfonate, Sodium Salt Mixture with a 2/3-Phenyl Index of About 550 and a 2-Methyl-2-Phenyl Index of About 0.02

An Alkylbenzene Sulfonate Surfactant Mixture to be Used as a Component of Modified Alkylbenzene Sulfonate Surfactant Mixtures in Accordance with the Invention The substantially linear alkylbenzenesulfonic acid mixture of example 7 is neutralized with a molar equivalent of sodium methoxide in methanol and the methanol is evaporated to give 613 g of the substantially linear alkylbenzene sulfonate, sodium salt mixture with a 2/3-Phenyl index of about 550 and a 2-methyl-2-phenyl index of about 0.02.

EXAMPLE 9

6,10-Dimethyl-2-undecanol

A Starting-material for Branched Olefins

To a glass autoclave liner is added 299 g of geranylacetone, 3.8 g of 5% rutheniumon carbon and 150 ml of methanol. The glass liner is sealed inside a 3 L, stainless steel, rocking autoclave and the autoclave purged once with 250 psig $N_2$, once with 250 psig $H_2$ and then charged with 1000 psig $H_2$. With mixing, the reaction mixture is heated. At about 75° C., the reaction initiates and begins consuming $H_2$ and exotherms to 170–180° C. In 10–15 minutes, the temperature has dropped to 100–110° C. and the pressure dropped to 500 psig. The autoclave is boosted to 1000 psig with $H_2$ and mixed at 100–110° C. for an additional 1 hour and 40 minutes with the reaction consuming an additional 160 psig $H_2$ but at which time no more $H_2$ consumption is observed. Upon cooling the autoclave to 40° C., the reaction mixture removed, filtered to remove catalyst and concentrated by evaporation of methanol under vacuum to yield 297.75 g of 6,10-dimethyl-2-undecanol.

EXAMPLE 10

5,7-Dimethyl-2-decanol

A starting-material for Branched Olefins

To a glass autoclave liner is added 249 g of 5,7-dimethyl-3,5,9-decatrien-2-one, 2.2 g of 5% rutheniumon carbon and 200 ml of methanol. The glass liner is sealed inside a 3 L, stainless steel, rocking autoclave and the autoclave purged once with 250 psig $N_2$, once with 250 psig $H_2$ and then charged with 500 psig $H_2$. With mixing, the reaction mixture is heated. At about 75° C., the reaction initiates and begins consuming $H_2$ and exotherms to 170° C. In 10 minutes, the temperature has dropped to 115–120° C. and the pressure dropped to 270 psig. The autoclave is boosted to 1000 psig with $H_2$, mixed at 110–115° C. for an additional 7 hours and 15 minutes then cooled to 30° C. The reaction mixture is removed from autoclave, filtered to remove catalyst and concentrated by evaporation of methanol under vacuum to yield 225.8 g of 5,7-dimethyl-2-decanol.

EXAMPLE 11

4,8-Dimethyl-2-nonanol

A starting-material for Branched Olefins

A mixture of 671.2 g of citral and 185.6 g of diethyl ether is added to an addition funnel. The citral mixture is then added dropwise over a five hour period to a nitrogen blanketed, stirred, 5 L, 3-neck, round bottom flask equipped with a reflux condenser containing 1.6 L of 3.0 M methylmagnesium bromide solution and an additional 740 ml of diethyl ether. The reaction flask is situated in an ice water bath to control exotherm and subsequent ether reflux. After addition is complete, the ice water bath is removed and the reaction allowed to mix for an additional 2 hours at 20–25° C. at which point the reaction mixture is added to 3.5 Kg of cracked ice with good mixing. To this mixture is added 1570 g of 30% sulfuric acid solution. The aqueous acid layer is drained and the remaining ether layer washed twice with 2 L of water. The ether layer is concentrated by evaporation of the ether under vacuum to yield 720.6 g of 4,8-dimethyl-3,7-nonadien-2-ol. To a glass autoclave liner is added 249.8 g of the 4,8-dimethyl-3,7-nonadien-2-ol, 5.8 g of 5% palladium on activated carbon and 200 ml of n-hexane. The glass liner is sealed inside a 3 L, stainless steel, rocking autoclave and the autoclave purged twice with 250 psig $N_2$, once with 250 psig $H_2$ and then charged with 100 psig $H_2$. Upon mixing, the reaction initiates and begins consuming $H_2$ and exotherms to 75° C. The autoclave is heated to 80° C., boosted to 500 psig with $H_2$, mixed for 3 hours and then cooled to 30° C. The reaction mixture is removed from autoclave, filtered to remove catalyst and concentrated by evaporation of n-hexane under vacuum to yield 242 g of 4,8-dimethyl-2-nonanol.

EXAMPLE 12

Substantially Dimethyl Branched Olefin Mixture with Randomized Branching

A Branched Olefin Mixture which is an Alkylating Agent for Preparing Modified Alkylbenzenes in Accordance with the Invention To a nitrogen blanketed, 2 L, 3-neck round bottom flask equipped with thermometer, mechanical stirrer and a Dean-Stark trap with reflux condenser is added 225 g of 4,8-dimethyl-2-nonanol (example 11), 450 g of 5,7-dimethyl-2-decanol (example 10), 225 g of 6,10-dimethyl-2-undecanol (example 9) and 180 g of a shape selective zeolite catalyst (acidic mordenite catalyst Zeocat™ FM-8/25H). With mixing, the mixture is heated (135–160° C.) to the point water and some olefin is driven off and collected in Dean-Stark trap at a moderate rate. After a few hours, the rate of water collection slows and the temperature rises to 180–195° C. where the reaction is allowed to mix for an additional 2–4 hours.

The dimethyl branched olefin mixture remaining in the flask along with the dimethyl branched olefin mixture that distilled over are recombined and filtered to remove the catalyst. The catalyst filter cake is slurried with 500 ml of hexane and vacuum filtered. The catalyst filter cake is washed twice with 100 ml of hexane and the filtrate concentrated by evaporation of the hexane under vacuum. The resulting product is combined with the first filtrate to give 820 g of dimethyl branched olefin mixture with randomized branching.

EXAMPLE 13

Substantially Dimethyl Branched Alkylbenzene Mixture with Randomized Branching and 2/3-Phenyl Index of About 600 and 2-Methyl-2-Phenyl Index of About 0.04

A Modified Alkylbenzene Mixture in Accordance with the Invention 820 g of the dimethyl branched olefm mixture of example 12 and 160 g of a shape selective zeolite catalyst (acidic mordenite catalyst Zeocat™ FM-8/25H) is added to a 2 gallon stainless steel, stirred autoclave and the autoclave is sealed. The autoclave is purged twice with 80 psig $N_2$ and then charged to 60 psig $N_2$. From outside the autoclave cell, 3000 g of benzene (contained in a isolated vessel and added by way of an isolated pumping system inside the isolated autoclave cell) is added to the autoclave. The mixture is stirred and heated to 205° C. to about 210° C. The reaction is continued for about 10 minutes at which time the product mixture is sampled. The 10 minute sample is filtered to remove catalyst and vacuum pulled on the mixture to remove any residual traces of benzene. The sample is distilled under vacuum (1–5 mm of Hg). The dimethyl branched alkylbenzene mixture with randomized branching and 2/3-Phenyl index of about 600 and a 2-methyl-2-phenyl index of about 0.26 is collected from 90° C.–140° C. The reaction is continued at 205° C. to about 210° C. for about 8 hours. The autoclave is cooled to about 30° C. overnight. The valve is opened leading from the autoclave to the benzene condenser and collection tank. The autoclave is heated to about 120° C. with continuous collection of benzene. No more benzene is collected by the time the reactor reaches 120° C. and the reactor is then cooled to 40° C. The autoclave is then drained to remove the reaction mixture. The reaction mixture is filtered to remove catalyst and vacuum pulled on the mixture to remove any residual traces of benzene. The product is distilled under vacuum (1–5 mm of Hg). The dimethyl branched alkylbenzene mixture with randomized branching and 2/3-Phenyl index of about 600 and a 2-methyl-2-phenyl index of about 0.04 is collected from 90° C.–140° C.

EXAMPLE 14

Substantially Dimethyl Branched Alkylbenzenesulfonic Acid Mixture with Randomized Branching and a 2/3-Phenyl Index of About 600 and a 2-Methyl-2-Phenyl Index of About 0.04

A Modified Alkylbenzene Sulfonic Acid Mixture in Accordance with the Invention The dimethyl branched alkylbenzene product of example 13 is sulfonated with a molar equivalent of chlorosulfonic acid using methylene chloride as solvent with HCl evolved as a side product. The resulting sulfonic acid product is concentrated by evaporation of methylene chloride under vacuum. The substantially dimethyl branched alkylbenzenesulfonic acid mixture has a 2/3 Phenyl Index of about 2/3-Phenyl index of about 600 and a 2-methyl-2-phenyl index of about 0.04.

EXAMPLE 15

Substantially Dimethyl Branched Alkylbenzenesulfonic Acid, Sodium Salt Mixture with Randomized Branching and 2/3-Phenyl Index of About 600 and a 2-Methyl-2-Phenyl Index of About 0.04

A Modified Alkylbenzene Sulfonate Surfactant Mixture in Accordance with the Invention The dimethyl branched alkylbenzenesulfonic acid mixture of example 14 is neutralized with a molar equivalent of sodium methoxide in methanol and the methanol is evaporated to give solid dimethyl branched alkylbenzene sulfonate, sodium salt mixture with randomized branching and a 2/3-Phenyl index of about 600 and a 2-methyl-2-phenyl index of about 0.04.

EXAMPLE 16

Modified Alkylbenzene Sulfonate Surfactant Mixtures According to the Invention

Medium 2/3-phenyl Type

Blends are prepared of:

I) Modified alkylbenzene sulfonate surfactant mixture in accordance with the invention having a 2/3-Phenyl index of about 550 (according to Example 5)

II) Commercial $C_{11.7}$ (average) linear alkylbenzene sulfonate surfactant (HF type) sodium salt having a 2/3-Phenyl index of about 100

In the table below, percentages are by weight:

| | A | B | C |
|---|---|---|---|
| I | 25% | 15% | 38% |
| II | 75% | 85% | 62% |

Each of the above blends has a 2/3-phenyl index in the range from about 160 to about 275.

EXAMPLE 17

Modified Alkylbenzene Sulfonate Surfactant Mixtures According to the Invention

Medium 2/3-phenyl Type

Blends are prepared of:

I) Modified alkylbenzene sulfonate surfactant mixture in accordance with the invention having a 2/3-Phenyl index of about 550 (according to Example 5)

II) Commercial $C_{11.7}$ (average) linear alkylbenzene sulfonate surfactant (DETAL® type) sodium salt having a 2/3-Phenyl index of about 150

In the table below, percentages are by weight:

| | A | B | C |
|---|---|---|---|
| I | 25% | 15% | 10% |
| II | 75% | 85% | 90% |

Each of the above blends has a 2/3-phenyl index in the range from about 160 to about 275.

EXAMPLE 18

Modified Alkylbenzene Sulfonic Acid Mixtures According to the Invention

Medium 2/3-phenyl Type

Blends are prepared of:

I) Modified alkylbenzene sulfonic acid surfactant mixture in accordance with the invention having a 2/3-Phenyl index of about 550 (according to Example 4)

II) Commercial $C_{11.7}$ (average) linear alkylbenzene sulfonic acid (HF type) having a 2/3-Phenyl index of about 100.

In the table below, percentages are by weight:

| | A | B | C |
|---|---|---|---|
| I | 25% | 15% | 38% |
| II | 75% | 85% | 62% |

Each of the above blends has a 2/3-phenyl index in the range from. about 160 to about 275.

EXAMPLE 19

Modified Alkylbenzene Sulfonic Acid Mixtures According to the Invention

Medium 2/3-phenyl Type

Blends are prepared of:

I) Modified alkylbenzene sulfonic acid mixture in accordance with the invention having a 2/3-Phenyl index of about 550 (according to Example 4)

II) Commercial $C_{11.7}$ (average) linear alkylbenzene sulfonic acid (DETAL® type) having a 2/3-Phenyl index of about 150.

In the table below, percentages are by weight:

| | A | B | C |
|---|---|---|---|
| I | 25% | 15% | 10% |
| II | 75% | 85% | 90% |

Each of the above blends has a 2/3-phenyl index in the range from about 160 to about 275.

EXAMPLE 20

Modified Alkylbenzene Mixtures According to the Invention

Medium 2/3-phenyl Type

Blends are prepared of:

I) Modified alkylbenzene mixture in accordance with the invention having a 2/3-Phenyl index of about 550 (according to Example 3)

II) Commercial $C_{11.7}$ (average) linear alkylbenzene (HF type) having a 2/3-Phenyl index of about 100.

In the table below, percentages are by weight:

| | A | B | C |
|---|---|---|---|
| I | 25% | 15% | 38% |
| II | 75% | 85% | 62% |

Each of the above blends has a 2/3-phenyl index in the range from about 160 to about 275.

EXAMPLE 21

Modified Alkylbenzene Mixtures According to the Invention

Medium 2/3-phenyl Type

Blends are prepared of:

I) Modified alkylbenzene mixture in accordance with the invention having a 2/3-Phenyl index of about 550 (according to Example 3)

II) Commercial $C_{11.7}$ (average) linear alkylbenzene (DETAL® type) having a 2/3-Phenyl index of about 150.

In the table below, percentages are by weight:

| | A | B | C |
|---|---|---|---|
| I | 25% | 15% | 10% |
| II | 75% | 85% | 90% |

Each of the above blends has a 2/3-phenyl index in the range from about 160 to about 275.

EXAMPLE 22

Modified Alkylbenzene Mixture According to the Invention

With a 2/3-Phenyl Index of about 550 and a 2-Methyl-2-Phenyl Index of about 0.02 110.25 g of the substantially mono methyl branched olefin mixture of example 2, 36.75 g a nonbranched olefin mixture (decene:undecene:dodecene:tridecene ratio of 2:9:20:18) and 36 g of a shape selective zeolite catalyst (acidic mordenite catalyst Zeocat™ FM-8/25H) are added to a 2 gallon stainless steel, stirred autoclave. Residual olefin and catalyst in the container are washed into the autoclave with 300 mL of n-hexane and the autoclave is sealed. From outside the autoclave cell, 2000 g of benzene (contained in a isolated vessel and added by way of an isolated pumping system inside the isolated autoclave cell) is added to the autoclave. The autoclave is purged twice with 250 psig $N_2$, and then charged to 60 psig $N_2$. The mixture is stirred and heated to about 200° C. for about 4–5 hours. The autoclave is cooled to about 20° C. overnight. The valve is opened leading from the autoclave to the benzene condenser and collection tank. The autoclave is heated to about 120° C. with continuous collection of benzene. No more benzene is collected by the time the reactor reaches 120° C. The reactor is then cooled to 40° C. and 750 g of n-hexane is pumped into the autoclave with mixing. The autoclave is then drained to remove the reaction mixture. The reaction mixture is filtered to remove catalyst and the n-hexane is removed under vacuum. The product is distilled under vacuum (1–5 mm of Hg). A modified alkylbenzene mixture with a 2/3-Phenyl index of about 550 and a 2-methyl-2-phenyl index of about 0.02 is collected from 76° C.–130° C. (167 g).

EXAMPLE 23

Modified Alkylbenzenesulfonic Acid Mixture According to the Invention (Branched and Nonbranched Alkylbenzenesulfonic Acid Mixture) with a 2/3-Phenyl Index of About 550 and a 2-Methyl-2-Phenyl Index of About 0.02

The modified alkylbenzene mixture of example 22 is sulfonated with a molar equivalent of chlorosulfonic acid using methylene chloride as solvent. The methylene chloride is removed to give 210 g of a modified alkylbenzenesulfonic acid mixture with a 2/3-Phenyl index of about 550 and a 2-methyl-2-phenyl index of about 0.02.

EXAMPLE 24

Modified Alkylbenzenesulfonate, Sodium Salt Mixture According to the Invention (Branched and Nonbranched Alkylbenzenesulfonate, Sodium Salt Mixture) with a 2/3-Phenyl Index of About 550 and a 2-Methyl-2-Phenyl Index of About 0.02

The modified alkylbenzenesulfonic acid of example 23 is neutralized with a molar equivalent of sodium methoxide in methanol and the methanol is evaporated to give 225 g of a modified alkylbenzenesulfonate, sodium salt mixture with a 2/3-Phenyl index of about 550 and a 2-methyl-2-phenyl index of about 0.02.

Methods for Determining Compositional Parameters (2/3-phenyl Index, 2-methyl-2-phenyl Index) of Mixed Alkylbenzene/Alkylbenzenesulfonate/Alkylbenzenesulfonic Acid Systems It is well known in the art to determine compositional parameters of conventional linear alkylbenzenes and/or highly branched alkylbenzenesulfonates (TPBS, ABS). See, for example Surfactant Science Series, Volume 40, Chapter 7 and Surfactant Science Series, Volume 73, Chapter 7. Typically this is done by GC and/or GC-mass spectroscopy for the alkylbenzenes and HPLC for the alkylbenzenesulfonates or sulfonic acids; $^{13}C$ nmr is also commonly used. Another common practice is desulfonation. This permits GC and/or GC-mass spectroscopy to be used, since desulfonation converts the sulfonates or sulfonic acids to the alkylbenzenes which are tractable by such methods.

In general, the present invention provides unique and relatively complex mixtures of alkylbenzenes, and similarly complex surfactant mixtures of alkylbenzenesulfonates and/or alkylbenzenesulfonic acids. Compositional parameters of such compositions can be determined using variations and combinations of the art-known methods.

The sequence of methods to be used depends on the composition to be characterized as follows:

| Composition to be characterized | Sequence of Methods (Methods separated by commas are run in sequence, others can be run in parallel) |
|---|---|
| Alkylbenzene mixtures | GC, NMR1 NMR 2 |
| Alkylbenzene mixtures with impurities* | GC, DIS, GC, NMR1 NMR 2 |
| Alkylbenzenesulfonic acid mixtures | Option 1: HPLC, NMR3 NMR 4<br>Option 2: HPLC, DE, NMR1 NMR 2 |
| Alkylbenzenesulfonate salt mixtures | Option 1: HPLC, AC, NMR3 NMR 4<br>Option 2: HPLC, DE, NMR1 NMR 2 |
| Alkylbenzenesulfonic acid mixtures with impurities* | Option 1: HPLC, HPLC-P, HPLC, NMR3 NMR 4<br>Option 2: HPLC, DE, DIS, GC, NMR1 NMR 2 |
| Alkylbenzenesulfonate salt mixtures with impurities* | Option 1: HPLC, HPLC-P, HPLC, AC, NMR3 NMR 4<br>Option 2: HPLC, DE, DIS, GC, NMR1 NMR 2 |

*Typically preferred when the material contains more than about 10% impurities such as dialkylbenzenes, olefins, paraffins, hydrotropes, dialkylbenzenesulfonates, etc.

GC

Equipment

Hewlett Packard Gas Chromatograph HP5890 Series II equipped with a split/splitless injector and FID J&W Scientific capillary column DB-1HT, 30 meter, 0.25 mm id, 0.1 um film thickness cat# 1221131

Restek Red lite Septa 11 mm cat# 22306

Restek 4 mm Gooseneck inlet sleeve with a carbofrit cat# 20799-209.5

O-ring for inlet liner Hewlett Packard cat# 5180-4182

J. T. Baker HPLC grade Methylene Chloride cat# 9315-33, or equivalent 2 ml GC autosampler vials with crimp tops, or equivalent Sample Preparation Weigh 4–5 mg of sample into a 2 ml GC autosampler vial Add 1 ml J. T. Baker HPLC grade Methylene Chloride, cat# 9315-33 to the GC vial, seal with 11 nm crimp vial teflon lined closures (caps), part # HP5181-1210 using crimper tool, part # HP8710-0979 and mix well The sample is now ready for injection into the GC GC Parameters Carrier Gas: Hydrogen Column Head Pressure: 9 psi Flows: Column Flow @1 ml/min.
Split Vent @~3 ml/min.
Septum Purge @1 ml/min.

Injection: HP 7673 Autosampler, 10 ul syringe, 1 ul injection

Injector Temperature: 350° C.

Detector Temperature: 400° C.

Oven Temperature Program:
initial 70° C. hold 1 min.
rate 1° C./min.
final 180° C. hold 10 min.

Standards required for this method are 2-phenyloctane and 2-phenylpentadecane, each freshly distilled to a purity of greater than 98%. Run both standards using the conditions specified above to define the retention time for each standard. This defines a rentention time range which is the retention time range to be used for characterizing any alkylbenzenes or alkylbenzene mixtures in the context of this invention (e.g., test samples). Now run the test samples for which compositional parameters are to be determined. Test samples pass the GC test provided that greater than 90% of the total GC area percent is within the retention time range defined by the two standards. Test samples that pass the GC test can be used directly in the NMR1 and NMR2 test methods. Test samples that do not pass the GC test must be further purified by distillation until the test sample passes the GC test.

Desulfonation (DE)

The desulfonation method is a standard method described in "The Analysis of Detergents and Detergent Products" by G. F. Longman on pages 197–199. Two other useful descriptions of this standard method are given on page 230–231 of volume 40 of the Surfactant Sience Series edited by T. M. Schmitt: "Analysis of Surfactants" and on page 272 of volume 73 of the Surfactant Science Series: "Anionic Surfactants" edited by John Cross. This is an alternative method to the HPLC method, described herein, for evaluation of the branched and nonbranched alkylbenzenesulfonic acid and/or salt mixtures (Modified Alkylbenzensulfonic acid and or salt Mixtures). The method provides a means of converting the sulfonic acid and/or salt mixture into branched and nonbranched alkylbenzene mixtures which can then be analyzed by means of the GC and NMR methods NMR1 and NMR2 described herein.

HPLC

See L. R. Snyder and J. J. Kirkland, "Introduction to Modem Liquid Chromatography", 2nd. Ed., Wiley, NY, 1979.

| Apparatus | |
|---|---|
| Suitable HPLC System | Waters Division of Millipore or equivalent. |
| HPLC pump with He sparge and temperature control | Waters, model 600 or equivalent |
| Autosampler/injector | Waters 717, or equivalent |
| Autosampler 48 position tray | Waters or equivalent |
| UV detector | Waters PDA 996 or equivalent |
| Fluorescence detector | Waters 740 or equivalent |
| Data System/Integrator | Waters 860 or equivalent |
| Autosampler vials and caps | 4 mL capacity, Millipore #78514 and #78515. |
| HPLC Column, X2 | Supelcosil LC18, 5 μm, 4.6 mm × 25 cm, Supelcosil #58298 |
| Column Inlet Filter | Rheodyne 0.5 μm × 3 mm Rheodyne #7335 |
| LC eluent membrane filters | Millipore SJHV M47 10, disposable filter funnel with 0.45 μm membrane. |
| Balance | Sartorius or equivalent; precision ±0.0001 g. |
| Vacuum | Sample Clarification Kit with pumps and filters, Waters #WAT085113. |
| **Reagents** | |
| C8 LAS standard material | Sodium-p-2-octylbenzene sulfonate. |
| C15 LAS standard material | Sodium-p-2-pentadecylbenzene sulfonate. |

Procedure

A. Preparation of HPLC mobile Phase

1. Mobile phase A
   a) Weigh 11.690 g sodium chloride and transfer to a 2000 mL volumetric flask. Dissolve in 200 mL HPLC grade water.
   b) Add 800 mL of acetonitrile and mix. Dilute to volume after solution comes to room temperature. This prepares a solution of 100 mM NaCl/40% ACN.
   c) Filter through an LC eluent membrane filter and degas prior to use.
2. Mobile phase B—Prepare 2000 mL of 60% acetonitrile in HPLC grade water. Filter through an LC eluient membrane filter and degas prior to use.

B. C8 and C15 Internal Standard Solution

1. Weigh 0.050 g of a 2-phenyloctylbenzenesulfonate and 0.050 g of 2-Phenylpentadecanesulfonate standards and quantitatively transfer to a 100 mL volumetric flask.
2. Dissolve with 30 mL ACN and dilute to volume with HPLC grade water.

This prepares ca. 1500 ppm solution of the mixed standard.

C. Sample Solutions

1. Wash Solutions—Transfer 250 μL of the standard solution to a 1 mL autosampler vial and add 750 μL of the wash solution. Cap and place in the autosampler tray.
2. Alkylbenzenesulfonic acid or Alkylbenzenesulfonate—Weigh 0.10 g of the alkylbenzenesulfonic acid or salt and quantitatively transfer to a 100 mL volumetric flask. Dissolve with 30 mL ACN and dilute to volume with HPLC grade water. Transfer 250 μL of the standard solution to a 1 mL autosampler vial and add 750 μL of the sample solution. Cap and place in the autosampler tray. If solution is excessively turbid, filter through 0.45 μm membrane before transferring to autosampler vial. Cap and place in the auto-sampler tray.

D. HPLC System

1. Prime HPLC pump with mobile phase. Install column and column inlet filter and equilibrate with eluent (0.3 mL/min for at least 1 hr.).
2. Run samples using the following HPLC conditions:

| | | |
|---|---|---|
| Mobile phase A | 100 mM NaCl/40% ACN | |
| Mobile phase B | 40% $H_2O$/60% ACN | |
| time 0 min. | 100% Mobile phase A | 0% Mobile Phase B |
| time 75 min. | 5% Mobile phase A | 95% Mobile Phase B |
| time 98 min. | 5% Mobile phase A | 95% Mobile Phase B |
| time 110 min. | 100% Mobile phase A | 0% Mobile Phase B |
| time 120 min. | 100% Mobile phase A | 0% Mobile Phase B |

Note:
A gradient delay time of 5–10 minutes may be needed depending on dead volume of HPLC system.

| | |
|---|---|
| Flow rate | 1.2 mL/min. |
| Temperature | 25° C. |
| He sparge rate | 50 mL/hr. |
| UV detector | 225 nm |
| Fluorescence detector | λ = 225 nm, λ = 295 nm with sensitivity at 10x. |
| Run time | 120 min. |
| Injection volume | 10 μL |
| Replicate injections | 2 |
| Data rate | 0.45 MB/Hr. |
| Resolution | 4.8 nm |

3. The column should be washed with 100% water followed by 100% acetonitrile and stored in 80/20 ACN/water.

The HPLC elution time of the 2-phenyloctylbenzenesulfonate defines the lower limit and the elution time of the 2-phenylpentadecanesulfonate standard defines the upper limit of the HPLC analysis relating to the alkylbenzenesulfonic acid/salt mixture of the invention. If 90% of the alkylbenzenesulfonic acid/salt mixture components have retention times within the range of the above standards then the sample can be further defined by methods NMR 3 and NMR 4.

If the alkylbenzenesulfonic acid/salt mixture contains 10% or more of components outside the retention limits defined by the standards then the mixture should be further purified by method HPLC-P or by DE, DIS methods.

HPLC Preparative (HPLC-P)

Alkylbenzenesulfonic acids and/or the salts which contain substantial impurities (10% or greater) are purified by preparative HPLC. See L. R. Snyder and J. J. Kirkland, "Introduction to Modem Liquid Chromatography", 2nd. Ed., Wiley, NY, 1979. This is routine to one skilled in the art. A sufficient quantity should be purified to meet the requirements of the NMR 3 and NMR 4.

Preparative LC Method Using Mega Bond Elut Sep Pak® (HPLC-P)

Alkylbenzenesulfonic acids and/or the salts which contain substantial impurities (10% or greater) can also be purified by an LC method (also defined herein as HPLC-P). This procedure is actually preferred over HPLC column prep purification. As much as 500 mg of unpurified MLAS salts can be loaded onto a 10 g(60 ml) Mega Bond Elut Sep Pak® and with optimized chromatography the purified MLAS salt can be isolated and ready for freeze drying within 2 hours. A 100 mg sample of Modified alkylbenzenesulfonate salt can be loaded onto a 5 g(20 ml) Bond Elut Sep Pak and ready within the same amount of time.

A. Instrumentation

HPLC: Waters Model 600E gradient pump, Model 717 Autosampler, Water's Millennium PDA, Millenium Data Manager (v. 2.15)

Mega Bond Elut: C18 bonded phase, Varian 5 g or 10 g, PN:1225-6023, 1225-6031 with adaptors HPLC Columns: Supelcosil LC-18 (X2), 250×4.6 mm, 5mm; #58298

Analytical Balance: Mettler Model AE240, capable of weighing samples to ±0.01 mg B. Accessories Volumetrics: glass, 10 mL Graduated Cylinder: 1 L HPLC Autosampler Vials: 4 mL glass vials with Teflon caps and glass low volume inserts and pipette capable of accurately delivering 1, 2, and 5 mL volumes C. Reagents and Chemicals Water (DI-$H_2O$): Distilled, deionized water from a Millipore, Milli-Q system or equivalent Acetonitrile ($CH_3CN$): HPLC grade from Baker or equivalent Sodium Chloride Crystal Baker Analyzed or equivalent D. HPLC Conditions Aqueous Phase Preparation:

A: To 600 mL of DI-$H_2O$ contained in a 1 L graduated cylinder, add 5.845 of sodium chloride. Mix well and add 400 ml ACN. Mix well.

B: To 400 ml of DI-$H_2O$ contained in a 1 L graduated cylinder, add 600 ml ACN and mix well.

Reservoir A: 60/40, $H_2O$/CAN with salt and Reservoir B: 40/60, $H_2O$/ACN

Run Conditions: Gradient: 100% A for 75 min. 5%A/95% B for 98 min. 5%A/95% B for 110 min. 100%A for 125min.

| | |
|---|---|
| Column Temperature | Not Thermostatted (i.e., room temp.) |
| HPLC Flow Rate | 1.2 mL/min |
| Injection Volume | 10 mL |
| Run Time | 125 minutes |
| UV Detection | 225 nm |
| Conc. | >4 mg/ml |

Sep Pak Equilibration (Bond Elut, 5 G)

1. Pass 10 ml of a solution containing 25/75 $H_2O$/ACN onto the sep pak by applying positive pressure with a 10 cc syringe at a rate of ~40 drops/min. Do not allow the sep pak to go dry.
2. Immediately pass 10 ml (×3) of a solution containing 70/30 $H_2O$/ACN in the same manner as #1. Do not allow the sep pak to go dry. Maintain a level of solution (~1 mm) at the head of the sep pak.
3. The sep pak is now ready for sample loading.

MLAS Sample Loading/Separation and Isolation

4. Weigh <200 mg of sample into a 1 dram vial and add 2 ml of 70/30 $H_2O$/ACN. Sonicate and mix well.
5. Load sample onto Bond Elut and with positive pressure from a 10 cc syringe begin separation. Rinse vial with 1 ml (×2) portions of the 70/30 solution and load onto sep pak. Maintain ~1 mm of solution at the head of the sep pak.
6. Pass 10 ml of 70/30 onto the Bond Elut with positive pressure from a 10 cc syringe at a rate of ~40 drops/min.
7. 4. Repeat this with 3 ml and 4 ml and collect effluent if interested in impurities.

MLAS Isolation and Collection

1. Pass 10 ml of solution containing 25/75 $H_2O$/ACN with positive pressure from a 10 cc syringe and collect effluent. Repeat this with another 10 ml and again with 5 ml. The isolated MLAS is now ready for freeze drying and subsequent characterization.
2. Rotovap until ACN is removed and freeze dry the remaining $H_2O$. Sample is now ready for chromatography.

Note: When incorporating the Mega Bond Elut Sep Pak (10 g version) up to 500 mg of sample can be loaded onto the sep pak and with solution volume adjustments, the effluent can be ready for freeze drying within 2 hours.

Sep Pak Equilibration (Bond Elut, 10 G)

1. Pass 20 ml of a solution containing 25/75 $H_2O$/ACN onto the sep pak using laboratory air or regulated cylinder air at a rate which will allow ~40 drops/min. You can not use positive pressure from a syringe because it is not sufficient to move the solution thru the sep pak. Do not allow the sep pak to go dry.
2. Immediately pass 20 ml (×2) and an additional 10 ml of a solution containing 70/30 $H_2O$/ACN in the same manner as #1. Do not allow the sep pak to go dry. Maintain a level of solution (~1 mm)at the head of the sep pak.
3. The sep pak is now ready for sample loading.

MLAS Sample Loading/Separation and Isolation

1. Weigh <500 mg of sample into a 2 dram vial and add 5 ml of 70/30 $H_2O$/ACN. Sonicate and mix well.
2. Load sample onto Bond Elut and with positive pressure from an air source begin separation. Rinse vial with 2 ml (×2) portions of the 70/30 solution and put onto the sep pak. Maintain ~1 mm of solution at the head of the sep pak.
3. Pass 20 ml of 70/30 onto the Bond Elut with positive pressure from an air source at a rate of ~40 drops/min. Repeat this with 6 ml and 8 ml and collect effluent if interested in impurities.

MLAS Isolation and Collection

1. Pass 20 ml of solution containing 25/75 $H_2O$/ACN with positive pressure from an air source and collect effluent.
2. Repeat this with another 20 ml and again with 10 ml. This isolated fraction contains the pure MLAS.
3. The isolated MLAS is now ready for freeze drying and subsequent characterization.
4. Rotovap until ACN is removed and freeze dry the remaining $H_2O$. Sample is now ready for chromatography.

Note: Adjustments in organic modifier concentration may be necessary for optimum separation and isolation.

Distillation (DIS)

A 5 liter, 3-necked round bottom flask with 24/40 joints is equipped with a magnetic stir bar. A few boiling chips (Hengar Granules, catalog #136-C) are added to the flask. A 9½ inch long vigreux condenser with a 24/40 joint is placed in the center neck of the flask. A water cooled condenser is attached to the top of the vigreux condenser which is fitted with a calibrated thermometer. A vacuum receiving flask is attached to the end of the condenser. A glass stopper is placed in one side arm of the 5 liter flask and a calibrated thermometer in the other. The flask and the vigreux condenser are wrapped with aluminum foil. To the 5 liter flask, is added 2270 g of an alkylbenzene mixture which contains 10% or more impurities as defined by the GC method. A vacuum line leading from a vacuum pump is attached to the receiving flask. The alkylbenzene mixture in the 5 liter flask is stirred and vacuum is applied to the system. Once the maximum vacuum is reached (at least 1 inch of Hg pressure by gauge or less), the alkylbenzene mixture is heated by means of an electric heating mantle. The distillate is collected in two fractions. Fraction A is collected from about 25° C. to about 90° C. as measured by the calibrated thermometer at the top of the vigreux column. Fraction B is collected from about 90° C. to about 155° C. as measured by the calibrated thermometer at the top of the vigreux column. Fraction A and pot residues (high boiling) are discarded. Fraction B (1881 g) contains the alkylbenzene mixture of interest. The method can be scaled according to the practitioner's needs provided that sufficient quantity of the alkylbenzene mixture remains after distillation for evaluation by NMR methods NMR1 and NMR2.

Acidification (AC) Salts of alkylbenzenesulfonic acids are acidified by common means such as reaction in a solvent with HCl or sulfuric acid or by use of an acidic resin such as Amberlyst 15. Acidification is routine to one skilled in the art. After acidifying remove all solvents, especially any moisture, so that the samples are anhydrous and solvent-free.

Note: For all of the below NMR test methods, the chemical shifts of the NMR spectrum are externally referenced to $CDCl_3$, i.e. chloroform.

NMR 1

$^{13}$C-NMR 2/3-Phenyl Index for Alkylbenzene Mixtures

A 400 mg sample of an alkylbenzene mixture is dissolved in 1 ml of anhydrous deuterated chloroform containing 1% v/v TMS as reference and placed in a standard NMR tube. The $^{13}$C NMR is run on the sample on a 300 MHz NMR spectrometer using a 20 second recycle time, a 40° $^{13}$C pulse width and gated heteronuclear decoupling. At least 2000 scans are recorded. The region of the $^{13}$C NMR spectrum between about 145.00 ppm to about 150.00 ppm is integrated. The 2/3-Phenyl index of an alkylbenzene mixture is defined by the following equation:

2/3-Phenyl Index=(Integral from about 147.65 ppm to about 148.05 ppm)/(Integral from about 145.70 ppm to about 146.15 ppm)×100

NMR 2

$^{13}$C-NMR 2-Methyl-2-Phenyl Index

A 400 mg sample of an anhydrous alkylbenzene mixture is dissolved in 1 ml of anhydrous deuterated chloroform containing 1% v/v TMS as reference and placed in a standard NMR tube. The $^{13}$C NMR is run on the sample on a 300 MHz NMR spectrometer using a 20 second recycle time, a 40° $^{13}$C pulse width and gated heteronuclear decoupling. At least 2000 scans are recorded. The $^{13}$C NMR spectrum region between about 145.00 ppm to about 150.00 ppm is integrated. The 2-methyl-2-phenyl index of an alkylbenzene mixture is defined by the following equation:

2-methyl-2-phenyl index=(Integral from about 149.35 ppm to about 149.80 ppm)/(Integral from about 145.00 ppm to about 150.00 ppm).

NMR 3

$^{13}$C-NMR 2/3-Phenyl Index for Alkylbenzenesulfonic Acid Mixtures

A 400 mg sample of an anhydrous alkylbenzenesulfonic acid mixture is dissolved in 1 ml of anhydrous deuterated chloroform containing 1% v/v TMS as reference and placed in a standard NMR tube. The 13C NMR is run on the sample on a 300 MHz NMR spectrometer using a 20 second recycle time, a 40° $^{13}$C pulse width and gated heteronuclear decoupling. At least 2000 scans are recorded. The $^{13}$C NMR spectrum region between about 152.50 ppm to about 156.90 ppm is integrated. The 2/3-Phenyl Index of an alkylbenzenesulfonic acid mixture is defined by the following equation:

2/3-Phenyl Index=(Integral from about 154.40 to about 154.80 ppm)/(Integral from about 152.70 ppm to about 153.15 ppm)×100

NMR 4

$^{13}$C-NMR 2-Methyl-2-Phenyl Index for Alkylbenzenesulfonic Acid Mixtures

A 400 mg sample of an anhydrous alkylbenzenesulfonic acid mixture is dissolved in 1 ml of anhydrous deuterated chloroform containing 1% v/v TMS as reference and placed in a standard NMR tube. The $^{13}$C NMR is run on the sample on a 300 MHz NMR spectrometer using a 20 second recycle time, a 40° $^{13}$C pulse width and gated heteronuclear decoupling. At least 2000 scans are recorded. The $^{13}$C NMR spectrum region between about 152.50 ppm to about 156.90 ppm is integrated. The 2-methyl-2-phenyl Index for an alkylbenzenesulfonic acid mixture is defined by the following equation:

2-methyl-2-phenyl index=(Integral from about 156.40 ppm to about 156.65 ppm)/(Integral from about 152.50 ppm to about 156.90 ppm).

In one embodiment of the present invention, the hand dishwashing compositions are substantially free from alkylbenzene sulfonate surfactants other than the modified alkylbenzene sulfonate surfactant mixture. That is no alkylbenzene sulfonate surfactants other than the modified alkylbenzene sulfonate surfactant mixture are added to the detergent compositions.

In another embodiment of the present invention, the hand dishwashing compositions may contain as an additional surfactant at least about 0.1%, preferably no more than about 10%, more preferably no more than about 5%, more preferably still, no more than about 1%, of a commercial $C_{10}$–$C_{14}$ linear alkylbenzene sulfonate surfactant. It is further preferred that the commercial $C_{10}$–$C_{14}$ linear alkylbenzene sulfonate surfactant has a 2/3 phenyl index of from 75 to 160.

In another embodiment of the present inventions the hand dishwashing compositions may contain as an additional surfactant at least about 0.1%, preferably no more than about 10%, more preferably no more than about 5%, more preferably still, no more than about 1%, of a commercial highly branched alkylbenzene sulfonate surfactant. For example TPBS or tetrapropylbenzene sulfonate.

The present invention encompasses less preferred but sometimes useful embodiments for their normal purposes, such as the addition of usefuil hydrotrope precursors and/or hydrotropes, such as $C_1$–$C_8$ alkylbenzenes, more typically toluenes, cumenes, xylenes, naphthalenes, or the sulfonated derivatives of any such materials, minor amounts of any other materials, such as tribranched alkylbenzene sulfonate surfactants, dialkylbenzenes and their derivatives, dialkyl tetralins, wetting agents, processing aids, and the like. It will be understood that, with the exception of hydrotropes, it will not be usual practice in the present invention to include any such materials. Likewise it will be understood that such materials, if and when they interfere with analytical methods, will not be included in samples of compositions used for analytical purposes.

Numerous variations of the present hand dishwashing compositions are useful. Such variations include:

- the hand dishwashing composition which is substantially free from alkylbenzene sulfonate surfactants other than said modified alkylbenzene sulfonate surfactant mixture;
- the hand dishwashing composition which comprises, in said component (iii), at least about 0.1%, preferably no more than about 10%, more preferably no more than about 5%, more preferably still, no more than about 1%, of a commercial $C_{10}$–$C_{14}$ linear alkylbenzene sulfonate surfactant;

the hand dishwashing composition which comprises, in said component (iii), at least about 0.1%, preferably no more than about 10%, more preferably no more than about 5%, more preferably still, no more than about 1%, of a commercial highly branched alkylbenzene sulfonate surfactant. (e.g., TPBS or tetrapropylbenzene sulfonate);

the hand dishwashing composition which comprises, in said component (iii), a nonionic surfactant at a level of from about 0.5% to about 25% by weight of said detergent composition, and wherein said nonionic surfactant is a polyalkoxylated alcohol in capped or non-capped form having:—a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof and—a hydrophilic group selected from 1–15 ethoxylates, 1–15 propoxylates 1–15 butoxylates and mixtures thereof, in capped or uncapped form. (when uncapped, there is also present a terminal primary —OH moiety and when capped, there is also present a terminal moiety of the form —OR wherein R is a $C_1$–$C_6$ hydrocarbyl moiety, optionally comprising a primary or, preferably when present, a secondary alcohol.);

the hand dishwashing composition which comprises, in said component (iii), an alkyl sulfate surfactant at a level of from about 0.5% to about 25% by weight of said detergent composition, wherein said alkyl sulfate surfactant has a hydrophobic group selected from linear $C_{10}$–$C_{18}$ alkyl, mid-chain $C_1$–$C_3$ branched $C_{10}$–$C_{18}$ alkyl, guerbet branched $C_{10}$–$C_{18}$ alkyl, and mixtures thereof and a cation selected from Na, K and mixtures thereof;

the hand dishwashing composition which comprises, in said component (iii), an alkyl(polyalkoxy)sulfate surfactant at a level of from about 0.5% to about 25% by weight of said detergent composition, wherein said alkyl(polyalkoxy)sulfate surfactant has—a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof and—a (polyalkoxy)sulfate hydrophilic group selected from 1–15 polyethoxysulfate, 1–15 polypropoxysulfate, 1–15 polybutoxysulfate, 1–15 mixed poly(ethoxy/propoxy/butoxy)sulfates, and mixtures thereof, in capped or uncapped form; and—a cation selected from Na, K and mixtures thereof;

It is preferred that when the hand dishwashing composition comprises an alkyl(polyalkoxy)sulfate surfactant which has a hydrophobic group selected from linear $C_{10}$–$C_{16}$ alkyl, mid-chain $C_1$–$C_3$ branched $C_{10}C_{16}$ alkyl, guerbet branched $C_{10}$–$C_{16}$ alkyl, and mixtures thereof; and a (polyalkoxy) sulfate hydrophilic group selected from 1–15 polyethoxysulfate, 1–15 polypropoxysulfate, 1–15 polybutoxysulfate, 1–15 mixed poly(ethoxy/propoxy/butoxy)sulfates, and mixtures thereof, in capped or uncapped form; and a cation selected from Na, K and mixtures thereof.

It is preferred that when the hand dishwashing composition comprises a nonionic surfactant, it is a polyalkoxylated alcohol in capped or non-capped form has a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof; and a hydrophilic group selected from 1–15 ethoxylates, 1–15 propoxylates 1–15 butoxylates and mixtures thereof, in capped or uncapped form. When uncapped, there is also present a terminal primary —OH moiety and when capped, there is also present a terminal moiety of the form —OR wherein R is a $C_1$–$C_6$ hydrocarbyl moiety, optionally comprising a primary or, preferably when present, a secondary alcohol.

It is preferred that when the hand dishwashing composition comprises an alkyl sulfate surfactant which has a hydrophobic group selected from linear $C_{10}$–$C_{16}$ alkyl, mid-chain $C_1$–$C_3$ branched $C_{10}$–$C_{18}$ alkyl, guerbet branched $C_{10}$–$C_{16}$ alkyl, and mixtures thereof and a cation selected from Na, K and mixtures thereof.

The hand dishwashing compositions of the present invention can be used or applied by hand and/or can be applied in unitary or freely alterable dosage, or by automatic dispensing means, They can be used in aqueous or non-aqueous cleaning systems. They can have a wide range of pH, for example from about 2 to about 12 or higher, though alkaline detergent compositions having a pH of from about 8 to about 11 are among the preferred embodiments, and they can have a wide range of alkalinity reserve. Both high-foaming and low-foaming types are encompassed, as well as types for use in all known aqueous and non aqueous consumer product cleaning processes.

The hand dishwashing compositions can be in any conventional form, namely, in the form of a liquid, powder, agglomerate, paste, tablet, bar, gel, liqui-gel microemulsion, liquid crystal, or granule.

Conventional Hand Dishwashing Adjuncts and Methods

In general, a conventional hand dishwashing adjunct is any material required to transform a composition containing only the minimum essential ingredients (herein the essential modified alkylbenzene sulfonate surfactant mixture) into a composition useful for hand dishwashing. In preferred embodiments, conventional hand dishwashing adjuncts are easily recognizable to those of skill in the art as being absolutely characteristic of cleaning products.

The precise nature of these additional components, and levels of incorporation thereof, will depend on the physical form of the composition and the nature of the cleaning operation for which it is to be used.

Levels of conventional hand dishwashing adjunct are from about 0.00001% to about 99.9%, by weight of the composition. Use levels of the overall compositions can vary widely depending on the intended application, ranging for example from a few ppm in solution to so-called "direct application" of the neat cleaning composition to the surface to be cleaned.

Preferably the conventional hand dishwashing adjunct is selected from the group consisting of builders, detersive enzymes, surfactants other than the modified alkyl benzene sulfonate surfactant mixture, typically selected from anionic, cationic, amphoteric, zwitterionic, nonionic and mixtures thereof, at least partially water-soluble or water dispersible polymers, abrasives, bactericides, tarnish inhibitors, dyes, solvents, hydrotropes, perfumes, thickeners, antioxidants, processing aids, suds boosters, suds suppressors, buffers, anti-fungal agents, mildew control agents, insect repellents, anti-corrosive aids, chelants and mixtures thereof. More preferably the conventional cleaning adjunct comprises one or more of:

Consumer product cleaning compositions are described in the "Surfactant Science Series", Marcel Dekker, New York, Volumes 1–67 and higher. Liquid compositions in particular are described in detail in the Volume 67, "Liquid Detergents", Ed. Kuo-Yann Lai, 1997, ISBN 0-8247-9391-9 incorporated herein by reference. More classical formulations, especially granular types, are described in "Detergent Manufacture including Zeolite Builders and Other New Materials", Ed. M. Sittig, Noyes Data Corporation, 1979 incorporated by reference. See also Kirk Othmer's Encyclopedia of Chemical Technology.

Detergents with enduring perfume (see for example U.S. Pat. No. 5,500,154; WO 96/02490) are increasingly popular and there use in conjunction with the present surfactant mixtures is envisioned.

In general, a conventional hand dishwashing adjuncts is any material required to transform a composition containing only the minimum essential ingredients (herein the essential modified alkylbenzene sulfonate surfactant mixture) into a composition useful for hand dishwashing. In preferred embodiments, conventional hand dishwashing adjuncts are easily recognizable to those of skill in the art as being absolutely characteristic of cleaning products.

The precise nature of these additional components, and levels of incorporation thereof, will depend on the physical form of the composition and the nature of the cleaning operation for which it is to be used.

Common adjuncts include builders, surfactants, enzymes, and polymers, and the like. Other adjuncts herein can include suds boosters, suds suppressors (antifoams) and the like, diverse active ingredients or specialized materials such as dispersant polymers (e.g., from BASF Corp. or Rohm & Haas), color speckles, silvercare, anti-tarnish and/or anti-corrosion agents, dyes, fillers, germicides, alkalinity sources, hydrotropes, anti-oxidants, enzyme stabilizing agents, pro-perfumes, perfumes, solubilizing agents, carriers, processing aids, pigments, and, for liquid formulations, solvents, as described in detail hereinafter.

Quite typically, the compositions herein may require several adjuncts, though certain simply formulated products may require only, one adjunct. A comprehensive list of suitable laundry or cleaning adjunct materials and methods can be found in U.S. Provisional Patent application No. 60/053,318 filed Jul. 21, 1997 and assigned to Procter & Gamble.

The modifed alkyl benzene sulfonate surfactants of the present invention can be used in a wide range of hand dishwashing formulations. This novel surfactant system can be used as a total or partial replacement of conventional LAS in existing hand dishwashing compositions. Formulations where the modifed alkyl benzene sulfonate surfactants of the present invention may be used as a supplement to the existing surfactant system or as a total or partial replacement for LAS in the surfactant system include, but not limited to: WO 98/12290; U.S. Pat. No. 5,728,668; WO 98/05745; U.S. Pat. Nos. 5,756,441; 5,714,454; 5,712,241; 5,707,955; 4,133,779; WO 97/47717; U.S. Pat. Nos. 5,688,754; 5,665,689; WO 9738073; U.S. Pat. No. 5,696,073; WO 97/38071; WO 97/00930 A; GB 2,292,562 A; U.S. Pat. Nos. 5,376,310; 5,269,974; 5,230,823; 4,923,635; 4,681,704; 4,316,824; 4,133,779; 5,700,773; WO 9735947; WO 97/34976; U.S. Pat. No. 5,629,279; WO 9715650; U.S. Pat. Nos. 5,616,548; 5,610,127; 5,565,421; WO 96/31586; U.S. Pat. Nos. 5,561,106; 5,552,089; WO 96/22347; U.S. Pat. Nos. 5,503,779; 5,480,586; EP 573329; U.S. Pat. No. 5,382,386; EP 487169; U.S. Pat. No. 5,096,622; EP 431050; U.S. Pat. Nos. 5,102,573; 4,772,425; 4,725,337; EP 228797; U.S. Pat. Nos. 4,556,509; 4,454,060; 4,554,098; 4,430,237; 4,877,546; 4,064,076; 4,101,456; 3,944,663; 4,040,989; 4,102,826; 5,767,051; 5,780,417; WO 97/26315; U.S. Pat. Nos. 5,290,482; 3,954,679; 5,700,331; 5,679,877; 5,565,419; WO 98/22569; U.S. Pat. Nos. 5,736,496; 5,733,560; 5,741,69; 5,733,860; 5,741,770; 5,719,114; 5,604,195; EP 848749; EP 839177; U.S. Pat. Nos. 5,646,104; 5,580,848; EP 781324 U.S. Pat. Nos. 5,415,812; 5,435,936; 5,082,584; 5,393,468;

Detersive surfactants—The instant compositions desirably include a detersive surfactant used as a co-surfactant with the essential surfactant mixtures. Since the present invention is surfactant-related, in the descriptions of the preferred embodiments of the detergent compositions of the invention, surfactant materials are described and accounted for separately from nonsurfactant adjuncts. Detersive surfactants are extensively illustrated in U.S. Pat. No. 3,929,678, Dec. 30, 1975 Laughlin, et al, and U.S. Pat. No. 4,259,217, Mar. 31, 1981, Murphy; in the series "Surfactant Science", Marcel Dekker, Inc., New York and Basel; in "Handbook of Surfactants", M. R. Porter, Chapman and Hall, 2nd Ed., 1994; in "Surfactants in Consumer Products", Ed. J. Falbe, Springer-Verlag, 1987; and in numerous detergent-related patents assigned to Procter & Gamble and other detergent and consumer product manufacturers.

The detersive surfactant herein includes anionic, nonionic, cationic, zwitterionic or arnphoteric types of surfactant known for use as cleaning agents, but does not include completely foam-free or completely insoluble surfactants (though these may be used as optional adjuncts).

In more detail, detersive surfactants useful herein, suitably include: (1) conventional alkylbenzene sulfonates, including the hard (ABS, TPBS) or linear types and made by known process such as various HF or solid HF e.g., DETAL® (UOP) process, or made by using other Lewis Acid catalysts e.g., $AlCl_3$, or made using acidic silica/alumina or made from chlorinated hydrocarbons; (2) olefin sulfonates, including α-olefin sulfonates and sulfonates derived from fatty acids and fatty esters; (3) alkyl or alkenyl sulfosuccinates, including the diester and half-ester types as well as sulfosuccinamates and other sulfonate/ carboxylate surfactant types such as the sulfosuccinates derived from ethoxylated alcohols and alkanolamides; (4) paraffin or alkane sulfonate- and alkyl or alkenyl carboxysulfonate-types including the product of adding bisulfite to alpha olefins; (5) alkylnaphthalenesulfonates; (6) alkyl isethionates and alkoxypropanesulfonates, as well as fatty isethionate esters, fatty esters of ethoxylated isethionate and other ester sulfonates such as the ester of 3-hydroxypropanesulfonate or AVANEL S types; (7) benzene, cumene, toluene, xylene, and naphthalene sulfonates, useful especially for their hydrotroping properties; (8) alkyl ether sulfonates; (9) alkyl amide sulfonates; (10) α-sulfo fatty acid salts or esters and internal sulfo fatty acid esters; (11) alkylglycerylsulfonates; (12) ligninsulfonates; (13) petroleum sulfonates, sometimes known as heavy alkylate sulfonates; (14) diphenyl oxide disulfonates; (15) linear or branched alkylsulfates or alkenyl sulfates; (16) alkyl or alkylphenol alkoxylate sulfates and the corresponding polyalkoxylates, sometimes known as alkyl ether sulfates, as well as the alkenylalkoxysulfates or alkenylpolyalkoxy sulfates; (17) alkyl amide sulfates or alkenyl amnide sulfates, including sulfated alkanolamides and their alkoxylates and polyalkoxylates; (18) sulfated oils, sulfated alkylglycerides, sulfated alkylpolyglycosides or sulfated sugar-derived surfactants; (19) alkyl alkoxycarboxylates and alkylpolyalkoxycarboxylates, including galacturonic acid salts; (20) alkyl ester carboxylates and alkenyl ester carboxylates; (21) alkyl or alkenyl carboxylates, especially conventional soaps and α,ω-dicarboxylates, including also the alkyl- and alkenylsuccinates; (22) alcyl or alkenyl amnide alkoxy- and polyalkoxy-carboxylates; (23) alkyl and alkenyl amidocarboxylate surfactant types, including the sarcosinates, taurides, glycinates, aminopropionates and iminopropionates; (24) amide soaps, sometimes referred to as fatty acid cyanamides; (25) alkylpolyaminocarboxylates; (26) phosphorus-based surfactants, including alkyl or alkenyl phosphate esters, alkyl ether phosphates including their alkoxylated derivatives, phopshatidic acid salts, alkyl phosphonic acid salts, alkyl di(polyoxyalkylene alkanol) phosphates, amphoteric phosphates such as lecithins; and phosphate/carboxylate, phosphate/sulfate and phosphate/sulfonate types; (27) Pluronic- and Tetronic-type nonionic surfactants; (28) the so-called EO/PO Block polymers, including the diblock and triblock EPE and PEP types; (29) fatty acid polyglycol esters; (30) capped and non-capped alkyl or alkylphenol ethoxylates, propoxylates and butoxylates including fatty alcohol polyethyleneglycol ethers; (31) fatty alcohols, especially where useful as viscosity-modifying surfactants or present as unreacted components of other surfactants; (32) N-alkyl polyhydroxy fatty acid amides, especially the alkyl N-alkylglucamides; (33) nonionic surfactants derived from mono- or polysaccharides or sorbitan, especially the alkylpolyglycosides, as well as sucrose fatty acid esters; (34) ethylene glycol-, propylene glycol-, glycerol- and polyglyceryl-esters and their alkoxylates, especially glycerol ethers and the fatty acid/glycerol monoesters and diesters; (35) aldobionamide surfactants; (36) alkyl succinimide nonionic surfactant types; (37) acetylenic alcohol surfactants, such as the SURFYNOLS; (38) alkanolamide surfactants and their alkoxylated derivatives including fatty acid alkanolamides and fatty acid alkanolamide polyglycol ethers; (39) alkylpyrrolidones; (40) alkyl amine oxides, including alkoxylated or polyalkoxylated amine oxides and amine oxides derived from sugars; (41) alkyl phosphine oxides; (42) sulfoxide surfactants; (43) amphoteric sulfonates, especially sulfobetaines; (44) betaine-type arnphoterics, including aminocarboxylate-derived types; (45) amnphoteric sulfates such as the alkyl ammonio polyethoxysulfates; (46) fatty and petroleum-derived alkylamines and amine salts; (47) alkylimidazolines; (48) alkylamidoamines and their alkoxylate and polyalkoxylate derivatives; and (49) conventional cationic surfactants, including water-soluble alkyltrimethylammonium salts. Moreover, more unusual surfactant types are included, such as: (50) alkylamidoamine oxides, carboxylates and quaternary salts; (51) sugar-derived surfactants modeled after any of the hereinabove-referenced more conventional nonsugar types; (52) fluorosurfactants; (53) biosurfactants; (54) organosilicon or fluorocarbon surfactants; (55) gemini surfactants, other than the above-referenced diphenyl oxide disulfonates, including those derived from glucose; (56) polymeric surfactants including amphopolycarboxyglycinates; and (57) bolaform surfactants; in short any surfactant known for aqueous or non-aqueous cleaning.

In any of the above detersive surfactants, hydrophobe chain length is typically in the general range $C_8$–$C_{20}$, with chain lengths in the range $C_8$–$C_{18}$ often being preferred, especially when laundering is to be conducted in cool water. Selection of chainlengths and degree of alkoxylation for conventional purposes are taught in the standard texts. When the detersive surfactant is a salt, any compatible cation may be present, including H (that is, the acid or partly acid form of a potentially acidic surfactant may be used), Na, K, Mg, amrnonium or alkanolammonium, or combinations of cations. Mixtures of detersive surfactants having different charges are commonly preferred, especially anionic/cationic, anionic/nonionic, anionic/nonionic/cationic, anionic/nonionic/amphoteric, nonionic/cationic and nonionic/amphoteric mixtures. Moreover, any single detersive surfactant may be substituted, often with desirable results for cool water washing, by mixtures of otherwise similar detersive surfactants having differing chainlengths, degree of unsaturation or branching, degree of alkoxylation (especially ethoxylation), insertion of substituents such as ether oxygen atoms in the hydrophobes, or any combinations thereof.

Preferred among the above-identified detersive surfactants are: acid, sodium and ammonium $C_9$–$C_{20}$ linear alkylbenzene sulfonates, particularly sodium linear secondary alkyl $C_{10}$–$C_{15}$ benzenesulfonates though in some regions ABS may be used (1); olefinsulfonate salts, (2), that is, material made by reacting olefins, particularly $C_{10}$–$C_{20}$ α-olefins, with sulfur trioxide and then neutralizing and hydrolyzing the reaction product; sodium and ammonium $C_7$–$C_{12}$ dialkyl sulfosuccinates, (3); alkane monosulfonates, (4), such as those derived by reacting $C_8$–$C_{20}$ α-olefins with sodium bisulfite and those derived by reacting paraffins with $SO_2$ and $Cl_2$ and then hydrolyzing with a base to form a random sulfonate; α-Sulfo fatty acid salts or esters, (10); sodium alkylglycerylsulfonates, (11), especially those ethers of the higher alcohols derived from tallow or coconut oil and synthetic alcohols derived from petroleum; alkyl or alkenyl sulfates, (15), which may be primary or secondary, saturated or unsaturated, branched or unbranched. Such compounds when branched can be random or regular. When secondary, they preferably have formula $CH_3(CH_2)_x(CHOSO_3^-M^+)CH_3$ or $CH_3(CH_2)_y(CHOSO_3^-M^+)CH_2CH_3$ where x and (y+1) are integers of at least 7, preferably at least 9 and M is a water-soluble cation, preferably sodium. When unsaturated, sulfates such as oleyl sulfate are preferred, while the sodium and ammonium alkyl sulfates, especially those produced by sulfating $C_8$–$C_{18}$ alcohols, produced for example from tallow or coconut oil are also useful; also preferred are the alkyl or alkenyl ether sulfates, (16), especially the ethoxy sulphates having about 0.5 moles or higher of ethoxylation, preferably from 0.5–8; the alkylethercarboxylates, (19), especially the EO 1–5 ethoxycarboxylates; soaps or fatty acids (21), preferably the more water-soluble types; aminoacid-type surfactants, (23), such as sarcosinates, especially oleyl sarcosinate; phosphate esters, (26); alkyl or alkylphenol ethoxylates, propoxylates and butoxylates, (30), especially the ethoxylates "AE", including the so-called narrow peaked alkyl ethoxylates and $C_6$–$C_{12}$ alkyl phenol alkoxylates as well as the products of aliphatic primary or secondary linear or branched $C_8$–$C_{18}$ alcohols with ethylene oxide, generally 2–30 EO; N-alkyl polyhydroxy fatty acid amides especially the $C_{12}$–$C_{18}$ N-methylglucamides, (32), see WO 9206154, and N-alkoxy polyhydroxy fatty acid amides, such as $C_{10}$–$C_{18}$ N-(3-methoxypropyl) glucamide while N-propyl through N-hexyl $C_{12}$–$C_{18}$ glucamides can be used for low sudsing; alkyl polyglycosides, (33); amine oxides, (40), preferably alkyldimethylamine N-oxides and their dihydrates; sulfobetaines or "sultaines", (43); betaines (44); and gemini surfactants.

Cationic surfactants suitable for use in the present invention include those having a long-chain hydrocarbyl group. Examples of such cationic co-surfactants include the ammonium co-surfactants such as alkyldimethylammonium halogenides, and those co-surfactants having the formula:

$$[R^2(OR^3)_y][R^4(OR^3)_y]_2R^5N^+X^-$$

wherein $R^2$ is an alkyl or alkyl benzyl group having from 8 to 18 carbon atoms in the alkyl chain, each $R^3$ is selected from the group consisting of —$CH_2CH_2$—, —$CH_2CH$ $(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Examples of other suitable catiomc. surfactants are described in following documents, all of which are incorporated by reference herein in their entirety: M. C. Publishing Co., McCutcheon's, Detergents & Emulsifiers, (North American edition 1997); Schwartz, et al., Surface Active Agents, Their Chemistry and Technology, New York: Interscience Publishers, 1949; U.S. Pat. Nos. 3,155,591; 3,929,678; 3,959,461 4,387,090 and 4,228,044.

Examples of suitable cationic surfactants are those corresponding to the general formula:

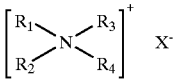

wherein $R_1$, $R_2$, $R_3$, and $R_4$ are independently selected from an aliphatic group of from 1 to about 22 carbon atoms or an aromatic, alkoxy, polyoxyalkylene, alkylamido, hydroxyalkyl, aryl or alkylaryl group having up to about 22 carbon atoms; and X is a salt-forming anion such as those selected from halogen, (e.g. chloride, bromide), acetate, citrate, lactate, glycolate, phosphate nitrate, sulfate, and alkylsulfate radicals. The aliphatic groups can contain, in addition to carbon and hydrogen atoms, ether linkages, and other groups such as amino groups. The longer chain aliphatic groups, e.g., those of about 12 carbons, or higher, can be saturated or unsaturated. Preferred is when $R_1$, $R_2$, $R_3$, and $R_4$ are independently selected from C1 to about C22 alkyl. Especially preferred are cationic materials containing two long alkyl chains and two short alkyl chains or those containing one long alkyl chain and three short alkyl chains. The long alkyl chains in the compounds described in the previous sentence have from about 12 to about 22 carbon atoms, preferably from about 16 to about 22 carbon atoms, and the short alkyl chains in the compounds described in the previous sentence have from 1 to about 3 carbon atoms, preferably from 1 to about 2 carbon atoms.

Suitable levels of cationic detersive surfactant herein are from about 0.1% to about 20%, preferably from about 1% to about 15%, although much higher levels, e.g., up to about 30% or more, may be useful especially in nonionic: cationic (i.e., limited or anionic-free) formulations. One possible use of cationic surfactants is as grease release agents. Cationic surfactants can be on their own or in combination with solvents and/or solublizing agents. See U.S. Pat. No. 5,552,089.

Another type of useful surfactants are the so-called dianionics. These are surfactants which have at least two anionic groups present on the surfactant molecule. Some suitable dianionic surfactants are further described in copending U.S. Ser. Nos. 60/020,503, 60/020,772, 60/020,928, 60/020,832, and 60/020,773, all filed on Jun. 28, 1996, and Ser. Nos. 60/023,539, 60/023493, 60/023,540 and 60/023,527 filed on Aug. 8th, 1996, the disclosures of which are incorporated herein by reference.

Additionally and preferably, the surfactant may be a midchain branched alkyl sulfate, midchain branched alkyl alkoxylate, or midchain branched alkyl alkoxylate sulfate. These surfactants are further described in Ser. No. 60/061,971, Oct. 14, 1997, Ser. No. 60/061,975, Oct. 14, 1997, Ser. No. 60/062,086, Oct. 14, 1997, Ser. No. 60/061,916, Oct. 14, 1997, Ser. No. 60/061,970, Oct. 14, 1997, Ser. No. 60/062,407, Oct. 14, 1997,. Other suitable mid-chain branched surfactants can be found in U.S. patent applications Ser. Nos. 60/032,035, 60/031,845, 60/031,916, 60/031,917, 60/031,761, 60/031,762 and 60/031,844. Mixtures of these branched surfactants with conventional linear surfactants are also suitable for use in the present compositions.

Combinations of surfactants are also envisaged. One such combination would be the modified alkylbenzene sulfonate surfactants of the present invention forming a negatively charged complex with an alkylene carbonate surfactant. See U.S. Pat. No. 5,736,496. Alternatively these alkylene carbonate surfactants can be combines with the modified alkylbenzene sulfonate surfactants of the present and not form a negatively charged complex. Such as the compositions in U.S. Pat. No. 5,733,860. In either type of composition suitable alkylene carbonate surfactants include those of the formula:

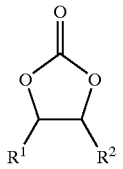

wherein R1 is a Cn alkyl group, R2 is H or is a Cm alkyl group, with n+m being a number from 11–14;

Another possible combination with the modified alkylbenzene suffonate surfactant is with a monoalkyl succinamate, more preferably with from about 0.5 to about 6% by weight of a $C_{10}$ to $C_{18}$ monoalkyl succinamate, wherein the alkyl group may be ethoxylated with up to 8 moles of ethylene oxide, the monoalkyl succinamate has the structure:

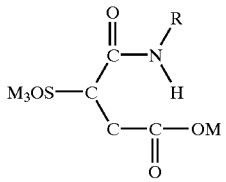

where R is an aliphatic radical, of from 10 to 18 carbon atoms, and M is a cation, selected from the group consisting of sodium, potassium, ammonium and alkanolamine. See U.S. Pat. No. 5,480,586.

Suitable levels of anionic detersive surfactants herein are in the range from about 1% to about 50% or higher, preferably from about 2% to about 30%, more preferably still, from about 5% to about 20% by weight of the detergent composition.

Suitable levels of nonionic detersive surfactant herein are from about 1% to about 40%, preferably from about 2% to about 30%, more preferably from about 5% to about 20%.

Desirable weight ratios of anionic:nonionic surfactants in combination include from 1.0:9.0 to 1.0:0.25, preferably 1.0:1.5 to 1.0:0.4.

Desirable weight ratios of anionic:cationic surfactants in combination include from 50:1 to 5:1, more preferably 35:1 to 15:1.

Suitable levels of cationic detersive surfactant herein are from about 0.1% to about 20%, preferably from about 1% to about 15%, although much higher levels, e.g., up to about 30% or more, may be useful especially in nonionic:cationic (i.e., limited or anionic-free) formulations.

Amphoteric or zwitterionic detersive surfactants when present are usually useful at levels in the range from about 0.1% to about 20% by weight of the detergent composition. Often levels will be limited to about 5% or less, especially when the amnphoteric is costly. Surfactant The composition will preferably contain at least about 0.01%, more preferably at least about 0.1%, even more preferably still, at least about 0.2%, even more preferably still, at least about 0.5% by weight of said composition of surfactant. The composition will also preferably contain no more than about 90%, more preferably no more than about 70%, even more preferably, no more than about 60%, even more preferably, no more than about 35% by weight of said composition of surfactant.

The anionic surfactants useful in the present invention are preferably selected from the group consisting of, linear alkylbenzene sulfonate, alpha olefin sulfonate, paraffin sulfonates, alkyl ester sulfonates, alkyl sulfates, alkyl alkoxy sulfate, alkyl sulfonates, alkyl alkoxy carboxylate, alkyl alkoxylated sulfates, sarcosinates, taurinates, and mixtures thereof.

When present, anionic surfactant will be present typically in an effective amount. More preferably, the composition may contain at least about 0.5%, more preferably at least about 5%, even more preferably still, at least about 10% by weight of said composition of anionic surfactant. The composition will also preferably contain no more than about 90%, more preferably no more than about 50%, even more preferably, no more than about 30% by weight of said composition of anionic surfactant.

Alkyl sulfate surfactants are another type of anionic surfactant of importance for use herein. In addition to providing excellent overall cleaning ability when used in combination with polyhydroxy fatty acid amides (see below), including good grease/oil cleaning over a wide range of temperatures, wash concentrations, and wash times, dissolution of alkyl sulfates can be obtained, as well as improved formidability in liquid detergent formulations are water soluble salts or acids of the formula ROSO3M wherein R preferably is a C10–C24 hydrocarbyl, preferably an alkyl or hydroxyalkyl having a C10–$C_{20}$ alkyl component, more preferably a C12–C18 alkyl or hydroxyalkyl, and M is H or a cation, e.g., an alkali (Group IA) metal cation (e.g., sodium, potassium, lithium), substituted or unsubstituted ammonium cations such as methyl-, dimethyl-, and trimethyl ammonium and quaternary ammonium cations, e.g., tetramethyl-ammonium and dimethyl piperdinium, and cations derived from alkanolamines such as ethanolamine, diethanolamine, triethanolamine, and mixtures thereof, and the like. Typically, alkyl chains of C12–16 are preferred for lower wash temperatures (e.g., below about 50° C.) and C16–18 alkyl chains are preferred for higher wash temperatures (e.g., above about 50° C.).

Alkyl alkoxylated sulfate surfactants are another category of useful anionic surfactant. These surfactants are water soluble salts or acids typically of the formula RO(A) mSO3M wherein R is an unsubstituted C10–C24 alkyl or hydroxyalkyl group having a C10–C24 alkyl component, preferably a C12–C20 alkyl or hydroxyalkyl, more preferably C12–C18 alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines, e.g. monoethanolamine, diethanolamine, and triethanolamine, and mixtures thereof. Exemplary surfactants are C12–C18 alkyl polyethoxylate (1.0) sulfate, C12–C18 alkyl polyethoxylate (2.25) sulfate, C12–C18 alkyl polyethoxylate (3.0) sulfate, and C12–C18 alkyl polyethoxylate (4.0) sulfate wherein M is conveniently selected from sodium and potassium. Surfactants for use herein can be made from natural or synthetic alcohol feedstocks. Chain lengths represent average hydrocarbon distributions, including branching. The anionic surfactant component may comprise alkyl sulfates and alkyl ether sulfates derived from conventional alcohol sources, e.g., natural alcohols, synthetic alcohols such as those sold under the trade name of NEODOL™, ALFOL™, LIAL™, LUTENSOL™ and the like. Alkyl ether sulfates are also known as alkyl polyethoxylate sulfates.

Examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

One type of anionic surfactant which can be utilized encompasses alkyl ester sulfonates. These are desirable because they can be made with renewable, non-petroleum resources. Preparation of the alkyl ester sulfonate surfactant component can be effected according to known methods disclosed in the technical literature. For instance, linear esters of C8–C20 carboxylic acids can be sulfonated with gaseous SO3 according to "The Journal of the American Oil Chemists Society," 52 (1975), pp.323–329. Suitable starting materials would include natural fatty substances as derived from tallow, palm, and coconut oils, etc.

The preferred alkyl ester sulfonate surfactant, especially for laundry applications, comprises alkyl ester sulfonate surfactants of the structural formula:

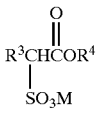

wherein R3 is a C8–C20 hydrocarbyl, preferably an alkyl, or combination thereof, R4 is a C1–C6 hydrocarbyl, preferably an alkyl, or combination thereof, and M is a soluble salt-forming cation. Suitable salts include metal salts such as sodium, potassium, and lithium salts, and substituted or unsubstituted ammonium salts, such as methyl-, dimethyl, -trimethyl, and quaternary ammonium cations, e.g. tetramethyl-ammonium and dimethyl piperdinium, and cations derived from alkanolamines, e.g. monoethanol-amine, diethanolamine, and triethanolamine. Preferably, R3 is C10–C16 alkyl, and R4 is methyl, ethyl or isopropyl. Especially preferred are the methyl ester sulfonates wherein R3 is C14–C16 alkyl.

Other anionic surfactants useful for detersive purposes can also be included in the compositions hereof. These can include salts (including, for example, sodium, potassium, ammoniun, and substituted ammonium salts such as mono-, di- and triethanolamine salts) of soap, C9–C20 linear alkylbenzenesulphonates, C8–C22 primary or secondary alkanesulphonates, C8–C24 olefinsulphonates, sulphonated polycarboxylic acids prepared by sulphonation of the pyrolyzed product of alkaline earth metal citrates, e.g., as described in British patent specification No. 1,082,179, alkyl glycerol sulfonates, fatty acyl glycerol sulfonates, fatty oleyl glycerol sulfates, alkyl phenol ethylene oxide ether sulfates, paraffin sulfonates, alkyl phosphates, isothionates such as the acyl isothionates, N-acyl taurates, fatty acid amides of methyl tauride, alkyl succinamates and sulfosuccinates, monoesters of sulfosuccinate (especially saturated and unsaturated C12–C18 monoesters) diesters of sulfosuccinate (especially saturated and unsaturated C6–C14 diesters), N-acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula RO(CH2CH2O)kCH2COO—M+ wherein R is a C8–C22 alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and I by Schwartz, Perry and Berch). A variety of such surfactants are also generally disclosed in U.S. Pat. No. 3,929,678, issued Dec. 30, 1975 to Laughihn, et al. at Column 23, line 58 through Column 29, line 23. Nonionic Detergent Surfactants—Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants include: alkyl ethoxylate, alkanoyl glucose amide, C12–C18 alkyl ethoxylates ("AE") including the so-called narrow peaked alkyl ethoxylates and C6–C12 alkyl phenol alkoxylates (especially ethoxylates and mixed ethoxy/propoxy), and mixtures thereof.

When present, nonionic surfactant will be present typically in an effective amount. More preferably, the composition may contain at least about 0.1%, more preferably at least about 0.2%, even more preferably still, at least about 0.5% by weight of said composition of nonionic surfactant. The composition will also preferably contain no more than about 20%, more preferably no more than about 15%, even more preferably, no more than about 10% by weight of said composition of nonionic surfactant.

The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal® CO-630, marketed by the GAF Corporation; and Triton® X-45, X-1 14, X-100, and X-102, all marketed by the Rohm & Haas Company. These compounds are commonly referred to as alkyl phenol alkoxylates, (e.g., alkyl phenol ethoxylates).

The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about IO to about 20 carbon atoms with from about 2 to about 18 moles of ethylene oxide per mole of alcohol. Examples of commercially available nonionic surfactants of this type include Tergitol® 15-S-9 (the condensation product of C11–C15 linear secondary alcohol with 9 moles ethylene oxide), Tergitol® 24-L-6 NMW (the condensation product of C12–C14 primary alcohol with 6 moles ethylene oxide with a narrow molecular weight distribution), both marketed by Union Carbide Corporation; Neodol®) 45-9 (the condensation product of C14–C15 linear alcohol with 9 moles of ethylene oxide), Neodol® 23-6.5 (the condensation product of C12–C13 linear alcohol with 6.5 moles of ethylene oxide), Neodol® 45-7 (the condensation product of C14–C15 linear alcohol with 7 moles of ethylene oxide), Neodol® 45–4 (the condensation product of C14–C15 linear alcohol with 4 moles of ethylene oxide), marketed by Shell Chemical Company, and Kyro® EOB (the condensation product of C13–C15 alcohol with 9 moles ethylene oxide), marketed by The Procter & Gamble Company. Other commercially available nonionic surfactants include Dobanol 91-8® marketed by Shell Chemical Co. and Genapol UD-080® marketed by Hoechst. This category of nonionic surfactant is referred to generally as "alkyl ethoxylates."

The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic® surfactants, marketed by BASF.

The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronicg compounds, marketed by BASF.

Examples of ethylene oxide-propylene oxide block co-polymers suitable for uses herein are described in greater detail in Pancheri/Mao; U.S. Pat. No. 5,167,872; Issued Dec. 2, 1992. This patent is incorporated herein by reference.

The preferred alkylpolyglycosides have the formula

R2O(CnH2nO)t(glycosyl)x wherein R2 is selected from the group consisting of alkyl, alkyl-phenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkylene-oxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyl, decyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexa-glucosides.

Another type of suitable nonionic surfactant comprises a mixture (herein after referred to as ethoxylated glycerol type compound) which is a mixture of a fully esterified ethoxylated polyhydric alcohol, a partially esterified ethoxylated polyhydric alcohol and a nonesterified ethoxylated polyhydric alcohol, wherein the preferred polyhydric alcohol is glycerol, and the compound is formula (I)

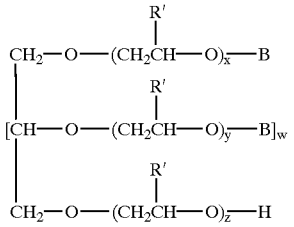

and

-continued formula (II)

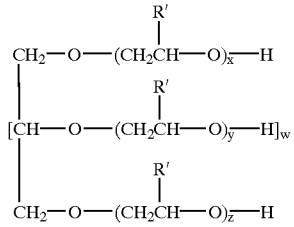

wherein w equals one to four, most preferably one. B is selected from the group consisting of hydrogen or a group represented by:

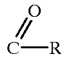

wherein R is selected from the group consisting of alkyl group having 6 to 22 carbon atoms, more preferably 11 to 15 carbon atoms and alkenyl groups having 6 to 22 carbon atoms, more preferably 11 to 15 carbon atoms, wherein a hydrogenated tallow alkyl chain or a coco alkyl chain is most preferred, wherein at least one of the B groups is represented by said

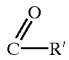

and R' is selected from the group consisting of hydrogen and methyl groups; x, y and z have a value between 0 and 60, more preferably 0 to 40, provided that (x+y+z) equals 2 to 100, preferably 4 to 24 and most preferably 4 to 19, wherein in Formula (I) the wt. ratio of monoester/diester/triester is 45 to 90/5 to 40/1 to 20, more preferably 50 to 90/9 to 32/1 to 12, wherein the wt. ratio of Formula (I) to Formula (II) is a value between 3 to 0.02, preferably 3 to 0.1, most preferably 1.5 to 0.2, wherein it is most preferred that there is more of Formula (II) than Formula (I) in the mixture that forms the compound.

The ethoxylated glycerol type compound which may be used in the in the instant composition are manufactured by the Kao Corporation and sold under the trade name Levenol such as Levenol F-200 which has an average EO of 6 and a molar ratio of coco fatty acid to glycerol of 0.55 or Levenol V501/2 which has an average EO of 17 and a molar ratio of tallow fatty acid to glycerol of 1.0. It is preferred that the molar ratio of the fatty acid to glycerol is less than 1.7, more preferably less than 1.5 and most preferably less than 1.0. The ethoxylated glycerol type compound has a molecular weight of 400 to 1600, and a pH (50 grams/liter of water) of 5–7. The Levenol compounds are substantially non irritant to human skin and have a primary biodegradabillity higher than 90% as measured by the Wickbold method Bias-7d. Two examples of the Levenol compounds are Levenol V-501/2 which has 17 ethoxylated groups and is derived from tallow fatty acid with a fatty acid to glycerol ratio of 1.0 and a molecular weight of 1465 and Levenol F-200 has 6 ethoxylated groups and is derived from coco fatty acid with a fatty acid to glycerol ratio of 0.55. Both Levenol F-200 and Levenol V-501/2 are composed of a mixture of Formula (I) and Formula (II). The Levenol compounds has ecoxicity values of algae growth inhibition >100 mg/liter; acute toxicity for Daphniae >100 mg/liter and acute fish toxicity >100 mg/liter. The Levenol compounds have a ready biodegradability higher than 60% which is the minimum required value according to OECD 301B measurement to be acceptably biodegradable. Polyesterified nonionic compounds also useful in the instant compositions are Crovol PK40 and Crovol PK-70 manufactured by Croda GMBH of the Netherlands. Crovol PK40 is a polyoxyethylene (12) Palm Kernel Glyceride which has 12 EO groups. Crovol PK-70 which is preferred is a polyoxyethylene (45) Palm Kernel Glyceride have 45 EO groups. More information on these nonionic surfactants can be found in U.S. Pat. No 5,719,114, Another type of suitable nonionic surfactant comprises the polyhydroxy fatty acid amides. These materials are more fully described in Pan/Gosselink; U.S Pat. No. 5,332,528; Issued Jul. 26, 1994, which is incorporated herein by reference. These polyhydroxy fatty acid amides have a general structure of the formula:

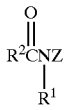

wherein: R1 is H, C1–C4 hydrocarbyl, 2-hydroxy ethyl, 2-hydroxy propyl, or a mixture thereof, preferably C1–C4 alkyl, more preferably C1 or C2 alkyl, most preferably C1 alkyl (i.e., methyl); and R2 is a C5–C31 hydrocarbyl, preferably straight chain C7–C19 alkyl or alkenyl, more preferably straight chain C9–C17 alkyl or alkenyl, most preferably straight chain C11–C15 alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of —CH2—(CHOH)n-CH2OH, —CH(CH2OH)—(CHOH)n-1—CH2OH, —CH2—(CHOH)2(CHOR')(CHOH)—CH2OH, and alkoxylated derivatives thereof, where n is an integer from 3 to 5, inclusive, and R' is H or a cyclic or aliphatic monosaccharide. Most preferred are glycityls wherein n is 4, particularly —CH2—(CHOH)4—CH2OH.

R' can be, for example, N-methyl, N-ethyl, N-propyl, N-isopropyl, N-butyl, N-2-hydroxy ethyl, or N-2-hydroxy propyl.

R2-CO—N<can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, I-deoxymaltotriotityl, etc.

Methods for making polyhydroxy fatty acid amides are knnown in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

Examples of such surfactants include the C10–C18 N-methyl, or N-hydroxypropyl, glucamides. The N-propyl through N-hexyl C12–C16 glucamides can be used for lower sudsing performance.

Preferred amides are C8–C20 ammonia amides, monoethanolamides, diethanolamides, and isopropanolamides.

Another suitable class of surfactants are the alkanol amide surfactants, including the ammonia, monoethanol, and diethanol amides of fatty acids having an acyl moiety containing from about 8 to about 18 carbon atoms. These materials are represented by the formula:

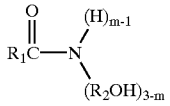

wherein R1 is a saturated or unsaturated, hydroxy-free aliphatic hydrocarbon group having from about 7 to 21, preferably from about 11 to 17 carbon atoms; R2 represents a methylene or ethylene group; and m is 1, 2, or 3, preferably 1. Specific examples of such amides are monoethanol amine coconut fatty acid amide and diethanolamine dodecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanolamides and diethanolamides of C12–14 fatty acids are preferred.

Amphoteric Surfactants—Amphoteric surfactants may optionally be incorporated into the detergent compositions hereof. These surfactants can be broadly described as aliphatic derivatives of secondary or tertiary amines, or aliphatic derivatives of heterocyclic secondary and tertiary amines in which the aliphatic radical can be straight chain or branched. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18–35 for examples of ampholytic surfactants. Preferred amphoteric include C12–C18 betaines and sulfobetaines ("sultaines"), C10–C1 8 amine oxides, and mixtures thereof.

When present, amphoteric surfactant will be present typically in an effective amount. More preferably, the composition may contain at least about 0.1%, more preferably at least about 0.2%, even more preferably still, at least about 0.5% by weight of said composition of amphoteric surfactant. The composition will also preferably contain no more than about 20%, more preferably no more than about 15%, even more preferably, no more than about 10% by weight of said composition of amphoteric surfactant.

Amine oxides are amphoteric surfactants and include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Preferred amine oxide surfactants have the formula

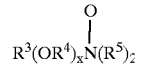

wherein R3 is an alkyl, hydroxyalkyl, or alkyl phenyl group or mixtures thereof containing from about 8 to about 22 carbon atoms; R4 is an alkylene or hydroxyalkylene group containing from about 2 to about 3 carbon atoms or mixtures thereof; x is from 0 to about 3; and each R5 is an alkyl or hydroxyalkyl group containing from about 1 to about 3 carbon atoms or a polyethylene oxide group containing from about 1 to about 3 ethylene oxide groups. The R5 groups can be attached to each other, e.g., through an oxygen or nitrogen atom, to form a ring structure.

These amine oxide surfactants in particular include C10–C18 alkyl dimethyl amine oxides and C8–C12 alkoxy ethyl dihydroxy ethyl amine oxides.

When present, amine oxide surfactant will be present typically in an effective amount. More preferably, the composition may contain at least about 0.1%, more preferably at least about 0.2%, even more preferably still, at least about 0.5% by weight of said composition of amine oxide surfactant. The composition will also preferably contain no more than about 20%, more preferably no more than about 15%, even more preferably, no more than about 10% by weight of said composition of amine oxide surfactant.

Examples of suitable amine oxide surfactants are given in "Surface Active Agents and Detergents" (Vol. I and II by Schwartz, Perry and Berch).

Suitable betaine surfactants include those of the general formula:

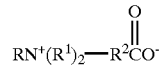

wherein R is a hydrophobic group selected from alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amino or ether linkages; each R1 is an alkyl group containing from 1 to about 3 carbon atoms; and R2 is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate. Other suitable amidoalkylbetaines are disclosed in U.S. Pat. Nos. 3,950,417; 4,137,191; and 4,375,421; and British Patent GB No. 2,103,236, all of which are incorporated herein by reference.

Zwitterionic Surfactants—Zwitterionic surfactants can also be incorporated into the detergent compositions hereof. These surfactants can be broadly described as derivatives of secondary and tertiary amines, derivatives of heterocyclic secondary and tertiary amines, or derivatives of quatemary ammonium, quaternary phosphonium or tertiary sulfonium compounds. See U.S. Pat. No. 3,929,678 to Laughlin et al., issued Dec. 30, 1975 at column 19, line 38 through column 22, line 48 for examples of zwitterionic surfactants. Ampholytic and zwitterionic surfactants are generally used in combination with one or more anionic and/or nonionic surfactants.

Detersive Enzymes—Enzymes are preferably included in the present detergent compositions for a variety of purposes, including removal of protein-based, carbohydrate-based, or triglyceride-based stains from substrates. Recent enzyme disclosures in detergents useful herein include chondriotinase (EP 747,469 A); protease variants (WO 96/28566 A; WO 96/28557 A; WO 96/28556 A; WO 96/25489 A); xylanase (EP 709,452 A); keratinase (EP 747,470 A); lipase (GB 2,297,979 A; WO 96/16153 A; WO 96/12004 A; EP 698,659 A; WO 96/16154 A); cellulase (GB 2,294,269 A; WO 96/27649 A; GB 2,303,147 A); thermitase (WO 96/28558 A). More generally, suitable enzymes include cellulases, hemicellulases, proteases, gluco-amylases, amylases, lipases, cutinases, pectinases, xylanases, keratinases, reductases, oxidases, phenoloxidases, lipoxygenases, ligninases, pullulanases, tannases, chondriotinases, thermitases, pentosanases, malanases, β-glucanases, arabinosidases or mixtures thereof of any suitable origin, such as vegetable, animal, bacterial, fuingal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. A preferred combination is a detergent composition having a cocktail of conventional applicable enzymes like protease, amylase, lipase, cutinase and/or cellulase. Suitable enzymes are also described in U.S. Pat. Nos. 5,677,272, 5,679,630, 5,703,027, 5,703,034, 5,705,464, 5,707,950, 5,707,951, 5,710,115, 5,710,116, 5,710,118, 5,710,119 and 5,721,202.

The composition will preferably contain at least about 0.0001%, more preferably at least about 0.0005%, even more preferably still, at least about 0.001% by weight of the composition of enzyme. The cleaning composition will also preferably contain no more than about 5%, more preferably no more than about 2%, even more preferably, no more than about 1% by weight of the composition of enzyme.

"Detersive enzyme", as used herein, means any enzyme having a cleaning, stain removing or otherwise beneficial effect in cleaning compositions. Preferred detersive enzymes are hydrolases such as proteases, amylases and lipases. Highly preferred are amylases and/or proteases, including both current commercially available types and improved types.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics, dishware and the like. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition. For certain detergents it may be desirable to increase the active enzyme content of the commercial preparation in order to minimize the total amount of non-catalytically active materials and thereby improve spotting/filming or other end-results. Higher active levels may also be desirable in highly concentrated detergent formulations.

Proteolvtic Enzyme—The proteolytic enzyme can be of animal, vegetable or microorganism (preferred) origin. The proteases for use in the detergent compositions herein include (but are not limited to) trypsin, subtilisin, chymotrypsin and elastase-type proteases. Preferred for use herein are subtilisin-type proteolytic enzymes. Particularly preferred is bacterial serine proteolytic enzyme obtained from *Bacillus subtilis* and/or *Bacillus licheniformis*.

Suitable proteolytic enzymes include Novo Industri A/S Alcalase® (preferred), Esperase®, Savinase® (Copenhagen, Denmark), Gist-brocades' Maxatase®, Maxacal® and Maxapem 15® (protein engineered Maxacal®). (Delft, Netherlands), and subtilisin BPN and BPN' (preferred), which are commercially available. Preferred proteolytic enzymes are also modified bacterial serine proteases, such as those made by Genencor International, Inc. (San Francisco, Calif.) which are described in European Patent 251,446B, granted Dec. 28, 1994 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International) which is called "Protease A" herein (same as BPN'). In particular see columns 2 and 3 of U.S. Pat. No. 5,030,378 for a complete description, including amino sequence, of Protease A and its variants. Other proteases are sold under the tradenames: Primase, Durazym, Opticlean and Optimase. Preferred proteolytic enzymes, then, are selected from the group consisting of Alcalase® (Novo Industri A/S), BPN', Protease A and Protease B (Genencor), and mixtures thereof. Protease B is most preferred.

Of particular interest for use herein are the proteases described in U.S. Pat. No. 5,470,733.

Also proteases described in our co-pending application U.S. Ser. No. 08/136,797 can be included in the detergent composition of the invention.

Another preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of Bacillus amyloliquefaciens subtilisin, as described in WO 95/10615 published Apr. 20, 1995 by Genencor International (A. Baeck et al. entitled "Protease-Containing Cleaning Compositions" having U.S. Ser. No. 08/322,676, filed Oct. 13, 1994).

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9,1995 by The Procter & Gamble Company.

Protease enzyme may be incorporated into the compositions in accordance with the invention at a level of from 0.0001% to 2% active enzyme by weight of the composition.

The composition will preferably contain at least about 0.0001%, more preferably at least about 0.0002%, more preferably at least about 0.0005%, even more preferably still, at least about 0.001% of active enzyme by weight of the composition of protease enzyme. The composition will also preferably contain no more than about 2%, more preferably no more than about 0.5%, more preferably no more than about 0.1%, even more preferably, no more than about 0.05% of active enzyme by weight of the composition of protease enzyme.

Amylase—Amylases (α and/or β) can be included for removal of carbohydrate-based stains. Suitable amylases are Termamyl® (Novo Nordisk), Fungamyl® and BAN® Novo Nordisk). The enzymes may be of any suitable origin, such as vegetable, animal, bacterial, fungal and yeast origin.

The composition will preferably contain at least about 0.0001%, more preferably at least about 0.0002%, more preferably at least about 0.0005%, even more preferably still, at least about 0.001% of active enzyme by weight of the composition of amylase enzyme. The composition will also preferably contain no more than about 2%, more preferably no more than about 0.5%, more preferably no more than about 0.1%, even more preferably, no more than about 0.05% of active enzyme by weight of the composition of amylase enzyme.

Amylase enzymes also include those described in WO95/26397 and in co-pending application by Novo Nordisk PCT/DK96/00056. Other specific amylase enzymes for use in the detergent compositions of the present invention therefore include:

(a) α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Such Phadebas® α-amylase activity assay is described at pages 9–10, WO95/26397.

(b) α-amylases according (a) comprising the amino sequence shown in the SEQ ID listings in the above cited reference. or an α-armylase being at least 80% homologous with the amino acid sequence shown in the SEQ ID listing.

(c) α-amylases according (a) obtained from an alkalophilic Bacillus species, comprising the following amino sequence in the N-terminal: His-His-Asn-Gly-Thr-Asn-Gly-Thr-Met-Met-Gln-Tyr-Phe-Glu-Trp-Tyr-Leu-Pro-Asn-Asp.

A polypeptide is considered to be X% homologous to the parent amylase if a comparison of the respective amino acid sequences, performed via algorithms, such as the one described by Lipman and Pearson in Science 227, 1985, p. 1435, reveals an identity of X%.

(d) α-amylases according (a–c) wherein the α-amylase is obtainable from an alkalophilic Bacillus species; and in particular, from any of the strains NCIB 12289, NCIB 12512, NCIB 12513 and DSM 935.

In the context of the present invention, the term "obtainable from" is intended not only to indicate an amylase produced by a Bacillus strain but also an amylase encoded by a DNA sequence isolated from such a Bacillus strain and produced in an host organism transformed with said DNA sequence.

(e)α-amylase showing positive immunological cross-reactivity with antibodies raised against an α-amylase having an amino acid sequence corresponding respectively to those α-amylases in (a–d).

(f) Variants of the following parent α-amylases which (i) have one of the amino acid sequences shown in corresponding respectively to those α-amylases in (a–e), or (ii) displays at least 80% homology with one or more of said amino acid sequences, and/or displays inmmunological cross-reactivity with an antibody raised against an α-amylase having one of said amino acid sequences, and/or is encoded by a DNA sequence which hybridizes with the same probe as a DNA sequence encoding an α-amylase having one of said amino acid sequence; in which variants:

1. at least one amino acid residue of said parent α-amylase has been deleted; and/or
2. at least one amino acid residue of said parent α-amylase has been replaced by a different amino acid residue; and/or
3. at least one amino acid residue has been inserted relative to said parent α-amylase; said variant having an α-amylase activity and exhibiting at least one of the following properties relative to said parent α-amylase: increased thermostability, increased stability towards oxidation, reduced Ca ion dependency, increased stability and/or α-amylolytic activity at neutral to relatively high pH values, increased α-amylolytic activity at relatively high temperature and increase or decrease of the isoelectric point (pI) so as to better match the pI value for α-amylase variant to the pH of the medium.

Said variants are described in the patent application PCT/DK96/00056.

Other amylases suitable herein include, for example, α-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, June 1985, pp. 6518–6521. Certain preferred embodiments of the present compositions can make use of amylases having improved stability in detergents such as automatic dishwashing types, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the conmmonality of being derived using site-directed mutagenesis from one or more of the Bacillus amylases, especially the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. licheniformis* alpha-amylase, known as TERMAMYL®, or the homologous position variation of a similar parent amylase, such as *B. amyloliquefaciens, B. subtilis,* or *B. stearothermophilus;* (b) stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Cellulases usable herein include both bacterial and fungal types, preferably having a pH optimum between 5 and 9.5. U.S. Pat. No. 4,435,307, Barbesgoard et al, Mar. 6, 1984, discloses suitable fungal cellulases from Humicola insolens or Humicola strain DSM 1800 or a cellulase 212-producing fungus belonging to the genus Aeromonas, and cellulase extracted from the hepatopancreas of a marine mollusk, Dolabella Auricula Solander. Suitable cellulases are also disclosed in GB-A-2.075.028; GB-A-2.095.275 and DE-OS-2.247.832. CAREZYME® and CELLUZYME® (Novo) are especially useful. See also WO 9117243 to Novo.

The composition will preferably contain at least about 0.0001%, more preferably at least about 0.0002%, more preferably at least about 0.0005%, even more preferably still, at least about 0.001% of active enzyme by weight of the composition of cellulases and/or peroxidases enzyme. The composition will also preferably contain no more than about 2%, more preferably no more than about 0.5%, more preferably no more than about 0.1%, even more preferably, no more than about 0.05% of active enzyme by weight of the composition of cellulases and/or peroxidases enzyme.

Also suitable are cutinases [EC 3.1.1.50] which can be considered as a special kind of lipase, namely lipases which do not require interfacial activation. Addition of cutinases to detergent compositions have been described in e.g. WO-A-88/09367 (Genencor).

Lipase—Suitable lipase enzymes include those produced by microorganisms of the Pseudomonas group, such as Pseudomonas stutzeri ATCC 19.154, as disclosed in British Patent 1,372,034. Suitable lipases include those which show a positive immunological cross-reaction with the antibody of the lipase, produced by the microorganism Pseudomonas fluorescens IAM 1057. This lipase is available from Amano Pharmaceutical Co. Ltd., Nagoya, Japan, under the trade name Lipase P "Amano," hereinafter referred to as "Amano-P". Further suitable lipases are lipases such as M1 Lipase® and Lipomax® (Gist-Brocades). Other suitable commercial lipases include Amano-CES, lipases ex Chromobacter viscosum, e.g. Chromobacter viscosum var. lipolyticum NRRLB 3673 from Toyo Jozo Co., Tagata, Japan; Chromobacter viscosum lipases from U.S. Biochemical Corp., U.S.A. and Disoynth Co., The Netherlands, and lipases ex Pseudomonas gladioli. LIPOLASE® enzyme derived from Humicola lanuginosa and commercially available from Novo, see also EP 341,947, is a preferred lipase for use herein. Lipase and amylase variants stabilized against peroxidase enzymes are described in WO 9414951 A to Novo. See also WO 9205249 and RD 94359044.

Highly preferred lipases are the D96L lipolytic enzyme variant of the native lipase derived from Humicola lanuginosa as described in U.S. Ser. No. 08/341,826. (See also patent application WO 92/05249 viz. wherein the native lipase ex Humicola lanuginosa aspartic acid (D) residue at position 96 is changed to Leucine (L). According to this nomenclature said substitution of aspartic acid to Leucine in position 96 is shown as D96L.) Preferably the Humicola lanuginosa strain DSM 4106 is used.

In spite of the large number of publications on lipase enzymes, only the lipase derived from Humicola lanuginosa and produced in Aspergillus oryzae as host has so far found widespread application as additive for washing products. It is available from Novo Nordisk under the tradename Lipolase® and Lipolase Ultra®, as noted above. In order to optimize the stain removal performance of Lipolase, Novo Nordisk have made a number of variants. As described in WO 92/05249, the D96L variant of the native Humicola lanuginosa lipase improves the lard stain removal efficiency by a factor 4.4 over the wild-type lipase (enzymes compared in an amount ranging from 0.075 to 2.5 mg protein per liter). Research Disclosure No. 35944 published on Mar. 10, 1994, by Novo Nordisk discloses that the lipase variant (D96L) may be added in an amount corresponding to 0.001–100-mg (5–500,000 LU/liter) lipase variant per liter of wash liquor.

The composition will preferably contain at least about 0.0001%, more preferably at least about 0.0002%, more preferably at least about 0.0005%, even more preferably still, at least about 0.001% of active enzyme by weight of the composition of lipase enzyme. The composition will also preferably contain no more than about 2%, more preferably no more than about 0.5%, more preferably no more than about 0.1%, even more preferably, no more than about 0.05% of active enzyme by weight of the composition of lipase enzyme.

Various carbohydrase enzymes which impart antimicrobial activity may also be included in the present invention. Such enzymes include endoglycosidase, Type II endoglycosidase and glucosidase as disclosed in U.S. Pat. Nos. 5,041,236, 5,395,541, 5,238,843 and 5,356,803 the disclosures of which are herein incorporated by reference. Of course, other enzymes having antimicrobial activity may be employed as well including peroxidases, oxidases and various other enzymes.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilized by various techniques. Enzyme stabilization techniques are disclosed and exemplified in U.S. Pat. No. 3,600,319, Aug. 17, 1971, Gedge et al, EP 199,405 and EP 200,586, Oct. 29, 1986, Venegas. Enzyme stabilization systems are also described, for example, in U.S. Pat. No. 3,519,570. A useful Bacillus, sp. AC13 giving proteases, xylanases and cellulases, is described in WO 9401532 A to Novo.

It is also possible to include an enzyme stabilization system into the compositions of the present invention when any enzyme is present in the composition.

Enzymne Stabilizing System—The preferred compositions herein may additionally comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the protease or other enzymes used in the compositions herein. Such stabilizing systems can comprise calcium ion, boric acid, propylene glycol, short chain carboxylic acid, boronic acid, polyhydroxyl compounds and mixtures thereof such as are described in U.S. Pat. No. 4,261,868, Hora et al, issued Apr. 14, 1981; U.S. Pat. No. 4,404,115, Tai, issued Sep. 13, 1983; U.S. Pat. No. 4,318,818, Letton et al; 4,243,543, Guildert et al issued Jan. 6, 1981; U.S. Pat. No. 4,462,922, Boskamp, issued Jul. 31, 1984; U.S. Pat. No. 4,532,064, Boskamp, issued Jul. 30, 1985; and U.S. Pat. No. 4,537,707, Severson Jr., issued Aug. 27, 1985, all of which are incorporated herein by reference.

The composition will preferably contain at least about 0.001%, more preferably at least about 0.005%, even more preferably still, at least about 0.01% by weight of the composition of enzyme stabilizing system. The composition will also preferably contain no more than about 10%, more preferably no more than about 8%, no more than about 6% of active enzyme by weight of the composition of enzyme stabilizing system.

One stabilizing approach is the use of water-soluble sources of calcium and/or magnesium ions in the finished compositions which provide such ions to the enzymes. Calcium ions are generally more effective than magnesium ions and are preferred herein if only one type of cation is being used. Typical detergent compositions, especially liquids, will comprise from about 1 to about 30, preferably from about 2 to about 20, more preferably from about 8 to about 12 millimoles of calcium ion per liter of finished detergent composition, though variation is possible depending on factors including the multiplicity, type and levels of enzymes incorporated. Preferably water-soluble calcium or magnesium salts are employed, including for example calcium chloride, calcium hydroxide, calcium formate, calcium malate, calcium maleate, calcium hydroxide and calcium acetate; more generally, calcium sulfate or magnesium salts corresponding to the exemplified calcium salts may be used. Further increased levels of Calcium and/or Magnesium may of course be useful, for example for promoting the grease-cutting action of certain types of surfactant. However, it is especially preferred that the composition contain no added calcium ions, and even more preferred that the composition be free of calcium ions.

Another stabilizing approach is by use of borate species. See Severson, U.S. Pat. No. 4,537,706. Borate stabilizers, when used, may be at levels of up to 10% or more of the composition though more typically, levels of up to about 3% by weight of boric acid or other borate compounds such as borax or orthoborate are suitable for liquid detergent use. Substituted boric acids such as phenylboronic acid, butaneboronic acid, p-bromophenylboronic acid or the like can be used in place of boric acid and reduced levels of total boron in detergent compositions may be possible though the use of such substituted boron derivatives.

Additionally, from 0% to about 10%, preferably from about 0.01% to about 6% by weight, of chlorine bleach or oxygen bleach scavengers can be added to compositions of the present invention to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are salts containing ammonium cations. These can be selected from the group consisting of reducing materials like sulfite, bisulfite, thiosulfite, thiosulfate, iodide, etc., antioxidants like carbonate, ascorbate, etc., organic amines such as ethylenediaminetetracetic acid (EDTA) or alkali metal salt thereof and monoethanolamine (MEA), and mixtures thereof. Other conventional scavenging anions like sulfate, bisulfate, carbonate, bicarbonate, percarbonate, nitrate, chloride, borate, sodium perborate tetrahydrate, sodiun perborate monohydrate, percarbonate, phosphate, condensed phosphate, acetate, benzoate, citrate, formate, lactate, malate, tartrate, salicylate, etc. and mixtures thereof can also be used.

Builders—Detergent builders are optionally included in the compositions herein. In solid formulations, builders sometimes serve as absorbents for surfactants. Alternately, certain compositions can be formulated with completely water-soluble builders, whether organic or inorganic, depending on the intended use.

Suitable silicate builders include water-soluble and hydrous solid types and including those having chain-, layer-, or three-dimensional-structure as well as amorphous-solid silicates or other types, for: example especially adapted for use in non-structured-liquid detergents. Preferred are alkali metal silicates, particularly those liquids and solids having a $SiO_2$:$Na_2O$ ratio in the range 1.6:1 to 3.2:1, including solid hydrous 2-ratio silicates marketed by PQ Corp. under the tradename BRITESIL®, e.g., BRITESIL H2O; and layered silicates, e.g., those described in U.S. Pat. No. 4,664,839, May 12, 1987, H. P. Rieck. NaSKS-6, sometimes abbreviated "SKS-6", is a crystalline layered aluminum-free $\delta$-$Na_2SiO_5$ morphology silicate marketed by Hoechst and is preferred especially in granular compositions. See preparative methods in German DE-A-3,417,649 and DE-A-3,742,043. Other layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0, can also or alternately be used herein. Layered silicates from Hoechst also include NaSKS-5, NaSKS-7 and NaSKS-11, as the $\alpha$, $\beta$ and $\gamma$ layer-silicate forms. Other silicates may also be useful, such as magnesium silicate, which can serve as a crispening agent in granules, and as a component of suds control systems.

Also suitable for use herein are synthesized crystalline ion exchange materials or hydrates thereof having chain structure and a composition represented by the following general formula in an anhydride form: $xM_2O.ySiO_2.zM'O$ wherein M is Na and/or K, M' is Ca and/or Mg; y/x is 0.5 to 2.0 and z/x is 0.005 to 1.0 as taught in U.S. Pat. No. 5,427,711, Sakaguchi et al, Jun. 27, 1995.

Aluminosilicate builders, such as zeolites, are especially usefuil in granular detergents, but can also be incorporated in liquids, pastes or gels. Suitable for the present purposes are those having empirical formula: $[M_z(AlO_2)_z(SiO_2)_v].xH_2O$ wherein z and v are integers of at least 6, M is an alkali metal, preferably Na and/or K, the molar ratio of z to v is in the range from 1.0 to 0.5, and x is an integer from 15 to 264. Aluminosilicates can be crystalline or amorphous, naturally-occurring or synthetically derived. An aluminosilicate production method is in U.S. Pat. No. 3,985,669, Krummel, et al, Oct. 12, 1976. Preferred synthetic crystalline aluminosilicate ion exchange materials are available as Zeolite A, Zeolite P (B), Zeolite X and, to whatever extent this differs from Zeolite P, the so-called Zeolite MAP. Natural types, including clinoptilolite, may be used. Zeolite A has the formula: $Na_{12}[(AlO_2)_{12}(SiO_2)_{12}].xH_2O$ wherein x is from 20 to 30, especially 27. Dehydrated zeolites (x=0–10) may also be used. Preferably, the aluminosilicate has a particle size of 0.1–10 microns in diameter.

Detergent builders in place of or in addition to the silicates and aluminosilicates described hereinbefore can optionally be included in the compositions herein, for example to assist in controlling mineral, especially Ca and/or Mg, hardness in wash water or to assist in the removal of particulate soils from surfaces. Builders can operate via a variety of mechanisms including forming soluble or insoluble complexes with hardness ions, by ion exchange, and by offering a surface more favorable to the precipitation of hardness ions than are the surfaces of articles to be cleaned. Builder level can vary widely depending upon end use and physical form of the composition. Built detergents typically comprise at least about 1% builder. Liquid formulations typically comprise about 5% to about 50%, more typically 5% to 35% of builder. Granular formulations typically comprise from about 10% to about 80%, more typically 15% to 50% builder by weight of the detergent composition. Lower or higher levels of builders are not excluded. For example, certain formulations can be unbuilt, that is the compositions contain no builder such as in some hand dishwashing compositions.

Suitable builders herein can be selected from the group consisting of phosphates and polyphosphates, especially the sodium salts; carbonates, bicarbonates, sesquicarbonates and carbonate minerals other than sodium carbonate or sesquicarbonate; organic mono-, di-, tri-, and tetracarboxylates especially water-soluble nonsurfactant carboxylates in acid, sodium, potassium or alkanolammonium salt form, as well as oligomeric or water-soluble low molecular weight polymer carboxylates including aliphatic and aromatic types; and phytic acid. These may be complemented by borates, e.g., for pH-buffering purposes, or by sulfates, especially sodium sulfate and any other fillers or carriers which may be important to the engineering of stable surfactant and/or builder-containing detergent compositions.

Builder mixtures, sometimes termed "builder systems" can be used and typically comprise two or more conventional builders, optionally complemented by chelants, pH-buffers or fillers, though these latter materials are generally accounted for separately when describing quantities of materials herein. In terms of relative quantities of surfactant and builder in the present detergents, preferred builder systems are typically formulated at a weight ratio of surfactant to builder of from about 60:1 to about 1:80. Certain preferred laundry detergents have said ratio in the range 0.90:1.0 to 4.0: 1.0, more preferably from 0.95:1.0 to 3.0:1.0.

P-containing detergent builders often preferred where permitted by legislation include, but are not limited to, the alkali metal, ammonium and alkanolammonium salts of polyphosphates exemplified by the tripolyphosphates, pyrophosphates, glassy polymeric meta-phosphates; and phosphonates.

Suitable carbonate builders include alkaline earth and alkali metal carbonates as disclosed in German Patent Application No. 2,321,001 published on Nov. 15, 1973, although sodium bicarbonate, sodium carbonate, sodium sesquicarbonate, and other carbonate minerals such as trona or any convenient multiple salts of sodium carbonate and calcium carbonate such as those having the composition $2Na_2CO_3.CaCO_3$ when anhydrous, and even calcium carbonates including calcite, aragonite and vaterite, especially forms having high surface areas relative to compact calcite may be useful, for example as seeds.

Suitable "organic detergent builders", as described herein for use in the cleaning compositions include polycarboxylate compounds, including water-soluble nonsurfactant dicarboxylates and tricarboxylates. More typically builder polycarboxylates have a plurality of carboxylate groups, preferably at least 3 carboxylates. Carboxylate builders can be formnulated in acid, partially neutral, neutral or overbaked form. When in salt form, alkali metals, such as sodium, potassium, and lithium, or alkanolammonium salts are preferred. Polycarboxylate builders include the ether polycarboxylates, such as oxydisuccinate, see Berg, U.S. Pat. No. 3,128,287, Apr. 7, 1964, and Lamberti et al, U.S. Pat. No. 3,635,830, Jan. 18, 1972; "TMS/TDS" builders of U.S. Pat. No. 4,663,071, Bush et al, May 5, 1987; and other ether carboxylates including cyclic and alicyclic compounds, such as those described in U.S. Pat. Nos. 3,923,679; 3,835,163; 4,158,635; 4,120,874 and 4,102,903.

Other suitable organic detergent builders are the ether hydroxypolycarboxylates, copolymers of maleic anhydride with ethylene or vinyl methyl ether; 1,3,5-trihydroxy benzene-2,4,6-trisulphonic acid; carboxymethyloxysuccinic acid; the various alkali metal, ammonium and substituted ammonium salts of polyacetic acids such as ethylenediamine tetraacetic acid and nitrilotriacetic acid; as well as mellitic acid, succinic acid, polymaleic acid, benzene 1,3,5-tricarboxylic acid, carboxymethyloxysuccinic acid, and soluble salts thereof.

Citrates, e.g., citric acid and soluble salts thereof are important carboxylate builders e.g., for light duty liquid detergents, due to availability from renewable resources and biodegradability. Citrates can also be used in granular compositions, especially in combination with zeolite and/or layered silicates. Oxydisuccinates are also especially useful in such compositions and combinations.

Where permitted, and especially in the formulation of bars, alkali metal phosphates such as sodium tripolyphosphates, sodium pyrophosphate and sodium orthophosphate can be used. Phosphonate builders such as ethane-1-hydroxy-1,1-diphosphonate and other known phosphonates, e.g., those of U.S. Pat. Nos. 3,159,581; 3,213,030; 3,422,021; 3,400,148 and 3,422,137 can also be used and may have desirable antiscaling properties.

Certain detersive surfactants or their short-chain homologues also have a builder action. For unambiguous formula accounting purposes, when they have surfactant capability, these materials are summed up as detersive surfactants. Preferred types for builder functionality are illustrated by: 3,3-dicarboxy-4-oxa-1,6-hexanedioates and the related compounds disclosed in U.S. Pat. No. 4,566,984, Bush, Jan. 28, 1986. Succinic acid builders include the $C_5$–$C_{20}$ alkyl and alkenyl succinic acids and salts thereof. Succinate builders also include: laurylsuccinate, myristylsuccinate, palmitylsuccinate, 2-dodecenylsuccinate (preferred), 2-pentadecenylsuccinate, and the like. Lauryl-succinates are described in European Patent Application 86200690.5/0, 200,263, published Nov. 5, 1986. Fatty acids, e.g., $C_{12}$–$C_{18}$ monocarboxylic acids, can also be incorporated into the compositions as surfactant/builder materials alone or in combination with the aforementioned builders, especially citrate and/or the succinate builders, to provide additional builder activity. Other suitable polycarboxylates are disclosed in U.S. Pat. No. 4,144,226, Crutchfield et al, Mar. 13, 1979 and in U.S. Pat. No. 3,308,067, Diehl, Mar. 7, 1967. See also Diehl, U.S. Pat. No. 3,723,322.

Other types of inorganic builder materials which can be used have the formula $(M_x)_iCa_y(CO_3)_z$ wherein x and i are integers from 1 to 15, y is an integer from 1 to 10, z is an integer from 2 to 25, $M_i$ are cations, at least one of which is a water-soluble, and the equation $\Sigma_i=_{1-15}(x_i$ multiplied by the valence of $M_i)+2y=2z$ is satisfied such that the formula has a neutral or "balanced" charge. These builders are referred to herein as "Mineral Builders", examples of these builders, their use and preparation can be found in U.S. Pat. No. 5,707,959. Another suitable class of inorganic builders are the Magnesiosilicates, see WO97/0179.

Suitable polycarboxylates builders for use herein include maleic acid, citric acid, preferably in the form of a water-soluble salt, derivatives of succinic acid of the formula R—CH(COOH)CH2(COOH) wherein R is C10–20 alkyl or alkenyl, preferably C12–16, or wherein R can be substituted with hydroxyl, sulfo sulfoxyl or sulfone substituents. Mixtures of these suitable polycarboxylates builders is also envisioned, such as a mixture of maleic acid and citric acid. Specific, examples include lauryl succinate, myristyl succinate, palnityl succinate. 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated C10–18 fatty acids, as well as the corresponding soaps. Preferred saturated species have from 12 to 16 carbon atoms in the alkyl chain. The preferred unsaturated fatty acid is oleic acid. Other preferred builder system for liquid compositions is based on dodecenyl succinic acid and citric acid.

The composition will preferably contain at least about 0.2%, more preferably at least about 0.5%, more preferably at least about 3%, even more preferably still, at least about 5% by weight of the composition of builder. The cleaning composition will also preferably contain no more than about 50%, more preferably no more than about 40%, more preferably no more than about 30%, even more preferably, no more than about 25% by weight of the composition of builder.

Divalent Ions—The presence of magnesium (divalent) ions improves the cleaning of greasy soils for various compositions, i.e., compositions containing alkyl ethoxy sulfates and/or polyhydroxy fatty acid amides. This is especially true when the compositions are used in softened water that contains few divalent ions. It is believed, while not wanting to be limited by theory, that, magnesium ions increase the packing of the surfactants at the oil/water interface, thereby reducing interfacial tension and improving grease cleaning. Compositions of the invention herein containing magnesium ions exhibit good grease removal, manifest mildness to the skin, and provide good storage stability.

It has been surprisingly found that the combination of the modified alkyl benezene sulfoante surfactants of the present invention with magnesium ions, provides the same cleaning benefits as a LAS/Mg cleaning system does but with the additional addvantage that the former system dissolves faster when added to water.

The composition will preferably contain at least about 0.01%, more preferably at least about 0.015%, more preferably at least about 0.02%, even more preferably still, at least about 0.025% by weight of said composition of divalent ions,. The cleaning composition will also preferably contain no more than about 5%, more preferably no more than about 2.5%, more preferably no more than about 1%, even more preferably, no more than about 0.05% by weight of said composition of divalent ions Preferably, the divalent ions, ions are added as a hydroxide, chloride, acetate, formate, oxide or nitrate salt to the compositions of the present invention. It is prefered that when the compositions of the present invention include diavlaent ions, that the divalent ions be magnesium ions.

Formulating such divalent ion-containing compositions in alkaline pH matrices may be difficult due to the incompatibility of the divalent ions, particularly magnesium, with hydroxide ions. When both divalent ions and alkaline pH are combined with the surfactant mixture of this invention, grease cleaning is achieved that is superior to that obtained by either alkaline pH or divalent ions alone. Yet, during storage, the stability of these compositions becomes poor due to the formation of hydroxide precipitates. Therefore, chelating agents discussed hereinafter may also be necessary.

Diamines—It is preferred that the diamines used in the present invention are substantially free from impurities. That is, by "substantially free" it is meant that the diamines are over 95% pure, i.e., preferably 97%, more preferably 99%, still more preferably 99.5%, free of impurities. Examples of impurities which may be present in commercially supplied diamines include 2-Methyl-1,3-diaminobutane and alkylhydropyrimidine. Further, it is believed that the diamines should be free of oxidation reactants to avoid diamine degradation and ammonia formation. Additionally, if amine oxide and/or other surfactants are present, the amine oxide or surfactant should be hydrogen peroxide-free. The preferred level of hydrogen peroxide in the amine oxide or surfactant paste of amine oxide is 0–40 ppm, more preferably 0–15 ppm. Amine impurities in amine oxide and betaines, if present, should be minimized to the levels referred above for hydrogen peroxide.

Making the compositions free of hydrogen peroxide is important when the compositions contain an enzyme. The peroxide can react with the enzyme and destroy any performance benefits the enzyme adds to the composition. Even small amounts of hydrogen peroxide can cause problems with enzyme containing formulations. However, the diamine can react with any peroxide present and act as an enzyme stabilizer and prevent the hydrogen peroxide from reacting with the enzyme. The only draw back of this stabilization of the enzymes by the diamine is that the nitrogen compounds produced are believed to cause the malodors which can be present in diamine containing compositions. Having the diamine act as an enzyme stabilizer also prevents the diamine from providing the benefits to the composition for which it was originally put in to perform, namely, grease cleaning, sudsing, dissolution and low temperature stability. Therefore, it is preferred to minimize the amount of hydrogen peroxide present as an impurity in the inventive compositions either by using components which are substantially free of hydrogen peroxide and/or by using non-diamine antioxidants even though the diamine can act as an enzyme stabilizer, because of the possible generation of malodorous compounds and the reduction in the amount of diamine available present to perform its primary role.

It is further preferred that the compositions of the present invention be "malodor" free. That is, that the odor of the headspace does not generate a negative olfactory response from the consumer. This can be achieved in many ways, including the use of perfumes to mask any undesirable odors, the use of stabilizers, such as antioxidants, chelants etc., and/or the use of diamines which are substantially free of impurities. It is believed, without wanting to being limited by theory, that it is the impurities present in the diamines that are the cause of most of the malodors in the compositions of the present invention. These impurities can form during the preparation and storage of the diamines. They can also form during the preparation and storage of the inventive composition. The use of stabilizers such as antioxidants and chelants inhibit and/or prevent the formation of these impurities in the composition from the time of preparation to ultimate use by the consumer and beyond. Hence, it is most preferred to remove, suppress and/or prevent the formation of these malodors by the addition of perfumes, stabilizers and/or the use of diamines which are substantially free from impurities.

One type of preferred organic diamines are those in which pK1 and pK2 are in the range of about 8.0 to about 11.5, preferably in the range of about 8.4 to about 11, even more preferably from about 8.6 to about 10.75. Preferred materials for performance and supply considerations are 1,3-bis (methylamine)-cyclohexane, 1,3 propane diamine (pK1=10.5; pK2=8.8), 1,6 hexane diamine (pK1=11; pK2=10), 1,3 pentane diamine (Dytek EP) (pK1=10.5; pK2=8.9), 2-methyl 1,5 pentane diamine (Dytek A) (pK1=11.2; pK2=10.0). Other preferred materials are the primary/primary diamines with alkylene spacers ranging from C4 to C8. In general, it is believed that primary diamines are preferred over secondary and tertiary diamines.

Definition of pK1 and pK2—As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, NY and London, 1975. Additional information on pKa's can be obtained from relevant company literature, such as information supplied by Dupont, a supplier of diamines.

As a working definition herein, the pKa of the diamines is specified in an all-aqueous solution at 25° C. and for an ionic strength between 0.1 to 0.5 M. The pKa is an equilibrium constant which can change with temperature and ionic strength; thus, values reported in the literature are sometimes not in agreement depending on the measurement method and conditions. To eliminate ambiguity, the relevant conditions and/or references used for pKa's of this invention are as defined herein or in "Critical Stability Constants: Volume 2, Amines". One typical method of measurement is the potentiometric titration of the acid with sodium hydroxide and determination of the pKa by suitable methods as described and referenced in "The Chemist's Ready Reference Handbook" by Shugar and Dean, McGraw Hill, NY, 1990.

It has been determined that substituents and structural modifications that lower pK1 and pK2 to below about 8.0 are undesirable and cause losses in performance. This can include substitutions that lead to ethoxylated diamines, hydroxy ethyl substituted diamines, diamines with oxygen in the beta (and less so gamma) position to the nitrogen in the spacer group (e.g., Jeffamine EDR 148). In addition, materials based on ethylene diamine are unsuitable.

Some of the diamines useful herein can be defined by the following structure:

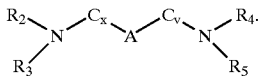

wherein R2–5 are independently selected from H, methyl, —CH3CH2, and ethylene oxides; Cx and Cv are independently selected from methylene groups or branched alkyl groups where x+y is from about 3 to about 6; and A is optionally present and is selected from electron donating or withdrawing moieties chosen to adjust the diamine pKa's to the desired range. If A is present, then x and y must both be 1 or greater.

Alternatively the diamines can be those organic diamines with a molecular weight less than or equal to 400 g/mol. It is preferred that these diamines have the formula:

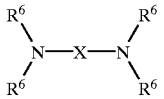

wherein each R6 is independently selected from the group consisting of hydrogen, C1–C4 linear or branched alkyl, alkyleneoxy having the formula:

$$-(R^7O)_mR^8$$

wherein R7 is C2–C4 linear or branched alkylene, and mixtures thereof; R8 is hydrogen, C1–C4 alkyl, and mixtures thereof; m is from 1 to about 10; X is a unit selected from:

i) C3–C10 linear alkylene, C3–C10 branched alkylene, C3–C10 cyclic alkylene, C3–C10 branched cyclic alkylene, an alkyleneoxyalkylene having the formula:

$$-(R^7O)_mR^7-$$

wherein R7 and m are the same as defined herein above;

ii) C3–C10 linear, C3–C10 branched linear, C3-C10 cyclic, C3–C10 branched cyclic alkylene, C6–C10 arylene, wherein said unit comprises one or more electron donating or electron withdrawing moieties which provide said diamine with a pKa greater than about 8; and iii) mixtures of (i) and (ii) provided said diamine has a pKa of at least about 8.

Examples of preferred diamines include the following: dimethyl aminopropyl amine, 1,6-hexane diamine, 1,3 propane diamine, 2-methyl 1,5 pentane diamine, 1,3-Pentanediamine (available under the tradename Dytek EP), 1,3-diaminobutane, 1,2-bis(2-aminoethoxy)ethane, (available under the tradename Jeffamine EDR 148), Isophorone diamine, 1,3-bis(methylamine)-cyclohexane, and mixtures thereof.

Polymeric Suds Stabilizer—The compositions of the present invention may optionally contain a polymeric suds stabilizer. These polymeric suds stabilizers provide extended suds volume and suds duration without sacrificing the grease cutting ability of the liquid detergent compositions. These polymeric suds stabilizers are preferably selected from:

i) homopolymers of (N,N-dialkylamino)alkyl acrylate esters having the formula:

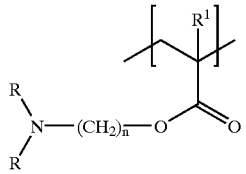

wherein each R is independently hydrogen, $C_1$–$C_8$ alkyl, and mixtures thereof, $R^1$ is hydrogen, $C_1$–$C_6$ alkyl, and mixtures thereof, n is from 2 to about 6; and ii) copolymers of (i) and

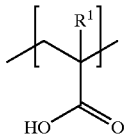

wherein $R^1$ is hydrogen, C1–C6 alkyl, and mixtures thereof, provided that the ratio of (ii) to (i) is from about 2 to 1 to about 1 to 2; The molecular weight of the polymeric suds boosters, determined via conventional gel permeation chromatography, is from about 1,000 to about 2,000,000, preferably from about 5,000 to about 1,000,000, more preferably from about 10,000 to about 750,000, more preferably from about 20,000 to about 500,000, even more preferably from about 35,000 to about 200,000. The polymeric suds stabilizer can optionally be present in the form of a salt, either an inorganic or organic salt, for example the citrate, sulfate, or nitrate salt of (N,N-dimethylamino)alkyl acrylate ester.

One preferred polymeric suds stabilizer is (N,N-dimethylamino)alkyl acrylate esters, namely

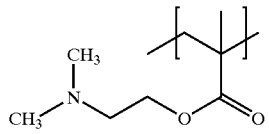

The composition will preferably contain at least about 0.01%, more preferably at least about 0.05%, even more preferably still, at least about 0.1% by weight of the composition of polymeric suds booster. The cleaning composition will also preferably contain no more than about 15%, more preferably no more than about 10%, even more preferably, no more than about 5% by weight of the composition of polymeric suds booster.

Other suitable polymeric suds stabilizers, including protenacious suds stabilizers and zwitterionic suds stabilizers, can be found in PCT/US98/24853 filed Nov. 20, 1998, PCT/US98/24707 filed Nov. 20, 1998, PCT/US98/24699 filed Nov. 20, 1998, and PCT/US98/24852 filed Nov. 20, 1998.

Another suitable type of suds stabilizers are the cationic copolymer stabilizers, which contain approximately by weight, more than 50% of units derived from acrylamide, methacrylamide or a mixture thereof, 0.5 to 2% of pendant quaternary nitrogen, and 0.1 to 10% of pendant C.sub.8–24 hydrophobic groups, preferably the copolymer contains, approximately by weight, 55 to 95% of units derived from acrylamide, methacrylamide or a mixture thereof, 4 to 30% of hydrophilically functional units having the molecular configuration of units derived from at least one monoethylenically unsaturated, quaternary ammonium group-containing monomer, and 1 to 15% of units derived from at least one monoethylenically unsaturated, C.sub.8–24 hydrophobic group-containing monomer devoid of quaternary nitrogen. It is more preferred that the quaternary ammonium group-containing monomer has the formula

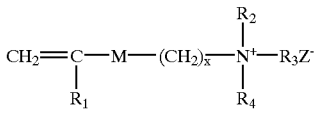

wherein $R_1$ is H or $CH_3$, $R_2$ and $R_3$ are independently $C_{1-4}$ alkyls, $R_4$ is $C_{1-4}$ alkyl, $C_{2-3}$ hydroxyalkyl, or benzyl $R_2$, $R_3$ and $R_4$ together contain less than 9 carbon atoms, Z is a water-solubilizing salt-forming anion, and M may be —CO—X—, then X is —O— or —$NR_5$—, $R_5$ is H or $C_{1-4}$ alkyl and x is 1–6, or M may be phenylene then x is 1; and that the hydrophobic group-containing monomer has the formula

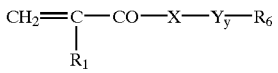

wherein $R_1$ is H or $CH_3$, X is —O— or —$NR_7$—, Y is —$C_2H_4O$— or —$C_3H_7O$—, y is 0–60 when X is —O—, $R_6$ is $C_{8-24}$ hydrocarbyl, and when X is —$NR_7$—, $R_6$ is $C_{1-24}$ hydrocarbyl and $R_7$ is H or $C_{1-24}$ hydrocarbyl, at least one of $R_6$ and $R_7$ being $C_{8-24}$ hydrocarbyl. For more details on these cationic copolymer stabilizers see U.S. Pat. No. 4,454,060.

Thickener—The dishwashing detergent compositions herein can also contain from about 0.2% to 5% of a thickening agent. More preferably, such a thickener will comprise from about 0.5% to 2.5% of the compositions herein. Thickeners are typically selected from the class of cellulose derivatives. Suitable thickeners include hydroxy ethyl cellulose, hydroxyethyl methyl cellulose, carboxy methyl cellulose, Quatrisoft LM200, and the like. A preferred thickening agent is hydroxypropyl methylcellulose.

The composition may preferably contain at least about 0.1%, more preferably at least about 0.2%, even more preferably still, at least about 5% by weight of the composition of thickener. The composition will also preferably contain no more than about 5%, more preferably no more than about 3%, even more preferably, no more than about 2.5% by weight of the composition of thickener.

The hydroxypropyl methylcellulose polymer has a number average molecular weight of about 50,000 to 125,000 and a viscosity of a 2 wt. % aqueous solution at 25° C. (ADTMD2363) of about 50,000 to about 100,000 cps. An especially preferred hydroxypropyl cellulose polymer is Methocel® J75MS-N wherein a 2.0 wt. % aqueous solution at 25° C. has a viscosity of about 75,000 cps. Especially preferred hydroxypropyl cellulose polymers are surface treated such that the hydroxypropyl cellulose polymer will ready disperse at 25° C. into an aqueous solution having a pH of at least about 8.5.

When formulated into the dishwashing detergent compositions of the present invention, the hydroxypropyl methylcellulose polymer should impart to the detergent composition a Brookfield viscosity of from about 500 to 3500 cps at 25° C. More preferably, the hydroxypropyl methylcellulose material will impart a viscosity of from about 1000 to 3000 cps at 25° C. For purposes of this invention, viscosity is measured with a Brookfield LVTDV-11 viscometer apparatus using an RV #2 spindle at 12 rpm.

Also suitable for use as thickeners are the clay thickeners. One suitable clay thickener is Laponite. The Laponite clay when used, is present in the instant composition at a concentration of about 0.25% to about 2.0 wt. %, more preferably about 0.5 to about 1.75 wt. % is a synthetic colored clay optionally having at least about 5.0 wt. % of tetrapotassium pyrrophosphate peptizer which is Laponite RDS. The particle size of Laponite RDS which is manufactured by Laponite Inorganics of Great Britain has a particle size of <2% greater than 250 microns a bulk density of about 1000 Kg/m.sup.3, and a surface area of about 330 m.sup.3/g. Laponite RD does not have a peptizer and has a particle size of <2% greater than 250 microns, a surface area of about 370 m.sup.2/g and a bulk density of about 1000 Kg/m.sup.3.

When the compositions contain an abrasive the dishwashing composition may also contain a colloid-foaming, expandable clay which functions both as a thickening agent for the formula and as a suspending agent for the abrasive. These expandable clays are those classified geologically as smectites and attapulgites. Suitable smectite clays are the montmorillonite clays which are primarily hydrated aluminosilicates and the hectorites which are primarily hydrated magnesium silicates. It should be understood that the proportion of water of hydration in the smectite clays varies with the manner in which the clay has been processed. However, the amount of water present is not significant because the expandable characteristics of the hydrated smectite clays are dictated by the silicate lattice structure. Additionally, deficit charges in smectite are compensated by cations such as sodium, calcium, potassium, etc., which are sorbed between the three layer (two tetrahedral and one octahedral) clay mineral sandwiches. The smectite clays used in the liquid compositions are commercially available under various trade names such as Thixogel No. 1 and Gelwhite GP from Georgia Kaolin Company (both montmorillonites) and Veegum Pro and Veegum F from R. T. Vanderbilt (both hectorites). A preferred clay is Gelwhite GP which is a colloidal montmorillonite clay of a high viscosity sold by Georgia Kaolin company. This clay contains about 6% to 10% by weight of water and is a mixture of the following oxides: 59% SIO.sub.2, 21% Al.sub.3 O.sub.3, 1% Fe.sub.2 O.sub.3, 2.4% CaO, 3.8% MgO, 4.1% Na.sub.2 O and 0.4% K.sub.2 O. 100% by weight of the clay passes through a 200 mesh screen. It disperses readily in water, but requires maximum swelling in water before use. This swelling of the clay is important to eliminate liquid layering. During this swelling process, the clay/water mix builds substantial viscosity. It is also thixotropic and, therefore, exhibits a yield point as well. 350 dynes/cm.sub.2 has been judged to be a preferred yield point for a clay/water mix of Gelwhite GP because at this point the other physical properties of the final composition, e.g., pourability, dispersibility, suspending ability and liquid layering, are acceptable. (The term "layering" refers to the amount—in millimeters—of clear liquid visible on the surface of the finished formula after aging at 49.degree. C. for one week and for ten weeks.) A clay/water mix having a yield point of 350 dynes/cm.sup.2 is acceptable regardless of Gelwhite GP concentration. The yield point normally is measured using HAAKE rv12, MVIP, E=0.3, R=100 O=113 min, 18 minute hold, grooved rotor and cup. Another expandable clay material suitable for use in the liquid compositions is classified geologically as attapulgite, a magnesium rich clay. A typical attapulgite analysis yields 55.02% SiO.sub.2; 10.24% Al.sub.2 O.sub.3; 3.53% Fe.sub.2 O.sub.3; 10.49%

MgO; 0.47% K.sub.2 O; 9.73% H.sub.2 O removed at 150.degree. C. and 10.13% H.sub.2 O removed at higher temperatures. These clays have a small particle size, with 100% of the clay passing through a 200 mesh screen. Attapulgite clays are commercially available under various trade names such as Attagel 40, Attagel 50 and Attagel 150 from Engelhard Minerals & Chemicals Corporation. Of course, mixtures of smectite clays and attapulgite clays are suitable, too, to provide combinative properties which are not obtained from either class of clay above. In order to achieve the desired swelling, a suspension of clay in water is subjected to high-shear mixing for a sufficient time to substantially fully hydrate the clay before its introduction into the organic portion of the formulation. For example, the desired swelling can be accomplished by high speed shearing of an 8% aqueous clay dispersion for 25 minutes. When the clay is substantially fully hydrated, the viscosity of the aqueous suspension increases dramatically and, thus, the swelling process permits the use of lower concentrations of clay. For example, concentrations of clay as low as 1% to 1.55% and up to a maximum of 3%, preferably 1.2% to 2%, by weight are effective to stabilize the inventive abrasive composition without adversely affecting its dispersibility in water. As indicated above, the clay/water mix used in the described composition preferably has a yield point of about 350 dynes/$cm^2$, but satisfactory abrasive compositions can be prepared with aqueousclay dispersions having a yield point as low as 300 dynes/$cm^2$and as high as 450 dynes/$cm^2$. The foregoing water-insoluble, low-density, abrasives are suspended in the dishwashing liquid composition and their concentration ranges from 3% to 15%, preferably from 5% to 15%, by weight. If desired, small amounts, e.g., 1% to 25% by weight (based upon the total weight of abrasive in the composition), of crystalline abrasives having a Mohs hardness of 2 to 7 such as silica or calcium carbonate may be substituted for part of the low density abrasive provided that a substantially stable liquid dishwashing composition results.

Abrasive—The instant cleaning compositions may optionally contain from about 0 to about 20 wt. %, more preferably about 0.5 to about 10 wt. % of an abrasive. The abrasive is preferably of selected from the group consisting of amorphous hydrated silica, calcite which is a limestone calcium carbonate, and polyethylene powder particles and mixtures thereof. A suitable amorphous silica (oral grade) to enhance the scouring ability of the composition is provided by Zeoffin. The mean particle size of Zeoffin silica is 8 up to 10 mm. Its apparent density is 0.32 to 0.37 g/ml. Another silica is Tixosil 103 made by Rhone-Poulenc. An amorphous hydrated silica from Crosfield of different particles sizes (9, 15 and 300 mm), and same apparent density was also used. One polyethylene powder suitable for use in the instant invention has a particle size of about 200 to about 500 microns and a density of about 0.91 to about 0.99 g/liter, more preferably about 0.94 to about 0.96. Another preferred abrasive is calcite used at a concentration of about 0% to 20 wt. %, more preferably 1 wt. % to 10 wt. % and is manufactured by J. M. Huber Corporation of Illinois. Calcite is a limestone consisting primarily of calcium carbonate and 1% to 5% of magnesium carbonate which has a mean particle size of 5 microns and oil absorption (rubout) of about 10 and a hardness of about 3.0 Mohs.

Solvents—A variety of water-miscible liquids such as lower alkanols, diols, other polyols, ethers, amines, and the like may be used Particularly preferred are the $C_1$–$C_4$ alkanols. Such solvents can be present in the compositions herein to the extent of from about 1% to 8%.

When present the composition will preferably contain at least about 0.01%, more preferably at least about 0.5%, even more preferably still, at least about 1% by weight of the composition of solvent. The composition will also preferably contain no more than about 20%, more preferably no more than about 10%, even more preferably, no more than about 8% by weight of the composition of solvent.

These solvents may be used in conjunction with an aqueous liquid carrier, such as water, or they may be used without any aqueous liquid carrier being present. Solvents are broadly defined as compounds that are liquid at temperatures of 20° C.–25° C. and which are not considered to be surfactants. One of the distinguishing features is that solvents tend to exist as discrete entities rather than as broad mixtures of compounds. Examples of suitable solvents for the present invention include, methanol, ethanol, propanol, isopropanol, 2-methyl pyrrolidinone, benzyl alcohol and morpholine n-oxide. Preferred among these solvents are methanol and isopropanol.

Suitable solvents for use herein include ethers and diethers having from 4 to 14 carbon atoms, preferably from 6 to 12 carbon atoms, and more preferably from 8 to 10 carbon atoms. Also other suitable solvents are glycols or alkoxylated glycols, alkoxylated aromatic alcohols, aromatic alcohols, aliphatic branched alcohols, alkoxylated aliphatic branched alcohols, alkoxylated linear C1–C5 alcohols, linear C1–C5 alcohols, C8–C14 alkyl and cycloalkyl hydrocarbons and halohydrocarbons, C6–C16 glycol ethers and mixtures thereof.

Suitable glycols which can be used herein are according to the formula HO—CR1R2—OH wherein R1 and R2 are independently H or a C2–C10 saturated or unsaturated aliphatic hydrocarbon chain and/or cyclic. Suitable glycols to be used herein are dodecaneglycol and/or propanediol. Also suitable are polypropylene glycols, such as those with a molecular weigh in the range of about 100 to 1000. One suitable polypropylene glycol ha a molecular weight of about 2700.

Suitable alkoxylated glycols which can be used herein are according to the formula R—(A)n-R1—OH wherein R is H, OH, a linear saturated or unsaturated alkyl of from 1 to 20 carbon atoms, preferably from 2 to 15 and more preferably from 2 to 10, wherein R1 is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable alkoxylated aromatic alcohols which can be used herein are according to the formula $R(A)_n$—OH wherein R is an alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols which can be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable aliphatic branched alcohols which can be used herein are according to the formula R—OH wherein R is a branched saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol.

Suitable alkoxylated aliphatic branched alcohols which can be used herein are according to the formula $R(A)_n$—OH wherein R is a branched saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Suitable alkoxylated linear C1–C5 alcohols which can be used herein are according to the formula $R(A)_n$—OH wherein R is a linear saturated or unsaturated alkyl group of from 1 to 5 carbon atoms, preferably from 2 to 4, wherein A is an alkoxy group preferably butoxy, propoxy and/or ethoxy, and n is an integer of from 1 to 5, preferably 1 to 2. Suitable alkoxylated aliphatic linear C1–C5 alcohols are butoxy propoxy propanol (n-BPP), butoxyethanol, butoxypropanol, ethoxyethanol or mixtures thereof. Butoxy propoxy propanol is commercially available under the trade name n-BPP® from Dow chemical.

Suitable linear C1–C5 alcohols which can be used herein are according to the formula R—OH wherein R is a linear saturated or unsaturated alkyl group of from 1 to 5 carbon atoms, preferably from 2 to 4. Suitable linear C1–C5 alcohols are methanol, ethanol, propanol or mixtures thereof.

Other suitable solvents include, but are not limited to, butyl diglycol ether (BDGE), butyltriglycol ether, ter amilic alcohol and the like. Particularly preferred solvents which can be used herein are butoxy propoxy propanol, butyl diglycol ether, benzyl alcohol, butoxypropanol, ethanol, methanol, isopropanol and mixtures thereof.

Other suitable solvents for use herein include propylene glycol derivatives such as n-butoxypropanol or n-butoxypropoxypropanol, water-soluble CARBITOL® solvents or water-soluble CELLOSOLVE® solvents; water-soluble CARBITOL® solvents are compounds of the 2-(2-alkoxyethoxy)ethanol class wherein the alkoxy group is derived from ethyl, propyl or butyl; a preferred water-soluble carbitol is 2-(2-butoxyethoxy)ethanol also known as butyl carbitol. Water-soluble CELLOSOLVE® solvents are compounds of the 2-alkoxyethoxy ethanol class, with 2-butoxyethoxyethanol being preferred. Other suitable solvents include benzyl alcohol, and diols such as 2-ethyl-1,3-hexanediol and 2,2,4-trimethyl-1,3-pentanediol and mixtures thereof. Some preferred solvents for use herein are n-butoxypropoxypropanol, BUTYL CARBITOL® and mixtures thereof.

The solvents can also be selected from the group of compounds comprising ether derivatives of mono-, di- and tri-ethylene glycol, propylene glycol, butylene glycol ethers, and mixtures thereof. The molecular weights of these solvents are preferably less than 350, more preferably between 100 and 300, even more preferably between 115 and 250. Examples of preferred solvents include, for example, mono-ethylene glycol n-hexyl ether, mono-propylene glycol n-butyl ether, and tri-propylene glycol methyl ether. Ethylene glycol and propylene glycol ethers are commercially available from the Dow Chemical Company under the tradename "Dowanol" and from the Arco Chemical Company under the tradename "Arcosolv". Other preferred solvents including mono- and di-ethylene glycol n-hexyl ether are available from the Union Carbide company.

Solubilizing agent—The instant compositions may optionally contain about 0 wt. % to about 12 wt. %, more preferably about 1 wt. % to about 10 wt. %, of at least one solubilizing agent which can be a hydrotrope such as sodium xylene sulfonate, or sodium cumene sulfonate, a $C_{2-3}$ mono or dihydroxy alkanols such as ethanol, isopropanol and propylene glycol and mixtures thereof. The solubilizing agents are included in order to control low temperature cloud clear properties. Urea can be optionally employed in the instant composition as a supplemental solubilizing agent at a concentration of 0 to about 10 wt. %, more preferably about 0.5 wt. % to about 8 wt. %. Other suitable solubilizing agents are glycerol, water-soluble polyethylene glycols having a molecular weight of 300 to 600, polypropylene glycol of the formula $HO(CH_3CHCH_2O)_nH$ wherein n is a number from 2 to 18, mixtures of polyethylene glycol and polypropylene glycol (Synalox) and mono $C_1$–$C_6$ alkyl ethers and esters of ethylene glycol and propylene glycol having the structural formulas $R(X)_nOH$ and $R_1(X)_nOH$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4. Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate.

Polymeric Soil Release Agent—The compositions according to the present invention may optionally comprise one or more soil release agents. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the laundry cycle and, thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10% preferably from about 0.1% to about 5%, more preferably from about 0.2% to about 3% by weight, of the composition.

The following, all included herein by reference, describe soil release polymers suitable for us in the present invention. U.S. Pat. No. 5,691,298 Gosselink et al., issued Nov. 25, 1997; U.S. Pat. No. 5,599,782 Pan et al., issued Feb. 4, 1997;

U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. Pat. No. 4,702,857 Gosselink et al., issued Oct. 27, 1987; U.S. Pat. No. 4,711,730 Gosselink et al., issued Dec. 8, 1987; U.S. Pat. No. 4,721,580 Gosselink issued Jan. 26, 1988; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et al.; U.S. Pat. No. 4,240,918 Lagasse et al.; U.S. Pat. No. 4,525,524 Tung et al.; U.S. Pat. No. 4,579,681 Ruppert et al.; U.S. Pat. Nos. 4,220,918; 4,787,989; EP 279,134 A, 1988 to Rhone-Poulenc Chemie; EP 457,205 A to BASF (1991); and DE 2,335,044 to Unilever N.V., 1974; all incorporated herein by reference.

Polymeric Grease release agents—The compositions of the present invention can also optionally contain polymeric grease release agents. Sutable polymer grese release agents include those of the formula:

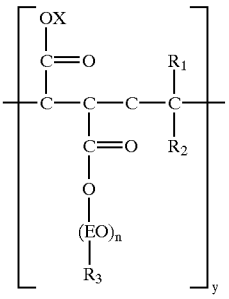

wherein x is hydrogen or an alkali metal cation and n is a number from 2 to 16, $R_1$ is selected from the group consisting of methyl or hydrogen, $R_2$ is a $C_1$ to $C_{12}$, linear or branched chained alkyl group and $R_3$ is a $C_2$ to $C_{16}$, linear or branched chained alkyl group and y is of such value as to provide a molecular weight about 5,000 to about 15,000. See U.S. Pat. No. 5,573,702.

Clay Soil Removal/Anti-redeposition Agents—The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylated amines; liquid detergent compositions typically contain about 0.01% to about 5%.

A preferred soil release and anti-redeposition agent is ethoxylated tetraethylene pentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. See U.S. Pat. No. 4,891,160, VanderMeer, issued Jan. 2, 1990 and WO 95/32272, published Nov. 30, 1995. Another type of preferred antiredeposition agent includes the carboxy methyl cellulose (CMC) materials. These materials are well known in the art.

Polymeric Dispersing Agents—Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release, peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Other polymer types which may be more desirable for biodegradability, improved bleach stability, or cleaning purposes include various terpolymers and hydrophobically modified copolymers, including those marketed by Rohm & Haas, BASF Corp., Nippon Shokubai and others for all manner of water-treatment, textile treatment, or detergent applications.

Chelating Agents—The compositions herein may also optionally contain one or chelating agents, particularly chelating agents for adventitious transition metals. Those commonly found in wash water include iron and/or manganese in water-soluble, colloidal or particulate form, and may be associated as oxides or hydroxides, or found in association with soils such as humic substances. Preferred chelants are those which effectively control such transition metals, especially including controlling deposition of such transition-metals or their compounds on fabrics and/or controlling undesired redox reactions in the wash medium and/or at fabric or hard surface interfaces. Such chelating agents include those having low molecular weights as well as polymeric types, typically having at least one, preferably two or more donor heteroatoms such as O or N, capable of co-ordination to a transition-metal. Common chelating agents can be selected from the group consisting of aminocarboxylates, aminophosphonates, polyfunctionally-substituted aromatic chelating agents and mixtures thereof.

Amino carboxylates useful as optional chelating agents include ethylenediaminetetrace-tates, N-hydroxyethylethylenediaminetriacetates, nitrilotriacetates, ethylenediamine tetrapro-prionates, triethylenetetraaminehexacetates, diethylenetriaminepentaacetates, and ethanoldi-glycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder. Similarly, the so called "weak" builders such as citrate can also be used as chelating agents.

If utilized, chelating agents will generally comprise from about 0.001% to about 15% by weight of the detergent compositions herein. More preferably, if utilized, chelating agents will comprise from about 0.01% to about 3.0% by weight of such compositions.

Suds Suppressors—Compounds for reducing or suppressing the formation of suds can be incorporated into the compositions of the present invention when required by the intended use, especially washing of laundry in washing appliances. Other compositions, such as those designed for hand-washing, may desirably be high-sudsing and may omit such ingredients Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors and are well known in the art. See, for example, Kirk Othmer Encyclopedia of Chemical Technology, Third Edition, Volume 7, pages 430–447 (Wiley, 1979).

The compositions herein will generally comprise from 0% to about 10% of suds suppressor. When utilized as suds suppressors, monocarboxylic fatty acids, and salts thereof, will be present typically in amounts up to about 5%, preferably 0.5%–3% by weight, of the detergent composition. although higher amounts may be used. Preferably from about 0.01% to about 1% of silicone suds suppressor is used, more preferably from about 0.25% to about 0.5%. These weight percentage values include any silica that may be utilized in combination with polyorganosiloxane, as well as any suds suppressor adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Alkoxylated Polycarboxylates—Alkoxylated polycarboxylates such as those prepared from polyacrylates are useful herein to provide additional grease removal performance. Such materials are described in WO 91/08281 and PCT 90/01815 at p. 4 et seq., incorporated herein by reference. Chemically, these materials comprise polyacrylates having one ethoxy side-chain per every 7–8 acrylate units. The side-chains are of the formula $—(CH_2CH_2O)_m(CH_2)_nCH_3$ wherein m is 2–3 and n is 6–12. The side-chains are ester-linked to the polyacrylate "backbone" to provide a "comb" polymer type structure. The molecular weight can vary, but is typically in the range of about 2000 to about 50,000. Such alkoxylated polycarboxylates can comprise from about 0.05% to about 10%, by weight, of the compositions herein.

Perfumes—Perfumes and perfumery ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfidmes typically comprise from about 0.01% to about 2%, by weight, of the detergent compositions herein, and individual perfuimrery ingredients can comprise from about 0.0001% to about 90% of a finished perfume composition.

Non-limiting examples of perfume ingredients useful herein include: 7-acetyl-1,2,3,4,5,6,7,8-octahydro-1,1,6,7-tetramethyl naphthalene; ionone methyl; ionone gamma methyl; methyl cedrylone; methyl dihydrojasmonate; methyl 1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; para-hydroxy-phenyl-butanone; benzophenone; methyl beta-naphthyl ketone; 6-acetyl-1,1,2,3,3,5-hexamethyl indane; 5-acetyl-3-isopropyl-1,1,2,6-tetramethyl indane; 1-dodecanal, 4-(4-hydroxy-4-methylpentyl)-3-cyclohexene-1-carboxaldehyde; 7-hydroxy-3,7-dimethyl ocatanal; 10-undecen-1-al; iso-hexenyl cyclohexyl carboxaldehyde; formyl tricyclodecane; condensation products of hydroxycitronellal and methyl anthranilate, condensation products of hydroxycitronellal and indol, condensation products of phenyl acetaldehyde and indol; 2-methyl-3-(para-tert-butylphenyl)-propionaldehyde; ethyl vanillin; heliotropin; hexyl cinnamic aldehyde; amyl cinnamic aldehyde; 2-methyl-2-(para-iso-propylphenyl)-propionaldehyde; coumarin; decalactone gamma; cyclopentadecanolide; 16-hydroxy-9-hexadecenoic acid lactone; 1,3,4,6,7,8-hexahydro-4,6,6,7,8,8-hexamethylcyclopenta-gamma-2-benzo-pyrane; beta-naphthol methyl ether; ambroxane; dodecahydro-3a,6,6,9a-tetramethyl-naphtho[2,1b]furan; cedrol, 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; tricyclodecenyl propionate; tricyclodecenyl acetate; benzyl salicylate; cedryl acetate; and para-(tert-butyl) cyclohexyl acetate.

Particularly preferred perfume materials are those that provide the largest odor improvements in finished product compositions containing cellulases. These perfumes include but are not limited to: hexyl cinnamic aldehyde; 2-methyl-3-(para-tert-butylphenyl)-propionaldehyde; 7-acetyl-1,2,3,4,5,6,7,8-octahydro-1,1,6,7-tetramethyl naphthalene; benzyl salicylate; 7-acetyl-1,1,3,4,4,6-hexamethyl tetralin; para-tert-butyl cyclohexyl acetate; methyl dihydro jasmonate; beta-napthol methyl ether; methyl beta-naphthyl ketone; 2-methyl-2-(para-iso-propylphenyl)-propionaldehyde; 1,3,4,6,7,8-hexahydro-4,6,6,7,8,8-hexamethyl-cyclopenta-gamma-2-benzopyrane; dodecahydro-3a,6,6,9a-tetramethylnaphtho[2,1b]furan; anisaldehyde; coumarin; cedrol; vanillin; cyclopentadecanolide; tricyclodecenyl acetate; and tricyclodecenyl propionate.

Other perfume materials include essential oils, resinoids, and resins from a variety of sources including, but not limited to: Peru balsam, Olibanum resinoid, styrax, labdanum resin, nutmeg, cassia oil, benzoin resin, coriander and lavandin. Still other perfume chemicals include phenyl ethyl alcohol, terpineol, linalool, linalyl acetate, geraniol, nerol, 2-(1,1-dimethylethyl)-cyclohexanol acetate, benzyl acetate, and eugenol. Carriers such as diethylphthalate can be used in the finished perfume compositions.

In place of the perfume, especially in microemulsions, the compositions can employ an essential oil or a water insoluble organic compound such as a water insoluble hydrocarbon having 6 to 18 carbon such as a paraffin or isoparaffin such as isoparH, isodecane, alpha-pinene, beta-pinene, decanol and terpineol. Suitable essential oils are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69.degree. C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchpouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen Composition DH—Dishwashing compositions of the invention will be subjected to acidic stresses created by food soils when put to use, i.e., diluted and applied to soiled dishes. If a composition with a pH greater than 7 is to be more effective, it may optionally contain a buffering agent capable of providing a generally more alkaline pH in the composition and in dilute solutions, i.e., about 0.1% to 0.4% by weight aqueous solution, of the composition. The pKa value of this buffering agent should be about 0.5 to 1.0 pH units below the desired pH value of the composition (determined as described above). Preferably, the pKa of the buffering agent should be from about 7 to about 10. Under these conditions the buffering agent most effectively controls the pH while using the least amount thereof.

It is prefered that the compositions of the present invention has a pH (as measured as 10% aqueous solution) from about 2.0 to about 12.5, more preferably from about to about, even more preferably from about to about.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are Tri (hydroxymethyl)amino methane (HOCH2)3CNH3(TRIS), 2-amino-2-ethyl-1,3-propanediol, 2-amino-2-methyl-propanol, 2-amino-2-methyl-1,3-propanol, disodium glutamate, N-methyl diethanolamide, 1,3-diamino-propanol N,N'-tetra-methyl-1,3-diamino-2-propanol, N,N-bis(2-hydroxyethyl)glycine (bicine) and N-tris (hydroxymethyl) methyl glycine (tricine). Mixtures of any of the above are also acceptable. Useful inorganic buffers/alkalinity sources include the alkali metal carbonates and alkali metal phosphates, e.g., sodium carbonate, sodium polyphosphate. For additional buffers see McCutcheon's EMULSIFIERS AND DETERGENTS, North American Edition, 1997, McCutcheon Division, MC Publishing Company Kirk and WO 95/07971 both of which are incorporated herein by reference.

The composition will preferably contain at least about 0.1%, more preferably at least about 1%, even more preferably still, at least about 2% by weight of the composition of buffering agent. The composition will also preferably contain no more than about 15%, more preferably no more than about 10%, even more preferably, no more than about 8% by weight of the composition of buffering agent.

Hydrotropes—The aqueous liquid carrier may comprise one or more materials which are hydrotropes. Hydrotropes suitable for use in the compositions herein include the $C_1$–$C_3$ alkyl aryl sulfonates, $C_6$–$C_{12}$ alkanols, $C_1$–$C_6$ carboxylic sulfates and sulfonates, urea, $C_1$–$C_6$ hydrocarboxylates, $C_1$–$C_4$ carboxylates, $C_2$–$C_4$ organic diacids and mixtures of these hydrotrope materials. The liquid detergent composition of the present invention preferably comprises from about 0.5% to 8%, by weight of the liquid detergent composition of a hydrotrope selected from alkali metal and calcium xylene and toluene sulfonates.

Suitable $C_1$–$C_3$ alkyl aryl sulfonates include sodium, potassium, calcium and ammonium xylene sulfonates; sodium, potassium, calcium and ammonium toluene sulfonates; sodium, potassium, calcium and ammonium cumene sulfonates; and sodium, potassium, calcium and ammonium substituted or unsubstituted naphthalene sulfonates and mixtures thereof.

Suitable $C_1$–$C_8$ carboxylic sulfate or sulfonate salts are any water soluble salts or organic compounds comprising 1 to 8 carbon atoms (exclusive of substituent groups), which are substituted with sulfate or sulfonate and have at least one carboxylic group. The substituted organic compound may be cyclic, acylic or aromatic, i.e. benzene derivatives. Preferred alkyl compounds have from 1 to 4 carbon atoms substituted with sulfate or sulfonate and have from 1 to 2 carboxylic groups. Examples of this type of hydrotrope include sulfosuccinate salts, sulfophthalic salts, sulfoacetic salts, m-sulfobenzoic acid salts and diester sulfosuccinates, preferably the sodium or potassium salts as disclosed in U.S. Pat. No. 3,915,903.

Suitable $C_1$–$C_4$ hydrocarboxylates and $C_1$–$C_4$ carboxylates for use herein include acetates and propionates and citrates. Suitable $C_2$–$C_4$ diacids for use herein include succinic, glutaric and adipic acids.

Other compounds which deliver hydrotropic effects suitable for use herein as a hydrotrope include $C_6$–$C_{12}$ alkanols and urea.

Preferred hydrotropes for use herein are sodium, potassium, calcium and ammonium cumene sulfonate; sodium, potassium, calcium and ammonium xylene sulfonate; sodium, potassium, calcium and ammonium toluene sulfonate and mixtures thereof. Most preferred are sodium cumene sulfonate and calcium xylene sulfonate and mixtures thereof. These preferred hydrotrope materials can be present in the composition to the extent of from about 0.5% to 8% by weight.

The composition will preferably contain at least about 0.1%, more preferably at least about 0.2%, even more preferably still, at least about 0.5% by weight of the composition of hydrotrope. The composition will also preferably contain no more than about 15%, more preferably no more than about 10%, even more preferably, no more than about 8% by weight of the composition of hydrotrope.

Other Ingredients—The detergent compositions may further preferably comprise one or more detersive adjuncts selected from the following: soil release polymers, polymeric dispersants, polysaccharides, abrasives, bactericides, tarnish inhibitors, color stabilizers, dyes, electrolytes (such as NaCl etc), antifungal or mildew control agents, insect repellents, acaricidal agents hydrotropes, anti-bacterial agent, processing aids, suds boosters, brighteners, anticorrosive aids and stabilizers antioxidants. A wide variety of other ingredients useful in detergent compositions can be included in the compositions herein, including other active ingredients, carriers, antioxidants, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous.

An antioxidant can be optionally added to the detergent compositions of the present invention. They can be any conventional antioxidant used in detergent compositions, such as 2,6-di-tert-butyl-4-methylphenol (BHT), carbamate, ascorbate, thiosulfate, monoethanolamine(MEA), diethanolamine, triethanolamine, etc. It is preferred that the antioxidant, when present, be present in the composition from about 0.001% to about 5% by weight.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfaciant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol (EO 7) nonionic surfactant. Typically, the enzyme/surfactant solution is 2.5× the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Form of the Composition

The compositions herein can be in any of the conventional forms for hand dishwashing compositions, such as, paste, liquid, granule, powder, gel, liqui-gel, microemulsion liquid crystal and mixtures thereof. Highly preferred embodiments are in liquid or gel form. The liquid compositions can be either aqueous or nonaqueous. When the composition is a aqueous liquid the composition will preferably further contain an aqueous liquid carrier in which the other essential and optional compositions components are dissolved, dispersed or suspended.

When the composition is an aqueous liquid the composition will preferably contain at least about 5%, more preferably at least about 10%, even more preferably still, at least about 30% by weight of the composition of aqueous liquid carrier. The composition will also preferably contain no more than about 95%, more preferably no more than about 60%, even more preferably, no more than about 50% by weight of the composition of aqueous liquid carrier.

One essential component of the aqueous liquid carrier is, of course, water. The aqueous liquid carrier, however, may contain other materials which are liquid, or which dissolve in the liquid carrier, at room temperature and which may also serve some other function besides that of a simple filler. Such materials can include, for example, hydrotropes and solvents. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used.

An example of the procedure for making granules of the detergent compositions herein is as follows:—the modified aklylbenzenesulfonate, citric acid, sodium silicate, sodium sulfate perfume, diamine and water are added to, heated and mixed via a crutcher. The resulting slurry is spray dried into a granular form.

An example of the procedure for making liquid detergent compositions herein is as follows:—To the free water and citrate are added and dissolved. To this solution amine oxide, betaine, ethanol, hydrotrope and nonionic surfactant are added. If free water isn't available, the citrate are added to the above mix then stirred until dissolved. At this point, an acid is added to neutralize the formulation. It is preferred that the acid be chosen from organic acids such as maleic and citric, however, inorganic mineral acids may be employed as well. In preferred embodiments these acids are added to the formulation followed by diamine addition. AExS is added last.

Non-Aqueous Liquid Detergents

The manufacture of liquid detergent compositions which comprise a non-aqueous carrier medium can be prepared according to the disclosures of U.S. Pat. Nos. 4,753,570; 4,767,558; 4,772,413; 4,889,652; 4,892,673; GB-A-2,158,838; GB-A-2,195,125; GB-A-2,195,649; U.S. Pat. Nos. 4,988,462; 5,266,233; EP-A-225,654 (Jun. 16, 1987); EP-A-510,762 (Oct. 28, 1992); EP-A-540,089 (May 5, 1993); EP-A-540,090 (May 5, 1993); U.S. Pat. No. 4,615,820; EP-A-565,017 (Oct. 13, 1993); EP-A-030,096 (Jun. 10, 1981), incorporated herein by reference. Such compositions can contain various particulate detersive ingredients stably suspended therein. Such non-aqueous compositions thus comprise a LIQUID PHASE and, optionally but preferably, a SOLID PHASE, all as described in more detail hereinafter and in the cited references.

The compositions of this invention can be used to form aqueous washing solutions for use hand dishwashing. Generally, an effective amount of such compositions is added to water to form such aqueous cleaning or soaking solutions. The aqueous solution so formed is then contacted with the dishware, tableware, and cooking utensils.

An effective amount of the detergent compositions herein added to water to form aqueous cleaning solutions can comprise amounts sufficient to form from about 500 to 20,000 ppm of composition in aqueous solution. More preferably, from about 800 to 5,000 ppm of the detergent compositions herein will be provided in aqueous cleaning liquor.

The following examples are illustrative of the present invention, but are not meant to limit or otherwise define its scope. All parts, percentages and ratios used herein are expressed as percent weight unless otherwise specified.

In the following Examples all levels are quoted as % by weight of the composition.

Detergent Composition Examples

In these Examples, the following abbreviation is used for a modified alkylbenzene sulfonate, sodium salt form or potassium salt form, prepared according to any of the preceding process examples: MLAS The following abbreviations are used for cleaning product adjunct materials:

| | |
|---|---|
| Cxy Amine Oxide | Alkyldimethylamine N-Oxide RN(O)Me2 of given chainlength Cxy where average total carbon range of the non-methyl alkyl moiety R is from 10 + *x* to 10 + *y* |
| Cxy APG | alkylpolyglycosides of the formula R2O(C*n*H2*n*O)*t*(glycosyl)*x* of given chainlength Cxy where R2 is a $C_{10-18}$ alkyl; *n* is 2 or 3, *t* is from 0 to about 10, preferably 0; and *x* is from about 1.3 to about 2.7. The glycosyl is preferably derived from glucose. |
| Amylase | Amylolytic enzyme of activity 60KNU/g sold by NOVO Industries A/S under the tradename Termamyl 60T. Alternatively, the amylase is selected from: Fungamyl ®; Duramyl ®; BAN ®; and α amylase enzymes described in WO95/26397 and in co-pending application by Novo Nordisk PCT/DK96/00056. |
| APA | C8–C10 amido propyl dimethyl amine |
| Cxy Betaine | Alkyldimethyl Betaine having an average total carbon range of alkyl moiety from 10 + *x* to 10 + *y* |
| Calcium Salt | Calcium chloride, Calcium sulfate, Calcium hydroxide, and mixtures thereof |
| Carbonate | $Na_2CO_3$ anhydrous, 200 μm–900 μm |
| Citrate | Trisodium citrate dihydrate, 86.4%, 425 μm–850 μm |
| Citric Acid | Citric Acid, Anhydrous |
| CMC | Sodium carboxymethyl cellulose |
| CxyAS | Alkyl sulfate, Na salt or other salt if specified having an average total carbon range of alkyl moiety from 10 + *x* to 10 + *y* |
| CxyEz | Commercial linear or branched alcohol ethoxylate (not having mid-chain methyl branching) and having an average total carbon range of alkyl moiety from 10 + *x* to 10 + *y* average z moles of ethylene oxide |
| CxyEzS | Alkyl ethoxylate sulfate, Na salt (or other salt if specified) having an average total carbon range of alkyl moiety from 10 + *x* to 10 + *y* and an average of z moles of ethylene oxide |
| DEA | diethanolamine |
| Diamine | Alkyl diamine, e.g., 1,3 propanediamine, Dytek EP, Dytek A, (Dupont) or selected from: dimethyl aminopropyl amine; 1,6-hexane diamine; 1,3 propane diamine; 2-methyl 1,5 pentane diamine; 1,3-pentanediamine; 1-methyl-diaminopropane; 1,3 cyclohexane diamine; 1,2 cyclohexane diamine; 1,3-bis(methylamine)-cyclohexane |
| DTPA | Diethylene triamine pentaacetic acid |
| DTPMP | Diethylene triamine penta (methylene phosphonate), Monsanto (Dequest 2060) |
| EtOH | Ethanol |
| Hydrotrope | selected from sodium, potassium, Magnesium, Calcium, ammonium or water-soluble substituted ammonium salts of toluene sulfonic acid, naphthalene sulfonic acid, cumene sulfonic acid, xylene sulfonic acid. |
| LAS | Linear Alkylbenzene Sulfonate (e.g., C11.8, Na or K salt) |
| Lipase | Lipolytic enzyme, 100kLU/g, NOVO, Lipolase ®. Alternatively, the lipase is selected from: Amano-P; M1 Lipase ®; Lipomax ®; D96L - lipolytic enzyme variant of the native lipase derived from *Humicola lanuginosa* as described in U.S. Ser. No. 08/341,826; and the *Humicola lanuginosa* strain DSM 4106. |
| LMFAA | C12–14 alkyl N-methyl glucamide |
| MA/AA | Copolymer 1:4 maleic/acrylic acid, Na salt, avg. mw. 70,000. |
| MBAxEy | Mid-chain branched primary alkyl ethoxylate (average total carbons = *x*; average EO = *y*) |
| MBAxEyS | Mid-chain branched or modified primary alkyl ethoxylate sulfate, Na salt (average total carbons = *x*; average EO = *y*) according to the invention (see Example 9) |
| MBAyS | Mid-chain branched primary alkyl sulfate, Na salt (average total carbons = *y*) |
| MEA | Monoethanolamine |
| Cxy MES | Alkyl methyl ester sulfonate, Na salt having an average total carbon range of alkyl moiety from 10 + *x* to 10 + *y* |
| Magnesium Salt | Magnesium chloride, Magnesium sulfate, magnesium hydroxide, and mixtures thereof |
| NaOH | Sodium hydroxide |

-continued

| | |
|---|---|
| Cxy NaPS | Paraffin sulfonate, Na salt having an average total carbon range of alkyl moiety from 10 + *x* to 10 + *y* |
| NaTS | Sodium toluene sulfonate |
| PAA | Polyacrylic Acid (mw = 4500) |
| PAE | Ethoxylated tetraethylene pentamine |
| PEG | Polyethylene glycol (mw = 4600) |
| PG | Propanediol |
| Protease | Proteolytic enzyme, 4KNPU/g, NOVO, Savinase ®. Alternatively, the protease is selected from: Maxatase ®; Maxacal ®; Maxapem 15 ®; subtilisin BPN and BPN'; Protease B; Protease A; Protease D; Primase ®; Durazym ®; Opticlean ®; and Optimase ®; and Alcalase ®. |
| Cxy SAS | Secondary alkyl sulfate, Na salt having an average total carbon range of alkyl moiety from 10 + *x* to 10 + *y* |
| Silicate | Sodium Silicate, amorphous ($SiO_2$:$Na_2O$; 2.0 ratio) |
| Solvent | hexylene glycol, ethanol, or propylene glycol |
| STPP | Sodium tripolyphosphate, anhydrous |
| Suds boosting polymer | (N,N-dimethylamino)alkyl acrylate; (N,N-dimethylamino)ethyl methacrylate homopolymer; Dimethylaminoethyl methacrylate/dimethylacrylamide copolymers; Poly(DMAM) homolymer; Poly(DMAM-co-AA) (2:1) Copolymer; Polypeptide comprising Lys, Ala, Glu, Tyr (5:6:2:1) having a molecular weight of approximately 52,000 daltons; |
| Sulfate | Sodium sulfate, anhydrous |
| TFA | C16–18 alkyl N-methyl glucamide |

Typical ingredients often referred to as "minors" can include perfuimes, dyes, pH trims etc.

The following example is illustrative of the present invention, but is not meant to limit or otherwise define its scope. All parts, percentages and ratios used are expressed as percent weight unless otherwise noted.

EXAMPLE 25

| Ingredient | Wt. % A | Wt. % B | Wt. % C | Wt. % D |
|---|---|---|---|---|
| MLAS (According to example 4) | 5 | 10 | 20 | 30 |
| Mid-Branched C12–13 alkyl ethoxylate (9 moles EO) | 1 | 1 | 1 | 1 |
| Sodium $C_{12-13}$ alkyl ethoxy (1–3) sulfate | 25 | 20 | 10 | 0 |
| $C_{12-14}$ Glucose Amide | 4 | 4 | 4 | 4 |
| Coconut amine oxide | 4 | 4 | 4 | 4 |
| EO/PO Block Co-polymer-Tetronic ® 704 | 0.5 | 0.5 | 0.5 | 0.5 |
| Ethanol | 6 | 6 | 6 | 6 |
| Hydrotrope | 5 | 5 | 5 | 5 |
| Magnesium$^{++}$ Salt | 3.0 | 3.0 | 3.0 | 3.0 |
| Water, thickeners and minors | to 100% | to 100% | to 100% | to 100% |
| pH @ 10% (as made) | 7.5 | 7.5 | 7.5 | 7.5 |

EXAMPLE 26

| | A | B | C |
|---|---|---|---|
| pH 10% | 9 | 10 | 10 |
| MLAS (according to example 7) | 0 | 28 | 25 |
| MLAS (according to example 8) | 30 | 0 | 0 |
| Amine Oxide (C12–14) | 5 | 3 | 7 |
| Betaine | 3 | 0 | 1 |
| Polyhydroxy fatty acid amide (C14) | 0 | 1.5 | 0 |
| AE nonionic | 2 | 0 | 4 |
| Diamine | 1 | 5 | 7 |
| Magnesium Salt | 0.25 | 0 | 0 |
| Citrate (cit2K3) | 0.25 | 0 | 0 |
| Total (perfumes, dye, water, ethanol, etc.) | | (to 100%) | |

-continued

| | D | E | F |
|---|---|---|---|
| pH 10% | 9.3 | 8.5 | 11 |
| MLAS (according to example 14) | 10 | 15 | 10 |
| Paraffin Sulfonate | 10 | 0 | 0 |
| Linear Alkyl Benzene Sulfonate | 5 | 15 | 12 |
| Betaine | 3 | 1 | 0 |
| Polyhydroxy fatty acid amide (C12) | 3 | 0 | 1 |
| AE nonionic | 0 | 0 | 20 |
| DTPA | 0 | 0.2 | 0 |
| Citrate (as Cit2K3) | 0.7 | 0 | 0 |
| Diamine | 1 | 5 | 7 |
| Magnesium Salt | 1 | 0 | 0 |
| Calcium Salt | 0 | 0.5 | 0 |
| Protease | 0.01 | 0 | 0.05 |
| Amylase | 0 | 0.05 | 0.05 |
| Hydrotrope | 2 | 1.5 | 3 |
| Total (perfumes, dye, water, ethanol, etc.) | | (to 100%) | |

EXAMPLE 27

| | A | B | C | D | E | F |
|---|---|---|---|---|---|---|
| pH 10% | 8.5 | 9 | 9.0 | 9.0 | 8.5 | 8.0 |
| MLAS (according to example 15) | 10 | 5 | 5 | 15 | 10 | 5 |
| Mid-branched alcohol ethoxy (0.6) Sulfate | 0 | 0 | 0 | 10 | 0 | 0 |
| Mid-branched alcohol ethoxy (1) Sulfate | 0 | 25 | 0 | 0 | 0 | 25 |
| Mid-branched alcohol ethoxy (1.4) Sulfate | 20 | 0 | 27 | 0 | 20 | 0 |
| Mid-branched alcohol ethoxy (2.2) Sulfate | 0 | 0 | 0 | 10 | 0 | 0 |
| Amine Oxide | 5 | 5 | 5 | 3 | 5 | 5 |
| Betaine | 3 | 3 | 0 | 0 | 3 | 3 |
| AE nonionic | 2 | 2 | 2 | 2 | 2 | 2 |
| Diamine | 1 | 2 | 4 | 2 | 0 | 0 |
| Magnesium Salt | 0.25 | 0.25 | 0 | 0 | 0.25 | 0 |
| Hydrotrope | 0 | 0.4 | 0 | 0 | 0 | 0 |
| Total (perfumes, dye, water, etbanol, etc.) | | | (to 100%) | | | |

| | G | H | I | J | K | L |
|---|---|---|---|---|---|---|
| pH 10% | 9.3 | 8.5 | 11 | 10 | 9 | 9.2 |
| Mid-branched alcohol ethoxy (0.6) Sulfate | 10 | 15 | 10 | 25 | 5 | 10 |
| Paraffin Sulfonate | 10 | 0 | 0 | 0 | 0 | 0 |
| LAS | 0 | 0 | 0 | 0 | 7 | 10 |
| MLAS (according to example 15) | 5 | 15 | 12 | 2 | 7 | 10 |
| Betaine | 3 | 1 | 0 | 2 | 2 | 0 |
| Amine Oxide | 0 | 0 | 0 | 2 | 5 | 7 |
| Polyhydroxy fatty acid amide (C12) | 3 | 0 | 1 | 2 | 0 | 0 |
| AE nonionic | 0 | 0 | 20 | 1 | 0 | 2 |
| Hydrotrope | 0 | 0 | 0 | 0 | 0 | 5 |
| Diamine | 1 | 5 | 7 | 2 | 2 | 5 |
| Magnesium Salt | 1 | 0 | 0 | .3 | 0 | 0 |
| Calcium Salt | 0 | 0.5 | 0 | 0 | 0.1 | 0.1 |

-continued

| | | | | | | |
|---|---|---|---|---|---|---|
| Protease | 0.1 | 0 | 0 | 0.05 | 0.06 | 0.1 |
| Amylase | 0 | 0.07 | 0 | 0.1 | 0 | 0.05 |
| Lipase | 0 | 0 | 0.025 | 0 | 0.05 | 0.05 |
| DTPA | 0 | 0.3 | 0 | 0 | 0.1 | 0.1 |
| Citrate (Cit2K3) | 0.65 | 0 | 0 | 0.3 | 0 | 0 |
| Total (perfumes, dye, water, ethanol, etc.) | | | (to 100%) | | | |

EXAMPLE 28

| | A | B | C | D | E |
|---|---|---|---|---|---|
| pH 10% | 8.5 | 9 | 10 | 10 | 10 |
| MLAS (according to example 17) | 0 | 0 | 0 | 15 | 0 |
| MLAS (according to example 18) | 0 | 30 | 0 | 0 | 33 |
| MLAS (according to example 18) | 30 | 0 | 27 | 0 | 0 |
| MLAS (according to example 19) | 0 | 0 | 0 | 15 | 0 |
| Amine Oxide | 5 | 5 | 5 | 3 | 6 |
| Betaine | 3 | 3 | 0 | 0 | 0 |
| AE nonionic | 2 | 2 | 2 | 2 | 4 |
| Diamine | 1 | 2 | 4 | 4 | 5 |
| K Citrate | 0.25 | 0.5 | 0 | 3.5 | 2 |
| Maleic Acid | 0.5 | 1 | 3 | 0 | 2 |
| Magnesium Salt | 0.25 | 0.25 | 0 | 0 | 0 |
| Hydrotrope | 0 | 0.4 | 0 | 0 | 0 |
| Total (perfumes, dye, water, ethanol, etc.) | | | (to 100%) | | |

EXAMPLE 29

| | A | B | C | D | E |
|---|---|---|---|---|---|
| $C_{12}E_{1.5}S$ | — | 9.66 | 9.3 | 22.4 | 2.0 |
| MLAS (According to example 23) | 11.2 | 13.71 | 20.4 | 13.4 | 12.8 |
| Nonionic | 0.158 | — | — | | 0.2 |
| Mg salt | 0.4 | 0.19 | 0.17 | 0.14 | 0.4 |
| Hydrotrope | | — | — | 2.31 | — |
| MEA/DEA | 0.1 | 1.07 | 2.3 | 1.4 | — |
| Antibacterial agent | — | 0.14 | — | | — |
| Solvent | | — | 2.6 | 4.5 | — |
| Water and minors | qs to 100% | qs to 100% | qs to 100% | qs to 100% | qs to 100% |
| 10% pH | 6.67 | 7.3 | 7.3 | 7.47 | 5.23 |

EXAMPLE 30

| | A | B | C | D | E |
|---|---|---|---|---|---|
| $C_{12}E_{1.5}S$ | 4 | — | | 6.7 | |
| $C_{12}E_{2.9}S$ | — | — | 2.2 | — | 14.3 |
| $C_{12}E_{3.7}S$ | — | — | — | — | |
| MLAS (According to example 23) | 7 | 25 | 17.8 | 0.6 | 6.0 |
| Nonionic | — | | 2.3 | | |
| Amine Oxide | | | | | 7.1 |
| Citrate | | | | | 0.8 |
| APG | | | | | 16.6 |
| Betaine | — | | | | |

-continued

| | A | B | C | D | E |
|---|---|---|---|---|---|
| Mg salt | 0.1 | 0.2 | 0.01 | 0.8 | |
| NaCl | — | | | | |
| Soap | 1 | | | | |
| Hydrotrope | — | | | | 4.3 |
| MEA/DEA | 0.1 | | 1.4 | 0.1 | 3.7 |
| Antibacterial agent | — | | | 0.06 | |
| Na2CO3 | — | 11.0 | | | |
| Silicate | | 2.0 | | | |
| Na2SO4 | 4.0 | 26.0 | | | 0.3 |
| Solvent | — | — | 1.6 | | 5.2 |
| Water and minors (perfume etc) | qs to 100% | qs to 100% | qs to 100% | qs to 100% | qs to 100% |
| form of composition | liquid | paste | gel | liquid | liquid |

EXAMPLE 31

| | A | B | C | D |
|---|---|---|---|---|
| $C_{12}E_{2.9}S$ | 4.0 | 2.0 | — | |
| $C_{12}E_{1.5}S$ | 4.0 | 2.0 | 9.0 | 22.0 |
| MLAS (According to example 24) | 2.0 | 4.0 | 26.7 | 1.35 |
| $C_{12}E_{2.9}$ | 20.6 | 20.6 | | |
| MEA | 1.4 | 1.4 | 2.0 | 1.5 |
| Hydrotrope | 1.1 | 1.1 | 3.0 | 2.5 |
| APG | — | — | 1.5 | 11 |
| polymeric thickener | — | — | 0.5 | |
| Betaine | 5.4 | 5.4 | | |
| NaCl | 1.1 | 1.1 | | |
| Solvent | — | — | | 4.5 |
| Mg salt | 0.11 | 0.11 | | 0.75 |
| perfume | 0.2 | 0.2 | 0.3 | 0.25 |
| Water and minors | qs to 100% | qs to 100% | qs to 100% | qs to 100% |
| pH of 10% solution | 4.9 | 4.9 | 7.5 | 7.5 |

EXAMPLE 33

| | A | B | C | D | E |
|---|---|---|---|---|---|
| AE0.6S | 6 | 10 | 13 | 15 | 20 |
| Amine oxide | 6.5 | 6.5 | 7.5 | 7.5 | 7.5 |
| C10E8 | 3 | 3 | 4.5 | 4.5 | 4.5 |
| MLAS (According to Example 4) | 20 | 16 | 13 | 11 | 6 |
| Diamine | 0.5 | 0.5 | 1.25 | 1 | 0 |
| Magnesium salt | 0.2 | 0.4 | 1.0 | 0 | 0.2 |
| Suds boosting polymer | 0 | 0.2 | 0.5 | 0.2 | 0.5 |
| Hydrotrope | 1.5 | 1.5 | 1 | 1 | 1 |
| Ethanol | 8 | 8 | 8 | 8 | 8 |
| Sodium Chloride | 0.5 | 0.5 | 0 | 0 | 0.2 |
| pH | 9 | 9 | 9 | 8 | 10 |

| | F | G | H | I |
|---|---|---|---|---|
| AE0.6S | 6 | 10 | 13 | 20 |
| Amine oxide | 6.50 | 6.50 | 6.50 | 7.20 |
| MLAS (According to Example 5) | 20 | 16 | 13 | 11 |
| Suds boosting polymer | 0.20 | 0.20 | 0.20 | 0.22 |
| Hydrotrope | 1.50 | 1.50 | 3.50 | 2.0 |
| Polypropylene glycol (MW | 1 | 1 | 1 | 1 |

-continued

| | | | | |
|---|---|---|---|---|
| 2700) | | | | |
| C10E8 | 3.00 | 3.00 | 3.00 | 3.30 |
| Diamine | 0.50 | 0 | 0 | 0.55 |
| Magnesium Salt | 0.22 | 0 | 0.5 | 0 |
| Sodium chloride | 0.5 | — | 0.5 | — |
| Water and Misc. | BAL. | BAL. | BAL. | BAL. |
| Viscosity (cps @ 70F) | 150 | 330 | 650 | 330 |
| pH @ 10% | 8.3 | 9.0 | 9.0 | 9.0 |

| | J | K |
|---|---|---|
| AE0.6S | 14.8 | 20 |
| MLAS (According to Example 15) | 14 | 8 |
| Amine oxide | 7.20 | 7.20 |
| Citric acid | 3.00 | — |
| Maleic acid | — | 2.50 |
| Magnesium Salt | 0.22 | 0.1 |
| Sodium chloride | 0.5 | — |
| Suds boosting polymer | 0.22 | 0.22 |
| Sodium Cumene Sulfonate | 3.30 | 3.30 |
| Ethanol | 6.50 | 6.50 |
| C10E8 | — | — |
| C11E9 | 3.33 | 3.33 |
| Diamine | 0.55 | 0.55 |
| Perfume | 0.31 | 0.31 |
| Water | BAL. | BAL. |
| Viscosity (cps @ 70F) | 330 | 330 |
| pH @ 10% | 9.0 | 9.0 |

EXAMPLE 34

| | A | B | C | D | E | F | G | H |
|---|---|---|---|---|---|---|---|---|
| MLAS | 14.2 | 14.3 | 6.5 | 13.1 | 10 | 27 | 8 | 15 |
| AE1S | — | — | — | 21.3 | 14 | 9 | | 5 |
| AE0.8S | — | 16.8 | 20.5 | | | | 11 | |
| AS | 9.6 | — | — | | | | | |
| AE3S | 11.4 | | | | | | | |
| APG | — | — | — | 10 | 7 | 2 | 4 | 2 |
| Amide MEA | 4.0 | 3.8 | 3.8 | | | | | |
| MEA/DEA | | | | 2.9 | 2 | 2 | 1 | 1 |
| Betaine | — | — | 1.5 | | | | 0.3 | |
| C10E8 | — | 4.0 | 4.0 | | | | | |
| Mg salt | 0.3 | 0.29 | 0.35 | 0.2 | 0.3 | | | |
| Water and minors | qs to 100% | qs to 100% | qs to 100% | qs to 100% | qs to 100% | qs to 100% | qs to 100% | qs to 100% |

| | I | J | K | L | M | N | O |
|---|---|---|---|---|---|---|---|
| MLAS | 13 | 13 | 7 | 20 | 19 | 22 | 18.4 |
| AE1S | 5 | 22 | | 9 | 13 | 11 | |
| AE0.8S | | | 21 | | | | |
| AS | | | | | | | |
| AE3S | | | | | | | 18.4 |
| APG | | 11 | 6 | | | | |
| Amide MEA | 1 | | | | | 1 | 4.3 |
| MEA/DEA | | 2 | 2 | 2 | | | |
| Betaine | | | | | 2 | | |
| C10E8 | | | | | 1 | 2 | |
| Mg salt | | | | | | | |
| Water and minors | qs to 100% | qs to 100% | qs to 100% | qs to 100% | qs to 100% | qs to 100% | qs to 100% |

What is claimed is:

1. A hand dishwashing detergent composition comprising:

(i) from about 0.01% to about 95% by weight of composition of a modified alkylbenzene sulfonate surfactant mixture comprising:

(a) from about 60% to about 95% by weight of surfactant mixture, a mixture of branched alkylbenzene sulfonates having formula (I):

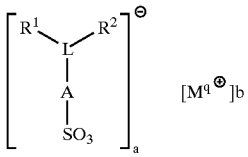

wherein L is an acyclic aliphatic moiety consisting of carbon and hydrogen, said L having two methyl termini and said L having no substituents other than A, $R^1$ and $R^2$; and wherein said mixture of branched alkylbenzene sulfonates contains two or more of said branched alkylbenzene sulfonates differing in molecular weight of the anion of said formula (I) and wherein said mixture of branched alkylbenzene sulfonates has a sum of carbon atoms in $R^1$, L and $R^2$ of from 9 to 15;

an average aliphatic carbon content of from about 10.0 to about 14.0 carbon atoms; M is a cation or cation mixture having a valence q; a and b are integers selected such that said branched alkylbenzene sulfonates are electroneutral; $R^1$ is $C_1$–$C_3$ alkyl; $R^2$ is selected from H and $C_1$–$C_3$ alkyl; A is a benzene moiety; and (b) from about 5% to about 40% by weight of surfactant mixture, of a mixture of nonbranched alkylbenzene sulfonates having formula (II):

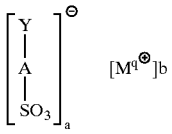

(II)

wherein a, b, M, A and q are as defined hereinbefore and Y is an unsubstituted linear aliphatic moiety consisting of carbon and hydrogen having two methyl termini, and wherein said Y has a sum of carbon atoms of from 9 to 15, and said Y has an average aliphatic carbon content of from about 10.0 to about 14.0; and wherein said modified alkylbenzene sulfonate surfactant mixture is further characterized by a 2/3-phenyl index of from about 275 to about 10,000;

(i) from about 0.00001% to about 99.9% by weight of composition of a conventional hand dishwashing adjunct;

wherein said composition is further characterized by a 2/3-phenyl index of from about 275 to about 10,000.

2. A hand dishwashing detergent composition according to claim 1 wherein said Y has a sum of caron atoms of from 10 to 14.

3. A hand dishwashing detergent composition according to claim 1 wherein said M is selected from H, Na, K and mixtures thereof, said a=1, said b=1, said q=1, and said modified alkylbenzene sulfonate surfactant mixture has a 2-methyl-2-phenyl index of less than about 0.3.

4. A hand dishwashing detergent composition according to claim 3 wherein said 2-methyl-2-phenyl index is from 0 to about 0.1.

5. A hand dishwashing detergent composition according to claim 4 wherein said modified alkylbenzene sulfonate surfactant mixture is the product of a process using as catalyst a zeolite selected from mordenite, offretite and H-ZSM-12 in at least partially acidic form.

6. A hand dishwashing detergent composition according to claim 5 wherein said catalyst is an acidic mordenite.

7. A hand dishwashing detergent composition comprising:

(i) from about 0.1% to about 95% by weight of composition of a medium 2/3-phenyl surfactant system consisting essentially of:

(1) from 1% to about 60% by weight of surfactant system of a first alkylbenzene sulfonate surfactant, wherein said first alkylbenzene sulfonate surfactant is a modified alkylbenzene sulfonate surfactant mixture, said surfactant mixture comprising:

(a) from about 60% to about 95% by weight of surfactant mixture, a mixture of branched alkylbenzene sulfonates having formula (I):

(I)

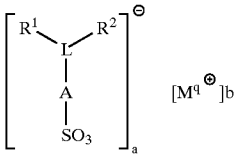

wherein L is an acyclic aliphatic moiety consisting of carbon and hydrogen, said L having two methyl termini and said L having no substituents other than A, $R^1$ and $R^2$; and wherein said mixture of branched alkylbenzene sulfonates contains two or more of said branched alkylbenzene sulfonates differing in molecular weight of the anion of said formula (I) and wherein said mixture of branched alkylbenzene sulfonates has a sum of carbon atoms in $R^1$, L and $R^2$ of from 9 to 15;

an average aliphatic carbon content of from about 10.0 to about 14.0 carbon atoms; M is a cation or cation mixture having a valence q; a and b are integers selected such that said branched alkylbenzene sulfonates are electroneutral; $R^1$ is $C_1$–$C_3$ alkyl; $R^2$ is selected from H and $C_1$–$C_3$ alkyl; A is a benzene moiety; and (b) from about 5% to about 40% by weight of surfactant mixture, of a mixture of nonbranched alkylbenzene sulfonates having formula (II):

(II)

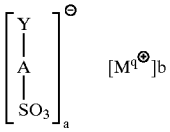

wherein a, b, M, A and q are as defined hereinbefore and Y is an unsubstituted linear aliphatic moiety consisting of carbon and hydrogen having two methyl termini, and wherein said Y has a sum of carbon atoms of from 9 to 15, and said Y has an average aliphatic carbon content of from about 10.0 to about 14.0; and wherein said modified alkylbenzene sulfonate surfactant mixture is further characterized by a 2/3-phenyl index of from about 275 to about 10,000; and (2) from 40% to about 99%, by weight of surfactant system of a second alkylbenzene sulfonate surfactant, wherein said second alkylbenzene sulfonate surfactant is an alkylbenzene sulfonate surfactant mixture other than said modified alkylbenzene sulfonate surfactant mixture (1), and wherein said second alkylbenzene sulfonate surfactant has a 2/3-phenyl index of from about 75 to about 160;

provided that said medium 2/3-phenyl surfactant system has a 2/3-phenyl index of from about 160 to about 275;

(i) from about 0.00001% to about 99.9% by weight of composition of a conventional hand dishwashing adjunct.

8. A hand dishwashing detergent composition according to claim 7 wherein said Y has a sum of caron atoms of from 10 to 14.

9. A hand dishwashing detergent composition according to claim 7 wherein said modified alkylbenzene sulfonate surfactant mixture consists essentially of said mixture of (a) and (b), wherein said 2-methyl-2-phenyl index of said modified alkylbenzene sulfonate surfactant mixture is less than about 0.1, and said average aliphatic carbon content is from about 11.5 to about 12.5 carbon atoms; said $R^1$ is methyl; said $R^2$ is selected from H and methyl provided that in at least about 0.7 mole fraction of said branched alkylbenzene sulfonates $R^2$ is H; and wherein said sum of carbon atoms in $R^1$, L and $R^2$ is from 10 to 14; and further wherein in said mixture of nonbranched alkylbenzene sulfonates, said Y has a sum of carbon atoms of from 10 to 14 carbon atoms, said average aliphatic carbon content of said nonbranched alkylbenzene sulfonates is from about 11.5 to about 12.5 carbon atoms, and said M is a monovalent cation or cation mixture selected from H, Na and mixtures thereof.

10. A hand dishwashing detergent composition comprising:

(i) a modified alkylbenzene sulfonate surfactant mixture comprising the product of a process comprising the steps of:

(I) alkylating benzene with an alkylating mixture;

(II) sulfonating the product of (I); and (III) neutralizing the product of (II);

wherein said alkylating mixture comprises:

(a) from about 1% to about 99.9%, by weight of alkylating mixture of branched $C_9$–$C_{20}$ monoolefins, said branched monoolefins having structures identical with those of the branched monoolefins formed by dehydrogenating branched paraffins of formula $R^1LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of alkylating mixture of $C_9$–$C_{20}$ linear aliphatic olefins;

wherein said alkylating mixture contains said branched $C_9$–$C_{20}$ monoolefins having at least two different carbon numbers in said $C_9$–$C_{20}$ range, and has a mean carbon content of from about 9.0 to about 15.0 carbon atoms; and wherein said components (a) and (b) are at a weight ratio of at least about 15:85;

(ii) from about 0.00001% to about 99.9% by weight of composition of a conventional hand dishwashing adjunct;

wherein said composition is further characterized by a 2/3-phenyl index of from about 275 to about 10,000.

11. A hand dishwashing detergent composition comprising:

(i) A modified alkylbenzene sulfonate surfactant mixture consisting essentially of the product of a process comprising the steps, in sequence, of:

(I) alkylating benzene with an alkylating mixture;
(II) sulfonating the product of (I); and
(III) neutralizing the product of (II);
wherein said alkylating mixture comprises:
(a) from about 1% to about 99.9%, by weight of alkylating mixture of a branched alkylating agent selected from the group consisting of:
(A) $C_9$–$C_{20}$ internal monoolefins $R^1LR^2$ wherein L is an acyclic olefinic moiety consisting of carbon and hydrogen and containing two terminal methyls;
(B) $C_9$–$C_{20}$ alpha monoolefins $R^1AR^2$ wherein A is an acyclic alpha-olefinic moiety consisting of carbon and hydrogen and containing one terminal methyl and one terminal olefinic methylene;
(C) $C_9$–$C_{20}$ vinylidene monoolefins $R^1BR^2$ wherein B is an acyclic vinylidene olefin moiety consisting of carbon and hydrogen and containing two terminal methyls and one internal olefinic methylene;
(D) $C_9$–$C_{20}$ primary alcohols $R^1QR^2$ wherein Q is an acyclic aliphatic primary terminal alcohol moiety consisting of carbon, hydrogen and oxygen and containing one terminal methyl;
(E) $C_9$–$C_{20}$ primary alcohols $R^1ZR^2$ wherein Z is an acyclic aliphatic primary nonterminal alcohol moiety consisting of carbon, hydrogen and oxygen and containing two terminal methyls; and
(F) mixtures thereof;
wherein in any of (A)–(F), said $R^1$ is $C_1$ to $C_3$ alkyl and said $R^2$ is selected from H and $C^1$ to $C_3$ alkyl; and
(b) from about 0.1% to about 85%, by weight of alkylating mixture of $C_9$–$C_{20}$ linear alkylating agent selected from $C_9$–$C_{20}$ linear aliphatic olefins, $C_9$–$C_{20}$ linear aliphatic alcohols and mixtures thereof;
wherein said alkylating mixture contains said branched alkylating agents having at least two different carbon numbers in said $C_9$–$C_{20}$ range, and has a mean carbon content of from about 9.0 to about 15.0 carbon atoms; and wherein said components (a) and (b) are at a weight ratio of at least about 15:85;
(i) from about 0.00001% to about 99.9% by weight of composition of a conventional hand dishwashing adjunct;
wherein said composition is further characterized by a 2/3-phenyl index of from about 275 to about 10,000.

12. A hand dishwashing composition according to claim 11 wherein said alkylating mixture consists essentially of:
(a) from about 0.5% to about 47.5%, by weight of alkylating mixture of said branched alkylating agent selected from:
(G) $C_9$–$C_{14}$ internal monoolefins $R^1LR^2$ wherein L is an acyclic olefinic moiety consisting of carbon and hydrogen and containing two terminal methyls;
(H) $C_9$–$C_{14}$ alpha monoolefins $R^1AR^2$ wherein A is an acyclic alpha-olefinic moiety consisting of carbon and hydrogen and containing one terminal methyl and one terminal olefinic methylene; and
(J) mixtures thereof;
wherein in any of (G), (H) and (J), said $R^1$ is methyl, and said $R^2$ is H or methyl provided that in at least about 0.7 mole fraction of the total of said monoolefins, $R^2$ is H; and
(b) from about 0.1% to about 25%, by weight of alkylating mixture of $C_9$–$C_{14}$ linear aliphatic olefins; and
(c) from about 50% to about 98.9%, by weight of alkylating mixture of carrier materials selected from paraffins and inert nonparaffinic solvents;
wherein said alkylating mixture contains said branched alkylating agents having at least two different carbon numbers in said $C_9$–$C_{14}$ range, and has a mean carbon content of from about 11.5 to about 12.5 carbon atoms; and wherein said components (a) and (b) are at a weight ratio of from about 51:49 to about 90:10.

13. A hand dishwashing composition according to claim 12 wherein in step (I), said alkylation is performed in the presence of an alkylation catalyst, said alkylation catalyst is an intermediate acidity solid porous alkylation catalyst, and step (II) comprises removal of components other than monoalkylbenzene prior to contacting the product of step (I) with sulfonating agent.

14. A hand dishwashing composition according to claim 12 wherein said alkylation catalyst is other than a member selected from the group consisting of HF, $AlCl_3$, sulfuric acid and mixtures thereof.

15. A hand dishwashing composition according to claim 12 wherein a hydrotrope, hydrotrope precursor, or mixtures thereof is added after step (I).

16. A hand dishwashing composition according to claim 12 wherein a hydrotrope, hydrotrope precursor or mixtures thereof is added during or after step (II) and prior to step (III).

17. A hand dishwashing composition according to claim 12 wherein a hydrotrope is added during or after step (III).

18. A hand dishwashing composition according to claim 12 wherein said alkylation catalyst is selected from the group consisting of non-fluoridated acidic mordenite-type catalyst, fluoridated acidic mordenite-type catalyst and mixtures thereof.

19. A hand dishwashing composition according to claim 12 wherein in step (I) said alkylation is performed at a temperature of from about 125° C. to about 230° C. and at a pressure of from about 50 psig to about 1000 psig.

20. A hand dishwashing composition according to claim 12 wherein step (II) is performed using a sulfonating agent selected from the group consisting of sulfur trioxide, sulfur trioxide/air mixtures, and sulfuric acid.

21. A hand dishwashing composition comprising:
(i) from about 0.01% to about 95% by weight of composition of a modified alkylbenzene sulfonate surfactant mixture comprising:
(a) from about 60% to about 95% by weight of surfactant mixture, a mixture of branched alkylbenzene sulfonates having formula (I):

(I)

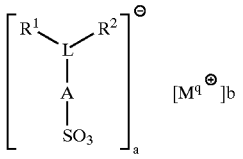

wherein L is an acyclic aliphatic moiety consisting of carbon and hydrogen, said L having two methyl termini and said L having no substituents other than A, $R^1$ and $R^2$; and wherein said mixture of branched alkylbenzene sulfonates contains two or more of said branched alkylbenzene sulfonates differing in molecular weight of the anion of said formula (I) and wherein said mixture of branched alkylbenzene sulfonates has a sum of carbon atoms in $R^1$, L and $R^2$ of from 9 to 15;

an average aliphatic carbon content of from about 10.0 to about 14.0 carbon atoms; M is a cation or cation mixture having a valence q; a and b are integers selected such that said branched alkylbenzene sulfonates are electroneutral; $R^1$ is $C_1$–$C_3$ alkyl; $R^2$ is selected from H and $C_1$–$C_3$ alkyl; A is a benzene moiety; and (b) from about 5% to about 40% by weight of surfactant mixture, of a mixture of nonbranched alkylbenzene sulfonates having formula (II):

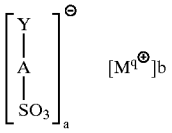

(II)

wherein a, b, M, A and q are as defined hereinbefore and Y is an unsubstituted linear aliphatic moiety consisting of carbon and hydrogen having two methyl termini, and wherein said Y has a sum of carbon atoms of from 9 to 15, and said Y has an average aliphatic carbon content of from about 10.0 to about 14.0; and wherein said modified alkylbenzene sulfonate surfactant mixture is further characterized by a 2/3-phenyl index of from about 275 to about 10,000 and wherein said modified alkylbenzene sulfonate surfactant mixture has a 2-methyl-2-phenyl index of less than about 0.3;

(ii) from about 0.00001% to about 99.9% by weight of composition of a conventional hand dishwashing adjunct; and (iii) from about 0.00001% to about 99.9% of composition of a surfactant selected from the group consisting of anionic surfactants other than those of (i), nonionic surfactants, zwitterionic surfactants, cationic surfactants, amphoteric surfactant and mixtures thereof;

wherein said composition is further characterized by a 2/3-phenyl index of from about 275 to about 10,000; provided that when said composition comprises any alkylbenzene sulfonate surfactant other than said modified alkylbenzene sulfonate surfactant mixture, said composition is further characterized by an overall 2/3-phenyl index of at least about 200, wherein said overall 2/3-phenyl index is determined by measuring 2/3-phenyl index, as defined herein, on a blend of said modified alkylbenzene sulfonate surfactant mixture and said any other alkylbenzene sulfonate to be added to said composition, said blend, for purposes of measurement, being prepared from aliquots of said modified alkylbenzene sulfonate surfactant mixture and said other alkylbenzene sulfonate not yet exposed to any other of the components of said composition; and further provided that when said composition comprises any alkylbenzene sulfonate surfactant other than said modified alkylbenzene sulfonate surfactant mixture, said composition is further characterized by an overall 2-methyl-2-phenyl index of less than about 0.3, wherein said overall 2-methyl-2-phenyl index is to be determined by measuring 2-methyl-2-phenyl index, as defined herein, on a blend of said modified alkylbenzene sulfonate surfactant mixture and any other alkylbenzene sulfonate to be added to said composition, said blend, for purposes of measurement, being prepared from aliquots of said modified alkylbenzene sulfonate surfactant mixture and said other alkylbenzene sulfonate not yet exposed to any other of the components of said composition.

22. A hand dishwashing detergent composition according to claim 21 wherein said Y has a sum of caron atoms of from 10 to 14.

23. A hand dishwashing composition according to claim 21 which is substantially free from alkylbenzene sulfonate surfactants other than said modified alkylbenzene sulfonate surfactant mixture.

24. A hand dishwashing composition according to claim 21 which comprises, in said component (iii), at least about 0.1%, of a commercial $C_{10}$–$C_{14}$ linear alkylbenzene sulfonate surfactant.

25. A hand dishwashing composition according to claim 21 which comprises, in said component (iii), at least about 0.1% of a commercial highly branched alkylbenzene sulfonate surfactant.

26. A hand dishwashing composition according to claim 21 which comprises, in said component (iii), a nonionic surfactant at a level of from about 0.5% to about 25% by weight of said detergent composition, and wherein said nonionic surfactant is a polyalkoxylated alcohol in capped or non-capped form having:

a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof and a hydrophilic group selected from 1–15 ethoxylates, 1–15 propoxylates 1–15 butoxylates and mixtures thereof, in capped or uncapped form.

27. A hand dishwashing composition according to claim 21 which comprises, in said component (iii), an alkyl sulfate surfactant at a level of from about 0.5% to about 25% by weight of said detergent composition, wherein said alkyl sulfate surfactant has a hydrophobic group selected from linear $C_{10}$–$C_{18}$ alkyl, mid-chain $C_1$–$C_3$ branched $C_{10}$–$C_{18}$ alkyl, guerbet branched $C_{10}$–$C_{18}$ alkyl, and mixtures thereof and a cation selected from Na, K and mixtures thereof.

28. A hand dishwashing composition according to claim 21 which comprises, in said component (iii), an alkyl (polyalkoxy)sulfate surfactant at a level of from about 0.5% to about 25% by weight of said detergent composition, wherein said alkyl(polyalkoxy)sulfate surfactant has a hydrophobic group selected from linear $C_{10}$–$C_{16}$ alkyl, mid-chain $C_1$–$C_3$ branched $C_{10}$–$C_{16}$alkyl, guerbet branched $C_{10}$–$C_{16}$alkyl, and mixtures thereof; and a (polyalkoxy)sulfate hydrophilic group selected from 1–15 polyethoxysulfate, 1–15 polypropoxysulfate, 1–15 polybutoxysulfate, 1–15 mixed poly(ethoxy/propoxy/butoxy)sulfates, and mixtures thereof, in capped or uncapped form; and a cation selected from Na, K and mixtures thereof.

* * * * *